US010577725B2

(12) United States Patent
Kurihara et al.

(10) Patent No.: US 10,577,725 B2
(45) Date of Patent: Mar. 3, 2020

(54) FIBER AND FIBER STRUCTURE

(75) Inventors: Hideshi Kurihara, Chiyoda-ku (JP); Kiyotsuna Toyohara, Iwakuni (JP); Shinichiro Shoji, Iwakuni (JP); Tomoyoshi Yamamoto, Matsuyama (JP); Akimichi Oda, Iwakuni (JP)

(73) Assignee: TEIJIN LIMITED, Osaka (JP)

( * ) Notice: Subject to any disclaimer, the term of this patent is extended or adjusted under 35 U.S.C. 154(b) by 67 days.

(21) Appl. No.: 13/496,449

(22) PCT Filed: Sep. 9, 2010

(86) PCT No.: PCT/JP2010/065994
§ 371 (c)(1),
(2), (4) Date: Mar. 15, 2012

(87) PCT Pub. No.: WO2011/034113
PCT Pub. Date: Mar. 24, 2011

(65) Prior Publication Data

US 2012/0184166 A1 Jul. 19, 2012

(30) Foreign Application Priority Data

Sep. 16, 2009 (JP) ..... 2009-214325
Oct. 13, 2009 (JP) ..... 2009-236297
(Continued)

(51) Int. Cl.
*D03D 15/00* (2006.01)
*D04H 13/00* (2006.01)
(Continued)

(52) U.S. Cl.
CPC ..... *D01F 6/625* (2013.01); *D01F 6/80* (2013.01); *D01F 6/82* (2013.01); *D01F 6/84* (2013.01);
(Continued)

(58) Field of Classification Search
CPC ..... D02G 3/00; C07D 267/22; C07D 245/00; C07D 225/04
See application file for complete search history.

(56) References Cited

U.S. PATENT DOCUMENTS 3,776,882 A 12/1973 Witzler et al.
5,246,992 A 9/1993 Wick et al.
(Continued)

FOREIGN PATENT DOCUMENTS

CN 101490127 A 7/2009
DE 2 020 330 A1 11/1971
(Continued)

OTHER PUBLICATIONS

Chemistry and Technology of carbodiimides, Cyclic carbodiimides; Chapter 11; Henri Ulrich; Nov. 19, 2007.*
(Continued)

*Primary Examiner* — Jennifer A Chriss
*Assistant Examiner* — Ricardo E Lopez
(74) *Attorney, Agent, or Firm* — Sughrue Mion, PLLC

(57) ABSTRACT

Provided is a fiber containing a composition obtained by mixing a compound having at least a ring structure containing one carbodiimide group, the first nitrogen and second nitrogen thereof being linked together through a linking group, with a polymer compound having an acidic group. Also provided is a fiber structure made thereof. A fiber and a fiber structure, which have improved hydrolysis resistance and from which no free isocyanate compounds are produced, can be provided.

17 Claims, 2 Drawing Sheets

(30) Foreign Application Priority Data

| | | |
|---|---|---|
| Dec. 17, 2009 | (JP) | 2009-286437 |
| Dec. 17, 2009 | (JP) | 2009-286438 |
| Jan. 26, 2010 | (JP) | 2010-014344 |
| May 14, 2010 | (JP) | 2010-112070 |
| May 17, 2010 | (JP) | 2010-113000 |
| May 17, 2010 | (JP) | 2010-113001 |
| May 17, 2010 | (JP) | 2010-113002 |
| Jun. 8, 2010 | (JP) | 2010-130950 |
| Jun. 8, 2010 | (JP) | 2010-130951 |
| Jun. 8, 2010 | (JP) | 2010-130952 |
| Jun. 8, 2010 | (JP) | 2010-130953 |
| Jun. 8, 2010 | (JP) | 2010-130954 |
| Jun. 8, 2010 | (JP) | 2010-130955 |
| Jun. 8, 2010 | (JP) | 2010-130956 |
| Jun. 10, 2010 | (JP) | 2010-132927 |
| Jun. 16, 2010 | (JP) | 2010-137329 |
| Jun. 23, 2010 | (JP) | 2010-142772 |

(51) Int. Cl.

| | |
|---|---|
| ***D02G 3/00*** | (2006.01) |
| ***C08G 63/08*** | (2006.01) |
| ***D01F 6/62*** | (2006.01) |
| ***D01F 6/80*** | (2006.01) |
| ***D01F 6/82*** | (2006.01) |
| ***D01F 6/84*** | (2006.01) |

(52) U.S. Cl.
CPC ..... *Y10T 428/2913* (2015.01); *Y10T 442/30* (2015.04); *Y10T 442/60* (2015.04)

(56) References Cited

U.S. PATENT DOCUMENTS

| | | | | |
|---|---|---|---|---|
| 5,811,508 | A | 9/1998 | Zeitler et al. | |
| 5,885,709 | A | 3/1999 | Wick et al. | |
| 7,163,743 | B2 * | 1/2007 | Atwood et al. | 428/375 |
| 2008/0161554 | A1 * | 7/2008 | Dai et al. | 540/454 |
| 2009/0318628 | A1 | 12/2009 | Tanaka et al. | |
| 2010/0004362 | A1 * | 1/2010 | Ikegame | D01D 5/084 524/117 |
| 2010/0093888 | A1 * | 4/2010 | Endo et al. | 523/124 |

FOREIGN PATENT DOCUMENTS

| | | | | | |
|---|---|---|---|---|---|
| EP | 0 503 421 | A1 | | 9/1992 | |
| JP | 11-92636 | A | | 4/1999 | |
| JP | 2925280 | B2 | | 7/1999 | |
| JP | 2005-2174 | A | | 1/2005 | |
| JP | 2008-50584 | A | | 3/2008 | |
| JP | WO 2008029934 | A1 | * | 3/2008 | D01D 5/084 |
| JP | WO-2008102919 | | * | 8/2008 | |
| JP | 2009084759 | A | * | 4/2009 | |
| TW | 200831725 | A | | 8/2008 | |
| WO | WO 2008/010355 | A1 | | 1/2008 | |
| WO | WO 2008/029934 | A1 | | 3/2008 | |
| WO | WO 2010/071212 | A1 | | 6/2010 | |
| WO | WO 2010/071213 | A1 | | 6/2010 | |

OTHER PUBLICATIONS

Machine Translation of JP-2009-084759 A.*
European Search Report for corresponding Application No. 10817226.3 dated May 28, 2013.
Communication dated Nov. 26, 2018, from Intellectual Property India in counterpart application No. 1715/DELNP/2012.

* cited by examiner

FIBER AND FIBER STRUCTURE

TECHNICAL FIELD

The invention relates to a fiber containing a composition having a polymer compound end-capped with a carbodiimide compound; and also to a fiber structure.

BACKGROUND ART

It has already been proposed to use a carbodiimide compound as an end-capping agent for a polymer compound terminated with acidic groups, such as carboxyl groups, thereby inhibiting the hydrolysis of the polymer compound (Patent Document 1). The carbodiimide compound used in this proposal is a linear carbodiimide compound. When a linear carbodiimide compound is used as an end-capping agent for a polymer compound, upon the reaction that attaches the linear carbodiimide compound to the ends of the polymer compound, an isocyanate-group-containing compound is released. This results in the characteristic odor of an isocyanate compound, causing a problem in that the working environment is deteriorated.

[Patent Document 1] JP-A-2008-50584

[Patent Document 2] JP-A-2005-2174

DISCLOSURE OF THE INVENTION

An object of the invention is to provide a fiber containing a composition having a polymer compound end-capped with a carbodiimide compound which has a specific structure without the release of an isocyanate compound; and a fiber structure.

Means for Solving the Problems

The present inventors conducted extensive research on capping agents whose reaction with an acidic group, such as a carboxyl group, does not causes the release of an isocyanate compound. As a result, they found that a carbodiimide compound having a ring structure does not causes the release of an isocyanate compound upon reaction with an acidic group, whereby a good working environment can be maintained. The invention was thus accomplished.

That is, the invention includes the following inventions.

1. A fiber containing a composition obtained by mixing:

a compound having at least a ring structure containing one carbodiimide group with the first nitrogen and second nitrogen thereof being linked together through a linking group; with a polymer compound having an acidic group.

2. A fiber according to 1 above, wherein the ring structure is represented by the following formula (1), and the number of atoms forming the ring structure is 8 to 50:

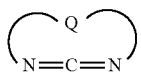

(1)

wherein Q is a divalent to tetravalent linking group that is an aliphatic group, an alicyclic group, an aromatic group, or a combination thereof and optionally contains a heteroatom.

3. A fiber according to 2 above, wherein Q is a divalent to tetravalent linking group represented by the following formula (1-1), (1-2), or (1-3):

$$—Ar^1—(O—X^1)_s—O—Ar^2— \quad (1\text{-}1)$$

$$—R^1—(O—X^2)_k—O—R^2— \quad (1\text{-}2)$$

$$—X^3— \quad (1\text{-}3)$$

wherein $Ar^1$ and $Ar^2$ are each independently a divalent to tetravalent aromatic group having 5 to 15 carbon atoms, $R^1$ and $R^2$ are each independently a divalent to tetravalent aliphatic group having 1 to 20 carbon atoms, a divalent to tetravalent alicyclic group having 3 to 20 carbon atoms, a combination thereof, or a combination of the aliphatic or alicyclic group with a divalent to tetravalent aromatic group having 5 to 15 carbon atoms, $X^1$ and $X^2$ are each independently a divalent to tetravalent aliphatic group having 1 to 20 carbon atoms, a divalent to tetravalent alicyclic group having 3 to 20 carbon atoms, a divalent to tetravalent aromatic group having 5 to 15 carbon atoms, or a combination thereof, s is an integer of 0 to 10 and k is an integer of 0 to 10, with the proviso that when s or k is 2 or more, $X^1$ or $X^2$ as a repeating unit may be different from the other $X^1$ or $X^2$, and $X^3$ is a divalent to tetravalent aliphatic group having 1 to 20 carbon atoms, a divalent to tetravalent alicyclic group having 3 to 20 carbon atoms, a divalent to tetravalent aromatic group having 5 to 15 carbon atoms, or a combination thereof, with the proviso that $Ar^1$, $Ar^2$, $R^1$, $R^2$, $X^1$, $X^2$, and $X^3$ optionally contain a heteroatom, when Q is a divalent linking group, $Ar^1$, $Ar^2$, $R^1$, $R^2$, $X^1$, $X^2$, and $X^3$ are all divalent groups, when Q is a trivalent linking group, one of $Ar^1$, $Ar^2$, $R^1$, $R^2$, $X^1$, $X^2$, and $X^3$ is a trivalent group, and when Q is a tetravalent linking group, one of $Ar^1$, $Ar^2$, $R^1$, $R^2$, $X^1$, $X^2$, and $X^3$ is a tetravalent group or two of $Ar^1$, $Ar^2$, $R^1$, $R^2$, $X^1$, $X^2$, and $X^3$ are trivalent groups.

4. A fiber according to 1 above, wherein the compound having a ring structure is represented by the following formula (2):

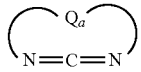

(2)

wherein $Q_a$ is a divalent linking group that is an aliphatic group, an alicyclic group, an aromatic group, or a combination thereof and optionally contains a heteroatom.

5. A fiber according to 4 above, wherein Qa is a divalent linking group represented by the following formula (2-1), (2-2), or (2-3):

$$—Ar_a^1—(O—X_a^1)_s—O—Ar_a^2— \quad (2\text{-}1)$$

$$—R_a^1—(O—X_a^2)_k—O—R_a^2— \quad (2\text{-}2)$$

$$—X_a^3— \quad (2\text{-}3)$$

wherein $Ar_a^1$, $Ar_a^2$, $R_a^1$, $R_a^2$, $X_a^1$, $X_a^2$, $X_a^3$, s, and k are as defined for $Ar^1$, $Ar^2$, $R^1$, $R^2$, $X^1$, $X^2$, $X^3$, s, and k of formulae (1-1) to (1-3), respectively.

6. A fiber according to 1 above, wherein the compound having a ring structure is represented by the following formula (3):

(3)

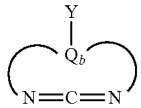

wherein $Q_b$ is a trivalent linking group that is an aliphatic group, an alicyclic group, an aromatic group, or a combination thereof and optionally contains a heteroatom, and Y is a carrier that supports the ring structure.

7. A fiber according to 6 above, wherein $Q_b$ is a trivalent linking group represented by the following formula (3-1), (3-2), or (3-3):

$$—Ar_b^1—(O—X_b^1)_s—O—Ar_b^2— \quad (3\text{-}1)$$

$$—R_b^1—(O—X_b^2)_k—O—R_b^2— \quad (3\text{-}2)$$

$$—X_b^3— \quad (3\text{-}3)$$

wherein $Ar_b^1$, $Ar_b^2$, $R_b^1$, $R_b^2$, $X_b^1$, $X_b^2$, $X_b^3$, s, and k are as defined for $Ar^1$, $Ar^2$, $R^1$, $R^2$, $X^1$, $X^2$, $X^3$, s, and k of formulae (1-1) to (1-3), respectively, with the proviso that one of the groups is a trivalent group.

8. A fiber according to 6 above, wherein Y is a single bond, a double bond, an atom, an atomic group, or a polymer.

9. A fiber according to 1 above, wherein the compound having a ring structure is represented by the following formula (4):

(4)

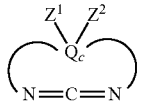

wherein $Q_c$ is a tetravalent linking group that is an aliphatic group, an aromatic group, an alicyclic group, or a combination thereof and optionally contains a heteroatom, and $Z^1$ and $Z^2$ are carriers that support the ring structure.

10. A fiber according to 9 above, wherein Qc is a tetravalent linking group represented by the following formula (4-1), (4-2), or (4-3):

$$—Ar_c^1—(O—X_c^1)_s—O—Ar_c^2— \quad (4\text{-}1)$$

$$—R_c^1—(O—X_c^2)_k—O—R_c^2— \quad (4\text{-}2)$$

$$—X_c^3— \quad (4\text{-}3)$$

wherein $Ar_c^1$, $Ar_c^2$, $R_c^1$, $R_c^2$, $X_c^1$, $X_c^2$, $X_c^3$, s, and k are as defined for $Ar^1$, $Ar^2$, $R^1$, $R^2$, $X^1$, $X^2$, $X^3$, s, and k of formulae (1-1) to (1-3), respectively, with the proviso that one of the groups is a tetravalent group or two of the groups are trivalent groups.

11. A fiber according to 9 above, wherein $Z^1$ and $Z^2$ are each independently a single bond, a double bond, an atom, an atomic group, or a polymer.

12. A fiber according to 1 above, wherein the polymer compound having an acidic group is at least one member selected from the group consisting of aromatic polyesters, aliphatic polyesters, polyamides, polyamideimide, and polyester amides.

13. A fiber according to claim 12 above, wherein the aromatic polyester contains as a main repeating unit at least one member selected from the group consisting of butylene terephthalate, ethylene terephthalate, trimethylene terephthalate, ethylene naphthalene dicarboxylate, and butylene naphthalene dicarboxylate.

14. A fiber according to 12 above, wherein the aliphatic polyester is polylactic acid.

15. A fiber according to 14 above, wherein the polylactic acid forms a stereocomplex crystal.

16. A fiber structure using at least a fiber according to claim 1.

17. A fiber structure according to 16 above, wherein the fiber structure is in at least one form selected from a textured yarn, a woven fabric, a knitted fabric, and a nonwoven fabric.

Advantage of the Invention

The invention enables the provision of a fiber containing a composition having a polymer compound end-capped with a carbodiimide compound without the release of an isocyanate compound; and a fiber structure. As a result, the generation of an offensive odor originating from a free isocyanate compound can be suppressed, whereby the working environment can be improved.

MODE FOR CARRYING OUT THE INVENTION

Figure 1:
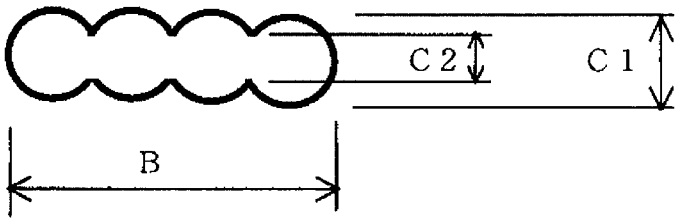
FIG. 1 shows an embodiment of the modified shape of a transverse cross-section of a fiber usable in the invention.

The invention will be described in detail hereinafter.

<Ring Structure>

In the invention, a carbodiimide compound has a ring structure (hereinafter, the carbodiimide compound is sometimes simply referred to as "cyclic carbodiimide compound"). The cyclic carbodiimide compound may have a plurality of ring structures.

The ring structure has one carbodiimide group (—N=C=N—), and the first nitrogen and second nitrogen thereof are linked together through a linking group. One ring structure has only one carbodiimide group. However, in the case where a plurality of ring structures are present in the molecule, such as the case of spiro rings, when each of the ring structures connected to the spiro atom has one carbodiimide group, the compound itself may have a plurality of carbodiimide groups, of course. The number of atoms in the ring structure is preferably 8 to 50, more preferably 10 to 30, still more preferably 10 to 20, and particularly preferably 10 to 15.

The number of atoms in the ring structure herein means the number of atoms directly forming the ring structure. For example, in the case of an 8-membered ring, it is 8, and in the case of a 50-membered ring, it is 50. This is because when the number of atoms in the ring structure is less than 8, the cyclic carbodiimide compound has reduced stability and may be difficult to store or use. This is also because although there is no particular upper limit on the number of ring members in terms of reactivity, when the number of atoms is more than 50, such a cyclic carbodiimide compound is difficult to synthesize, and this may greatly increase the cost. From such points of view, the number of atoms in the ring structure is preferably within a range of 10 to 30, more preferably 10 to 20, and particularly preferably 10 to 15.

It is preferable that the ring structure is a structure represented by the following formula (1).

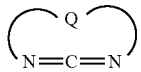

(1)

In the formula, Q is a divalent to tetravalent linking group that is an aliphatic group, an alicyclic group, an aromatic group, or a combination thereof, each optionally containing a heteroatom and a substituent. Heteroatoms herein include O, N, S, and P.

Of the valences of the linking group, two valences are used to form the ring structure. In the case where Q is a trivalent or tetravalent linking group, it is linked to a polymer or another ring structure via a single bond, a double bond, an atom, or an atomic group.

The linking group is a divalent to tetravalent aliphatic group having 1 to 20 carbon atoms, a divalent to tetravalent alicyclic group having 3 to 20 carbon atoms, a divalent to tetravalent aromatic group having 5 to 15 carbon atoms, or a combination thereof, each optionally containing a heteroatom and a substituent. A linking group having a number of carbon atoms necessary for forming the ring structure specified above is selected. As an example of the combination, the structure like an alkylene-arylene group, in which an alkylene group and an arylene group are linked together, is mentioned.

It is preferable that the linking group (Q) is a divalent to tetravalent linking group represented by the following formula (1-1), (I-2), or (1-3).

$$—Ar^1—(—O—X^1—)_s—O—Ar^2— \quad (1\text{-}1)$$

$$—R^1—(—O—X^2—)_k—O—R^2— \quad (1\text{-}2)$$

$$—X^3— \quad (1\text{-}3)$$

In the formula, $Ar^1$ and $Ar^2$ are each independently a divalent to tetravalent aromatic group having 5 to 15 carbon atoms and optionally containing a heteroatom and a substituent. Examples of aromatic groups include $C_{5-15}$ arylene groups, $C_{5-15}$ arenetriyl groups, and $C_{5-15}$ arenetetrayl groups, each optionally containing a heteroatom and having a heterocyclic structure. Examples of arylene groups (divalent) include a phenylene group and a naphthalenediyl group. Examples of arenetriyl groups (trivalent) include a benzenetriyl group and a naphthalenetriyl group. Examples of arenetetrayl groups (tetravalent) include a benzenetetrayl group and a naphthalenetetrayl group. These aromatic groups may be substituted. Examples of substituents include a $C_{1-20}$ alkyl group, a $C_{6-15}$ aryl group, a halogen atom, a nitro group, an amide group, a hydroxyl group, an ester group, an ether group, and an aldehyde group.

$R^1$ and $R^2$ are each independently a divalent to tetravalent aliphatic group having 1 to 20 carbon atoms, a divalent to tetravalent alicyclic group having 3 to 20 carbon atoms, a combination thereof, or a combination of the aliphatic or alicyclic group with a divalent to tetravalent aromatic group having 5 to 15 carbon atoms, each optionally containing a heteroatom and a substituent.

Examples of aliphatic groups include $C_{1-20}$ alkylene groups, $C_{1-20}$ alkanetriyl groups, and $C_{1-20}$ alkanetetrayl groups. Examples of alkylene groups include a methylene group, an ethylene group, a propylene group, a butylene group, a pentylene group, a hexylene group, a heptylene group, an octylene group, a nonylene group, a decylene group, a dodecylene group, and a hexadecylene group. Examples of alkanetriyl groups include a methanetriyl group, an ethanetriyl group, a propanetriyl group, a butanetriyl group, a pentanetriyl group, a hexanetriyl group, a heptanetriyl group, an octanetriyl group, a nonanetriyl group, a decanetriyl group, a dodecanetriyl group, and a hexadecanetriyl group. Examples of alkanetetrayl groups include a methanetetrayl group, an ethanetetrayl group, a propanetetrayl group, a butanetetrayl group, a pentanetetrayl group, a hexanetetrayl group, a heptanetetrayl group, an octanetetrayl group, a nonanetetrayl group, a decanetetrayl group, a dodecanetetrayl group, and a hexadecanetetrayl group. These aliphatic groups may be substituted. Examples of substituents include a $C_{1-20}$ alkyl group, a $C_{6-15}$ aryl group, a halogen atom, a nitro group, an amide group, a hydroxyl group, an ester group, an ether group, and an aldehyde group.

Examples of alicyclic groups include $C_{3-20}$ cycloalkylene groups, $C_{3-20}$ cycloalkanetriyl groups, and $C_{3-20}$ cycloalkanetetrayl groups. Examples of cycloalkylene groups include a cyclopropylene group, a cyclobutylene group, a cyclopentylene group, a cyclohexylene group, a cycloheptylene group, a cyclooctylene group, a cyclononylene group, a cyclodecylene group, a cyclododecylene group, and a cyclohexadecylene group. Examples of alkanetriyl groups include a cyclopropanetriyl group, a cyclobutanetriyl group, a cyclopentanetriyl group, a cyclohexanetriyl group, a cycloheptanetriyl group, a cyclooctanetriyl group, a cyclononanetriyl group, a cyclodecanetriyl group, a cyclododecanetriyl group, and a cyclohexadecanetriyl group. Examples of alkanetetrayl groups include a cyclopropanetetrayl group, a cyclobutanetetrayl group, a cyclopentanetetrayl group, a cyclohexanetetrayl group, a cycloheptanetetrayl group, a cyclooctanetetrayl group, a cyclononanetetrayl group, a cyclodecanetetrayl group, a cyclododecanetetrayl group, and a cyclohexadecanetetrayl group. These alicyclic groups may be substituted. Examples of substituents include a $C_{1-20}$ alkyl group, a $C_{6-15}$ aryl group, a halogen atom, a nitro group, an amide group, a hydroxyl group, an ester group, an ether group, and an aldehyde group.

Examples of aromatic groups include $C_{5-15}$ arylene groups, $C_{5-15}$ arenetriyl groups, and $C_{5-15}$ arenetetrayl groups, each optionally containing a heteroatom and having a heterocyclic structure. Examples of arylene groups include a phenylene group and a naphthalenediyl group. Examples of arenetriyl groups (trivalent) include a benzenetriyl group and a naphthalenetriyl group. Examples of arenetetrayl groups (tetravalent) include a benzenetetrayl group and a naphthalenetetrayl group. These aromatic groups may be substituted. Examples of substituents include a $C_{1-20}$ alkyl group, a $C_{6-15}$ aryl group, a halogen atom, a nitro group, an amide group, a hydroxyl group, an ester group, an ether group, and an aldehyde group.

In the above formulae (1-1) and (1-2), $X^1$ and $X^2$ are each independently a divalent to tetravalent aliphatic group having 1 to 20 carbon atoms, a divalent to tetravalent alicyclic group having 3 to 20 carbon atoms, a divalent to tetravalent aromatic group having 5 to 15 carbon atoms, or a combination thereof, each optionally containing a heteroatom and a substituent.

Examples of aliphatic groups include $C_{1-20}$ alkylene groups, $C_{1-20}$ alkanetriyl groups, and $C_{1-20}$ alkanetetrayl groups. Examples of alkylene groups include a methylene group, an ethylene group, a propylene group, a butylene group, a pentylene group, a hexylene group, a heptylene group, an octylene group, a nonylene group, a decylene group, a dodecylene group, and a hexadecylene group. Examples of alkanetriyl groups include a methanetriyl group, an ethanetriyl group, a propanetriyl group, a butanetriyl group, a pentanetriyl group, a hexanetriyl group, a heptanetriyl group, an octanetriyl group, a nonanetriyl group, a decanetriyl group, a dodecanetriyl group, and a hexadecanetriyl group. Examples of alkanetetrayl groups include a methanetetrayl group, an ethanetetrayl group, a propanetetrayl group, a butanetetrayl group, a pentanetetrayl group, a hexanetetrayl group, a heptanetetrayl group, an octanetetrayl group, a nonanetetrayl group, a decanetetrayl group, a dodecanetetrayl group, and a hexadecanetetrayl group. These aliphatic groups may be substituted. Examples of substituents include a $C_{1-20}$ alkyl group, a $C_{6-25}$ aryl group, a halogen atom, a nitro group, an amide group, a hydroxyl group, an ester group, an ether group, and an aldehyde group.

Examples of alicyclic groups include $C_{3-20}$ cycloalkylene groups, $C_{3-20}$ cycloalkanetriyl groups, and $C_{3-20}$ cycloalkanetetrayl groups. Examples of cycloalkylene groups include a cyclopropylene group, a cyclobutylene group, a cyclopentylene group, a cyclohexylene group, a cycloheptylene group, a cyclooctylene group, a cyclononylene group, a cyclodecylene group, a cyclododecylene group, and a cyclohexadecylene group. Examples of alkanetriyl groups include a cyclopropanetriyl group, a cyclobutanetriyl group, a cyclopentanetriyl group, a cyclohexanetriyl group, a cycloheptanetriyl group, a cyclooctanetriyl group, a cyclononanetriyl group, a cyclodecanetriyl group, a cyclododecanetriyl group, and a cyclohexadecanetriyl group. Examples of alkanetetrayl groups include a cyclopropanetetrayl group, a cyclobutanetetrayl group, a cyclopentanetetrayl group, a cyclohexanetetrayl group, a cycloheptanetetrayl group, a cyclooctanetetrayl group, a cyclononanetetrayl group, a cyclodecanetetrayl group, a cyclododecanetetrayl group, and a cyclohexadecanetetrayl group. These alicyclic groups may be substituted. Examples of substituents include a $C_{1-20}$ alkyl group, a $C_{6-15}$ aryl group, a halogen atom, a nitro group, an amide group, a hydroxyl group, an ester group, an ether group, and an aldehyde group.

Examples of aromatic groups include $C_{5-15}$ arylene groups, $C_{5-15}$ arenetriyl groups, and $C_{5-15}$ arenetetrayl groups, each optionally containing a heteroatom and having a heterocyclic structure. Examples of arylene groups include a phenylene group and a naphthalenediyl group. Examples of arenetriyl groups (trivalent) include a benzenetriyl group and a naphthalenetriyl group. Examples of arenetetrayl groups (tetravalent) include a benzenetetrayl group and a naphthalenetetrayl group. These aromatic groups may be substituted. Examples of substituents include a $C_{1-20}$ alkyl group, a $C_{6-15}$ aryl group, a halogen atom, a nitro group, an amide group, a hydroxyl group, an ester group, an ether group, and an aldehyde group.

In the above formulae (1-1) and (1-2), s and k are an integer of 0 to 10, preferably an integer of 0 to 3, and more preferably an integer of 0 to 1. This is because when s and k are more than 10, such a cyclic carbodiimide compound is difficult to synthesize, and this may greatly increase the cost. From such a point of view, the integer is preferably within a range of 0 to 3. Incidentally, when s or k is 2 or more, $X^1$ or $X^2$ as a repeating unit may be different from the other $X^1$ or $X^2$.

In the above formula (1-3), $X^3$ is a divalent to tetravalent aliphatic group having 1 to 20 carbon atoms, a divalent to tetravalent alicyclic group having 3 to 20 carbon atoms, a divalent to tetravalent aromatic group having 5 to 15 carbon atoms, or a combination thereof, each optionally containing a heteroatom and a substituent.

Examples of aliphatic groups include $C_{1-20}$ alkylene groups, $C_{1-20}$ alkanetriyl groups, and $C_{1-20}$ alkanetetrayl groups. Examples of alkylene groups include a methylene group, an ethylene group, a propylene group, a butylene group, a pentylene group, a hexylene group, a heptylene group, an octylene group, a nonylene group, a decylene group, a dodecylene group, and a hexadecylene group. Examples of alkanetriyl groups include a methanetriyl group, an ethanetriyl group, a propanetriyl group, a butanetriyl group, a pentanetriyl group, a hexanetriyl group, a heptanetriyl group, an octanetriyl group, a nonanetriyl group, a decanetriyl group, a dodecanetriyl group, and a hexadecanetriyl group. Examples of alkanetetrayl groups include a methanetetrayl group, an ethanetetrayl group, a propanetetrayl group, a butanetetrayl group, a pentanetetrayl group, a hexanetetrayl group, a heptanetetrayl group, an octanetetrayl group, a nonanetetrayl group, a decanetetrayl group, a dodecanetetrayl group, and a hexadecanetetrayl group. These aliphatic groups may be substituted. Examples of substituents include a $C_{1-20}$ alkyl group, a $C_{6-25}$ aryl group, a halogen atom, a nitro group, an amide group, a hydroxyl group, an ester group, an ether group, and an aldehyde group.

Examples of alicyclic groups include $C_{3-20}$ cycloalkylene groups, $C_{3-20}$ cycloalkanetriyl groups, and $C_{3-20}$ cycloalkanetetrayl groups. Examples of cycloalkylene groups include a cyclopropylene group, a cyclobutylene group, a cyclopentylene group, a cyclohexylene group, a cycloheptylene group, a cyclooctylene group, a cyclononylene group, a cyclodecylene group, a cyclododecylene group, and a cyclohexadecylene group. Examples of alkanetriyl groups include a cyclopropanetriyl group, a cyclobutanetriyl group, a cyclopentanetriyl group, a cyclohexanetriyl group, a cycloheptanetriyl group, a cyclooctanetriyl group, a cyclononanetriyl group, a cyclodecanetriyl group, a cyclododecanetriyl group, and a cyclohexadecanetriyl group. Examples of alkanetetrayl groups include a cyclopropanetetrayl group, a cyclobutanetetrayl group, a cyclopentanetetrayl group, a cyclohexanetetrayl group, a cycloheptanetetrayl group, a cyclooctanetetrayl group, a cyclononanetetrayl group, a cyclodecanetetrayl group, a cyclododecanetetrayl group, and a cyclohexadecanetetrayl group. These alicyclic groups may be substituted. Examples of substituents include a $C_{1-20}$ alkyl group, a $C_{6-15}$ arylene group, a halogen atom, a nitro group, an amide group, a hydroxyl group, an ester group, an ether group, and an aldehyde group.

Examples of aromatic groups include $C_{5-15}$ arylene groups, $C_{5-15}$ arenetriyl groups, and $C_{5-15}$ arenetetrayl groups, each optionally containing a heteroatom and having a heterocyclic structure. Examples of arylene groups include a phenylene group and a naphthalenediyl group. Examples of arenetriyl groups (trivalent) include a benzenetriyl group and a naphthalenetriyl group. Examples of arenetetrayl groups (tetravalent) include a benzenetetrayl group and a naphthalenetetrayl group. These aromatic groups may be substituted. Examples of substituents include a $C_{1-20}$ alkyl group, a $C_{6-15}$ aryl group, a halogen atom, a nitro group, an amide group, a hydroxyl group, an ester group, an ether group, and an aldehyde group.

$Ar^1$, $Ar^2$, $R^1$, $R^2$, $X^1$, $X^2$, and $X^3$ optionally contain a heteroatom. When Q is a divalent linking group, $Ar^1$, $Ar^2$, $R^1$, $R^2$, $X^1$, $X^2$, and $X^3$ are all divalent groups. When Q is a trivalent linking group, one of $Ar^1$, $Ar^2$, $R^1$, $R^2$, $X^1$, $X^2$, and $X^3$ is a trivalent group. When Q is a tetravalent linking group, one of $Ar^1$, $Ar^2$, $R^1$, $R^2$, $X^1$, $X^2$, and $X^3$ is a tetravalent group or two of $Ar^1$, $Ar^2$, $R^1$, $R^2$, $X^1$, $X^2$, and $X^3$ are trivalent groups.

As cyclic carbodiimide compounds for use in the invention, compounds represented by the following (a) to (c) are mentioned.

<Cyclic Carbodiimide Compound (a)>

As the cyclic carbodiimide compound for use in the invention, a compound represented by the following formula (2) (hereinafter sometimes referred to as "cyclic carbodiimide compound (a)") can be mentioned.

(2)

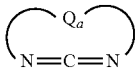

In the formula, $Q_a$ is a divalent linking group that is an aliphatic group, an alicyclic group, an aromatic group, or a combination thereof and optionally contains a heteroatom. The aliphatic group, the alicyclic group, and the aromatic group are as defined with respect to formula (1). However, in the compound of formula (2), the aliphatic group, the alicyclic group, and the aromatic group are all divalent. It is preferable that $Q_a$ is a divalent linking group represented by the following formula (2-1), (2-2), or (2-3).

$$—Ar_a^1—(O—X_a^1)_s—O—Ar_a^2— \quad (2\text{-}1)$$

$$—R_a^1—(O—X_a^2)_k—O—R_a^2— \quad (2\text{-}2)$$

$$—X_a^3— \quad (2\text{-}3)$$

In the formulae, $Ar_a^1$, $Ar_a^2$, $R_a^1$, $R_a^2$, $X_a^1$, $X_a^2$, $X_a^3$, s, and k are as defined for $Ar^1$, $Ar^2$, $R^1$, $R^2$, $X^1$, $X^2$, $X^3$, s, and k in the formulae (1-1) to (1-3), respectively. However, they are all divalent.

Examples of such cyclic carbodiimide compounds (a) include the following compounds.

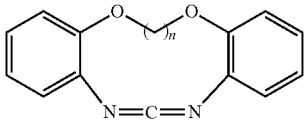

(n=an integer of 1 to 6)

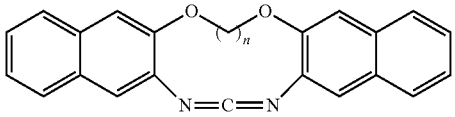

(n=an integer of 1 to 6)

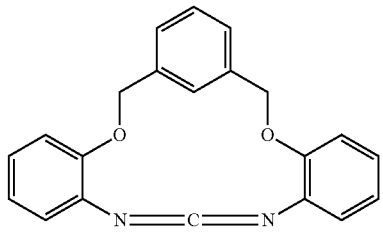

(m=an integer of 0 to 3, n=an integer of 0 to 3)

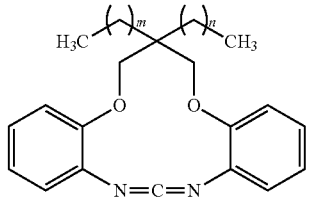

(m=an integer of 0 to 5, n=an integer of 0 to 5)

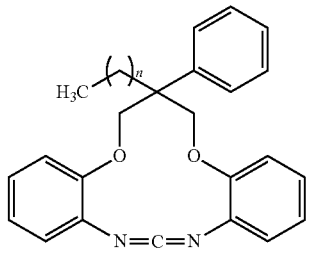

(n=an integer of 0 to 5)

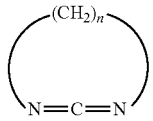

(n=an integer of 5 to 20)

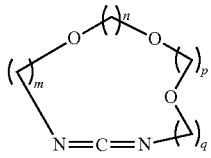

(m, n, p, q=an integer of 1 to 6)

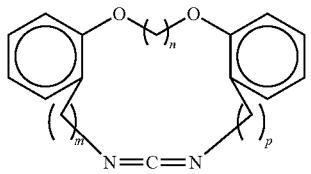

(m, n, p, q=an integer of 1 to 6)

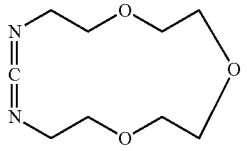

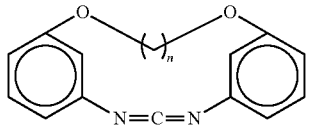

(n=an integer of 1 to 6)

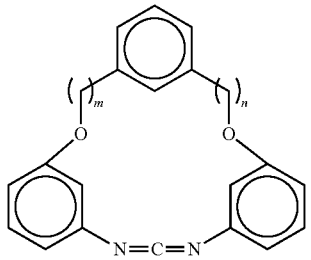

(m, n=an integer of 0 to 3)

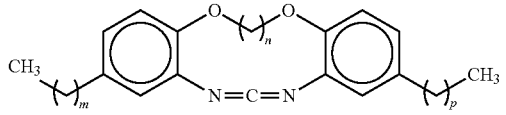

(m, p=an integer of 1 to 5, n=an integer of 1 to 6)

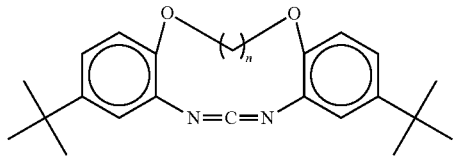

(n=an integer of 1 to 6)

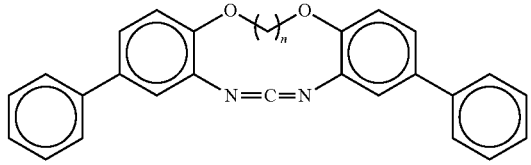

(n=an integer of 1 to 6)<

<Cyclic Carbodiimide Compound (b)>

Further, as the cyclic carbodiimide compound for use in the invention, a compound represented by the following formula (3) (hereinafter sometimes referred to as "cyclic carbodiimide compound (b)") can be mentioned.

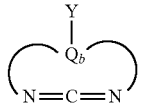

(3)

In the formula, $Q_b$ is a trivalent linking group that is an aliphatic group, an alicyclic group, an aromatic group, or a combination thereof and optionally contains a heteroatom. Y is a carrier that supports the ring structure. The aliphatic group, the alicyclic group, and the aromatic group are as defined with respect to formula (1). However, in the compound of formula (3), one of the groups forming $Q_b$ is trivalent.

It is preferable that $Q_b$ is a trivalent linking group represented by the following formula (3-1), (3-2), or (3-3).

$$—Ar_b^1—(O—X_b^1)_s—O—Ar_b^2— \quad (3\text{-}1)$$

$$—R_b^1—(O—X_b^2)_k—O—R_b^2— \quad (3\text{-}2)$$

$$—X_b^3— \quad (3\text{-}3)$$

In the formulae, $Ar_b^1$, $Ar_b^2$, $R_b^1$, $R_b^2$, $X_b^1$, $X_b^2$, $X_b^3$, s, and k are as defined for $Ar^1$, $Ar^2$, $R^1$, $R^2$, $X^1$, $X^2$, $X^3$, s, and k of formulae (1-1) to (1-3), respectively. However, one of them is a trivalent group. It is preferable that Y is a single bond, a double bond, an atom, an atomic group, or a polymer. Y is a linking site, and a plurality of ring structures are linked together through Y, forming the structure represented by formula (3).

Examples of such cyclic carbodiimide compounds (b) include the following compounds.

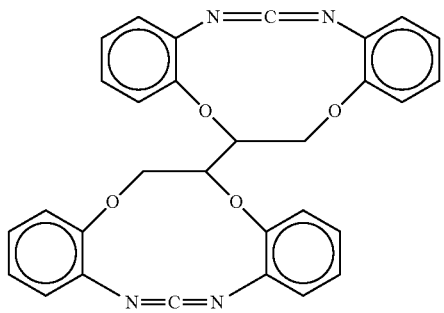

-continued

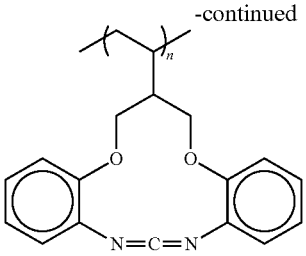

(n is a repeating unit)

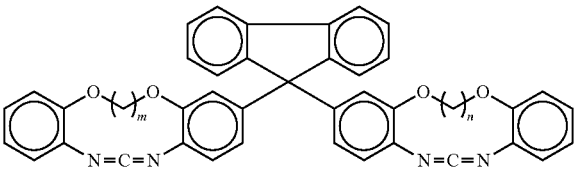

(m, n=an integer of 1 to 6)

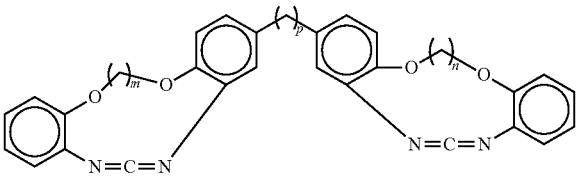

(p, m, n=an integer of 1 to 6)

<Cyclic Carbodiimide Compound (c)>

As the cyclic carbodiimide compound for use in the invention, a compound represented by the following formula (4) (hereinafter sometimes referred to as "cyclic carbodiimide compound (c)") can be mentioned.

(4)

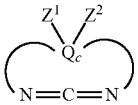

In the formula, $Q_c$ is a tetravalent linking group that is an aliphatic group, an alicyclic group, an aromatic group, or a combination thereof and optionally contains a heteroatom. $Z^1$ and $Z^2$ are carriers that support the ring structure. $Z^1$ and $Z^2$ may be joined together to form a ring structure.

The aliphatic group, the alicyclic group, and the aromatic group are as defined with respect to formula (1). However, in the compound of formula (4), Qc is tetravalent. Therefore, one of these groups is a tetravalent group or two of them are trivalent groups.

It is preferable that $Q_c$ is a tetravalent linking group represented by the following formula (4-1), (4-2), or (4-3).

$$—Ar_c^1—(—O—X_c^1—)_s—O—Ar_c^2— \quad (4\text{-}1)$$

$$—R_c^1—(—O—X_c^2—)_k—O—R_c^2— \quad (4\text{-}2)$$

$$—X_c^3— \quad (4\text{-}3)$$

In the formulae, $Ar_c^1$, $Ar_c^2$, $R_c^1$, $R_c^2$, $X_c^1$, $X_c^2$, $X_c^3$, s, and k are as defined for $Ar^1$, $Ar^2$, $R^1$, $R^2$, $X^1$, $X^2$, $X^3$, s, and k in formulae (1-1) to (1-3), respectively, However, with respect to $Ar_c^1$, $Ar_c^2$, $R_c^1$, $R_c^2$, $X_c^1$, $X_c^2$, and $X_c^3$, one of them is a tetravalent group or two of them are trivalent groups. It is preferable that $Z^1$ and $Z^2$ are each independently a single bond, a double bond, an atom, an atomic group, or a polymer. $Z^1$ and $Z^2$ are linking sites. A plurality of ring structures are linked together through $Z^1$ and $Z^2$, forming the structure represented by formula (4).

Examples of such cyclic carbodiimide compounds (c) include the following compounds.

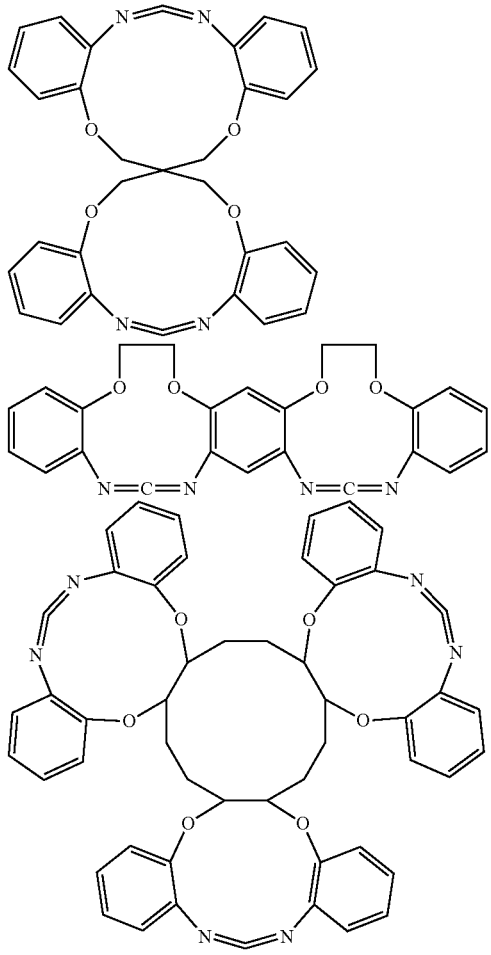

<Polymer Compound>

In the invention, a polymer compound to which the cyclic carbodiimide compound is applied has an acidic group. As the acidic group, at least one group selected from the group consisting of a carboxyl group, a sulfonic acid group, a sulfinic acid group, a phosphonic acid group, and a phosphinic acid group is mentioned.

As the polymer compound, at least one member selected from the group consisting of polyesters, polyamides, polyamideimide, and polyester amides is mentioned.

Examples of polyesters include polymers and copolymers obtained by the polycondensation of at least one member selected from dicarboxylic acids or ester-forming derivatives thereof with diols or ester-forming derivatives thereof, hydroxycarboxylic acids or ester-forming derivatives thereof, and lactones. A thermoplastic polyester resin is preferable, for example.

For moldability, etc., such a thermoplastic polyester resin may have a crosslinked structure formed by treatment with a radical-generating source, such as energy active radiation, an oxidizing agent, or the like.

Examples of the dicarboxylic acids and ester-forming derivatives thereof mentioned above include aromatic dicarboxylic acids such as terephthalic acid, isophthalic acid, phthalic acid, 2,6-naphthalenedicarboxylic acid, 1,5-naphthalenedicarboxylic acid, bis(p-carboxyphenyl)methane, anthracenedicarboxylic acid, 4,4'-diphenyl ether dicarboxylic acid, 5-tetrabutylphosphonium isophthalic acid, and 5-sodium sulfoisophthalic acid; aliphatic dicarboxylic acids such as oxalic acid, succinic acid, adipic acid, sebacic acid, azelaic acid, dodecanedioic acid, malonic acid, glutaric acid, and dimer acid; alicyclic dicarboxylic acid units such as 1,3-cyclohexanedicarboxylic acid and 1,4-cyclohexanedicarboxylic acid; and ester-forming derivatives thereof.

Examples of the diols and ester-forming derivatives thereof mentioned above include $C_{2-20}$ aliphatic glycols, i.e., ethylene glycol, propylene glycol, 1,3-butanediol, 1,4-butanediol, neopentyl glycol, 1,5-pentanediol, 1,6-hexanediol, decamethylene glycol, cyclohexane dimethanol, cyclohexanediol, dimer diol, etc.; long-chain glycols having a molecular weight of 200 to 100,000, i.e., polyethylene glycol, poly-1,3-propylene glycol, poly-1,2-propylene glycol, polytetramethylene glycol, etc.; aromatic dioxy compounds, i.e., 4,4'-dihydroxybiphenyl, hydroquinone, tert-butyl hydroquinone, bisphenol-A, bisphenol-S, bisphenol-F, etc.; and ester-forming derivatives thereof.

Examples of the hydroxycarboxylic acids mentioned above include glycolic acid, lactic acid, hydroxypropionic acid, hydroxybutyric acid, hydroxyvaleric acid, hydroxycaproic acid, hydroxybenzoic acid, p-hydroxybenzoic acid, and 6-hydroxy-2-naphthoic acid, as well as ester-forming derivatives thereof. Examples of the lactones mentioned above include caprolactone, valerolactone, propiolactone, undecalactone, and 1,5-oxepan-2-one.

Specific examples of polymers and copolymers thereof are as follows. Examples of aromatic polyesters obtained by the polycondensation of, as main components, an aromatic dicarboxylic acid or an ester-forming derivative thereof and an aliphatic diol or an ester-forming derivative thereof include polymers obtained by the polycondensation of, as main components, an aromatic carboxylic acid or an ester-forming derivative thereof, preferably terephthalic acid, naphthalene 2,6-dicarboxylic acid, or an ester-forming derivative thereof, and an aliphatic diol selected from ethylene glycol, propylene glycol, 1,3-butanediol, and butanediol or an ester-forming derivative thereof.

Specific preferred examples thereof include polyethylene terephthalate, polyethylene naphthalate, polytrimethylene terephthalate, polypropylene naphthalate, polybutylene terephthalate, polybutylene naphthalate, polyethylene(terephthalate/isophthalate), polytrimethylene(terephthalate/isophthalate), polybutylene(terephthalate/isophthalate), polyethylene terephthalate-polyethylene glycol, polytrimethylene terephthalate-polyethylene glycol, polybutylene terephthalate-polyethylene glycol, polybutylene naphthalate-polyethylene glycol, polyethylene terephthalate-poly(tetramethylene oxide) glycol, polytrimethylene terephthalate-poly(tetramethylene oxide) glycol, polybutylene terephthalate-poly(tetramethylene oxide) glycol, polybutylene naphthalate-poly(tetramethylene oxide) glycol, polyethylene(terephthalate/isophthalate)-poly(tetramethylene oxide) glycol, polytrimethylene(terephthalate/isophthalate)-poly(tetramethylene oxide) glycol, polybutylene(terephthalate/isophthalate)-poly(tetramethylene oxide) glycol, polybutylene(terephthalate/succinate), polyethylene (terephthalate/succinate), polybutylene(terephthalate/adipate), and polyethylene(terephthalate/adipate).

Examples of aliphatic polyester resins include polymers containing an aliphatic hydroxycarboxylic acid as a main component, polymers obtained by the polycondensation of an aliphatic polycarboxylic acid or an ester-forming derivative thereof and an aliphatic polyalcohol as main components, and copolymers thereof.

Examples of polymers containing an aliphatic hydroxycarboxylic acid as a main component include polycondensates of glycolic acid, lactic acid, hydroxypropionic acid, hydroxybutyric acid, hydroxyvaleric acid, hydroxycaproic acid, and the like, as well as copolymers thereof. In particular, polyglycolic acid, polylactic acid, poly(3-hydroxybutyric acid), poly(4-hydroxybutyric acid), poly(3-hydroxyhexanoic acid), polycaprolactone, copolymers thereof, and the like are mentioned, and poly(L-lactic acid), poly(D-lactic acid), stereocomplex polylactic acid that forms a stereocomplex crystal, and racemic polylactic acid are particularly suitable.

As the polylactic acid, one whose main repeating unit is L-lactic acid and/or D-lactic acid may be used, and it is particularly preferable to use polylactic acid having a melting point of 150° C. or more ("main" herein means that the component occupies at least 50% of the total). In the case where the melting point is less than 150° C., when fibers are produced therefrom, the drawing properties are poor due to the fusion of single fibers, or a melting defect occurs at the time of dyeing, heat setting, or friction heating, for example, resulting in extremely low product quality. Therefore, this is undesirable for garment application.

The polylactic acid preferably has a melting point of 170° C. or more, and still more preferably 200° C. or more. Melting point herein means the peak temperature of the melting peak obtained by DSC measurement. In particular, in order to impart heat resistance, it is preferable that the polylactic acid forms a stereocomplex crystal. Stereocomplex polylactic acid herein is a eutectic crystal formed by a poly(L-lactic acid) segment and a poly(D-lactic acid) segment.

Stereocomplex crystals usually have a higher melting point than crystals formed by poly(L-lactic acid) or poly(D-lactic acid) alone, and, therefore, the presence of even a small amount is expected to have a heat-resistance-improving effect. Such an effect is particularly prominent when the amount of stereocomplex crystals is large relative to the total amount of crystals. The stereocomplex crystallinity (S) according to the following equation is preferably 95% or more, and still more preferably 100%:

$$S=[\Delta Hm_s/(\Delta Hm_h+\Delta Hm_s)]\times 100$$

wherein $\Delta Hm_s$ is the melting enthalpy of stereocomplex-phase crystal, and $\Delta Hm_h$ is the melting enthalpy of homo-phase polylactic acid crystal.

As a technique to stably and highly promote the formation of stereocomplex polylactic acid crystals, it is preferable to incorporate specific additives.

That is, a technique in which a phosphoric acid ester metal salt represented by the following formulae is added as a stereocomplex crystallization promoter is mentioned as an example.

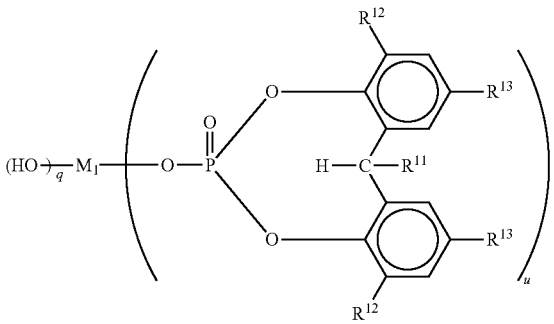

In the formula, $R^{11}$ represents a hydrogen atom or a $C_{1-4}$ alkyl group, $R^{12}$ and $R^{13}$ each independently represent a hydrogen atom or a $C_{1-12}$ alkyl group, $M_1$ represents an alkali metal atom, an alkaline-earth metal atom, a zinc atom, or an aluminum atom, u represents 1 or 2, and q represents 0 when $M_1$ is an alkali metal atom, an alkaline-earth metal atom, or a zinc atom, and represents 1 or 2 when $M_1$ is an aluminum atom.

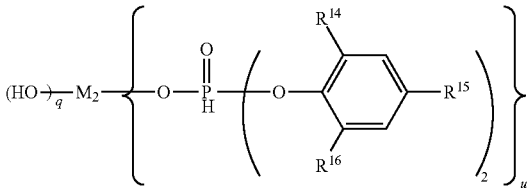

In the formula, $R^{14}$, $R^{15}$, and $R^{16}$ each independently represent a hydrogen atom or a $C_{1-12}$ alkyl group, $M_2$ represents an alkali metal atom, an alkaline-earth metal atom, a zinc atom, or an aluminum atom, u represents 1 or 2, and q represents 0 when $M_2$ is an alkali metal atom, an alkaline-earth metal atom, or a zinc atom, and represents 1 or 2 when $M_2$ is an aluminum atom.

As $M_1$ and $M_2$ of phosphoric acid ester metal salts represented by the above two formulae, Na, K, Al, Mg, Ca, and Li, particularly K, Na, Al, and Li, are preferable. In particular, Li and Al are the most suitable. As examples of such phosphoric acid ester metal salts, those available from ADEKA under trade names "ADK STAB" NA-11 and "ADK STAB" NA-71 are mentioned as preferred agents.

It is preferable that the phosphoric acid ester metal salt is used in an amount of 0.001 to 2 wt %, preferably 0.005 to 1 wt %, more preferably 0.01 to 0.5 wt %, and still more preferably 0.02 to 0.3 wt %, relative to the polylactic acid. In the case where the amount is too small, the effectiveness in improving the stereocomplex crystallinity (S) is low, while when the amount is too large, the stereocomplex crystal melting point is lowered, and this is thus undesirable.

Further, if desired, known crystal-nucleating agents may be used together in order to enhance the function of the phosphoric acid ester metal salt. In particular, calcium silicate, talc, kaolinite, and montmorillonite are preferably selected.

Such a crystal-nucleating agent is used in an amount within a range of 0.05 wt % to 5 wt %, more preferably 0.06 wt % to 2 wt %, and still more preferably from 0.06 wt % to 1 wt %, relative to the polylactic acid.

The polylactic acid may be obtained by any method. Examples of methods for producing polylactic acid include a two-stage lactide method in which lactide, a cyclic dimer, is once produced from L-lactic acid and/or D-lactic acid as a raw material, followed by ring-opening polymerization, and a single-stage direct polymerization method in which L-lactic acid and/or D-lactic acid as a raw material is directly dried and condensed in a solvent; the polylactic acid can be suitably obtained by such a commonly known polymerization method.

In the production, carboxylic acid groups are sometimes incorporated into the polylactic acid. With respect to the amount of such carboxylic acid groups contained, the smaller the better. For this reason, for example, it is preferable to use a product obtained by the ring-opening polymerization of lactide using an initiator other than water, or use a polymer that has undergone chemical treatment after polymerization and thus has a reduced amount of carboxylic acid groups.

The weight-average molecular weight of the polylactic acid is usually at least 50,000, preferably at least 100,000, and preferably 100,000 to 300,000. An average molecular weight of less than 50,000 reduces the strength properties of the fiber and thus is undesirable. In the case where it is more than 300,000, this may result in melt viscosity so high that melt spinning is difficult.

The polylactic acid in the invention may be a copolymerized polylactic acid obtained by copolymerizing other ester-forming components in addition to L-lactic acid and D-lactic acid. Examples of copolymerizable components include hydroxycarboxylic acids such as glycolic acid, 3-hydroxybutyric acid, 4-hydroxybutyric acid, 4-hydroxyvaleric acid, and 6-hydroxycaproic acid; compounds having a plurality of hydroxyl groups in the molecule, such as ethylene glycol, propylene glycol, butanediol, neopentyl glycol, polyethylene glycol, glycerin, and pentaerythritol, as well as derivatives thereof; and compounds having a plurality of carboxylic acid groups in the molecule, such as adipic acid, sebacic acid, and fumaric acid, as well as derivatives thereof. However, in order to maintain the high melting point and not to lose fiber strength, in this case, it is preferable that lactic acid units make up 70 mol % or more of a fiber.

A fiber made of the thus-obtained polylactic acid preferably has a fiber tensile strength of 2 to 8 cN/dtex, a boiling water shrinkage of 0 to 15%, and a carboxyl end group concentration of 0 to 20 eq/ton.

In the case where the strength is less than 2 cN/dtex, this causes filament breakage or machine stoppage during weaving or leads to a decrease in the tear strength or break strength of a woven fabric or knitting fabric, causing a decrease in product strength; therefore, this is undesirable.

The strength of the fiber is more preferably 4 cN/dtex or more, and still more preferably 5 cN/dtex or more. A fiber having a strength of more than 8 cN/dtex can be obtained by increasing the draw ratio. However, such a fiber has significantly reduced elongation and thus may be difficult to produce.

Boiling water shrinkage is preferably 0 to 15%. When it is more than 15%, this results in significant shrinkage in a hot-water treatment such as scouring or dyeing, whereby the tentering of the cloth is difficult, and also the texture tends to be hard; therefore, this is undesirable. For use as an ordinary cloth, boiling water shrinkage is preferably 2 to 10%, and still more preferably 3 to 8%.

Further, it is preferable that the carboxyl end group concentration of the polylactic acid fiber is 0 to 20 eq/ton. In the case where the carboxyl end group concentration is more than 20 eq/ton, significant hydrolysis occurs at the time of dyeing, and, depending on the dyeing conditions, this may cause a remarkable decrease in the tear strength of the cloth.

In particular, hydrolysis is significant in the case where the dyeing temperature is increased in order to dye the cloth a deep color. Therefore, in terms of retaining the strength of a cloth, the carboxyl end group concentration is preferably 10 eq/ton or less, and most preferably 6 eq/ton or less. The lower the carboxyl end group concentration, the better.

An example of a polymer containing an aliphatic polycarboxylic acid and an aliphatic polyalcohol as main components is a condensate whose main components are an aliphatic dicarboxylic acid, such as oxalic acid, succinic acid, adipic acid, sebacic acid, azelaic acid, dodecanedioic acid, malonic acid, glutaric acid, or dimer acid, or an alicyclic dicarboxylic acid unit, such as 1,3-cyclohexanedicarboxylic acid or 1,4-cyclohexanedicarboxylic acid, as a polycarboxylic acid or an ester derivative thereof and, as a diol component, a $C_{2-20}$ aliphatic glycol, i.e., ethylene glycol, propylene glycol, 1,4-butanediol, neopentyl glycol, 1,5-pentanediol, 1,6-hexanediol, decamethylene glycol, cyclohexane dimethanol, cyclohexanediol, dimerdiol, etc., or a long-chain glycol having a molecular weight of 200 to 100,000, i.e., polyethylene glycol, poly-1,3-propylene glycol, poly-1,2-propylene glycol, or polytetramethylene glycol. Specific examples thereof include polyethylene adipate, polyethylene succinate, polybutylene adipate, and polybutylene succinate, as well as copolymers thereof.

Further, examples of wholly aromatic polyesters include polymers obtained by the polycondensation of, as main components, an aromatic carboxylic acid or an ester-forming derivative thereof, preferably terephthalic acid, naphthalene-2,6-dicarboxylic acid, or an ester-forming derivative thereof, and an aromatic polyhydroxy compound or an ester-forming derivative thereof.

Specifically, poly(4-oxyphenylene-2,2-propylidene-4-oxyphenylene-terephthaloyl-co-isophthaloyl) is mentioned as an example. Such a polyester has, as carbodiimide-reactive components, terminal carboxyl and/or hydroxyl groups at its molecular ends in an amount of 1 to 50 eq/ton. Such end groups, especially carboxyl groups, reduce the stability of the polyester, and thus are preferably capped with a cyclic carbodiimide compound.

In the capping of carboxyl end groups with a carbodiimide compound, the application of the cyclic carbodiimide compound of the invention allows the carboxyl groups to be capped without producing toxic, free isocyanates. This is greatly advantageous.

The above polyesters can be produced by a well known method (e.g., described in "*Howa-Poriesuteru-Jushi Handobukku* (Handbook of Saturated Polyester Resin)" (written by Kazuo YUKI, Nikkan Kogyo Shimbun (published on Dec. 22, 1989), etc.).

Examples of polyesters of the invention further include, in addition to the above polyesters, unsaturated polyester resins obtained by the copolymerization of unsaturated polycarboxylic acids or ester-forming derivatives thereof and also polyester elastomers containing a low-melting-point polymer segment.

Examples of unsaturated polycarboxylic acids include maleic anhydride, tetrahydromaleic anhydride, fumaric acid, and endomethylene tetrahydromaleic anhydride. Various monomers are added to such an unsaturated polyester in order to control curing properties, and the unsaturated polyester is cured and molded by a curing treatment such as heat curing, radical curing, light, or active energy radiation such as electron radiation. The control of carboxyl groups in such an unsaturated resin is an important technical problem related to rheological properties such as thixotropy, resin durability, and the like. However, the carboxyl groups can be capped and controlled by the cyclic carbodiimide compound without producing toxic, free isocyanates, and also the molecular weight is more effectively increased by the cyclic carbodiimide compound. These advantages are of great industrial significance.

<Polyester Elastomer>

Further, in the invention, the polyester may also be a polyester elastomer obtained by the copolymerization of soft components. A polyester elastomer is a copolymer containing a high-melting-point hard polyester segment and a low-melting-point polymer segment having a molecular weight of 400 to 6,000, as described in a known document, for example, JP-A-11-92636. It is a thermoplastic polyester block copolymer whose components are such that in the case where a high polymer is made solely of the high-melting-point polyester segment component, the melting point thereof is 150° C. or more, while in the case where only the low-melting-point polymer segment component which contains, for example, an aliphatic polyester produced from a polyalkylene glycol or a $C_{2-12}$ aliphatic dicarboxylic acid and a $C_{2-10}$ aliphatic glycol is subjected to measurement, the melting point or softening point thereof is 80° C. or less. Such an elastomer has a problem with hydrolytic stability. However, its carboxyl groups can be controlled by the cyclic carbodiimide compound without any safety problem, which is of great significance, and also its molecular weight can be prevented from decreasing or can be increased by the cyclic carbodiimide compound, which is of great industrial significance.

<Polyamide>

The polyamide of the invention is a thermoplastic polymer having an amide bond and obtained from an amino acid, a lactam, or a diamine and a dicarboxylic acid or an amide-forming derivative thereof as main raw materials.

As polyamides in the invention, polycondensates obtained by the condensation of a diamine and a dicarboxylic acid or an acyl activator thereof, polymers obtained by the polycondensation of an aminocarboxylic acid, a lactam, or an amino acid, and copolymers thereof are usable.

Examples of diamines include aliphatic diamines and aromatic diamines. Examples of aliphatic diamines include tetramethylenediamine, hexamethylenediamine, undecamethylenediamine, dodecamethylenediamine, 2,2,4-trimethylhexamethylenediamine, 2,4,4-trimethylhexamethylenediamine, 5-methylnonamethylenediamine, 2,4-dimethyloctamethylenediamine, meta-xylylenediamine, para-xylylenediamine, 1,3-bis(aminomethyl)cyclohexane, 1-amino-3-aminomethyl-3,5,5-trimethylcyclohexane, 3,8-bis(aminomethyl)tricyclodecane, bis(4-aminocyclohexyl)methane, bis(3-methyl-4-aminocyclohexyl)methane, 2,2-bis(4-aminocyclohexyl)propane, bis(aminopropyl)piperazine, and aminoethylpiperazine. Examples of aromatic diamines include p-phenylenediamine, m-phenylenediamine, 2,6-naphthalenediamine, 4,4'-diphenyldiamine, 3,4'-diphenyldiamine, 4,4'-diaminodiphenyl ether, 3,4'-diaminodiphenyl ether, 4,4'-sulfone, 3,4'-diaminodiphenyl sulfone, 4,4'-diaminodiphenyl ketone, 3,4'-diaminodiphenyl ketone, and 2,2-bis(4-aminophenyl)propane.

Examples of dicarboxylic acids include adipic acid, suberic acid, azelaic acid, sebacic acid, dodecanoic acid, terephthalic acid, isophthalic acid, naphthalenedicarboxylic acid, 2-chloroterephthalic acid, 2-methylterephthalic acid, 5-methylisophthalic acid, 5-sodium sulfoisophthalic acid, hexahydroterephthalic acid, hexahydroisophthalic acid, and diglycolic acid. Specific examples of polyamides include aliphatic polyamides such as polycaproamide (Nylon 6), polytetramethylene adipamide (Nylon 46), polyhexamethylene adipamide (Nylon 66), polyhexamethylene sebacamide (Nylon 610), polyhexamethylene dodecamide (Nylon 612), polyundecamethylene adipamide (Nylon 116), polyundecanamide (Nylon 11), and polydodecanamide (Nylon 12); aliphatic-aromatic polyamides such as polytrimethylhexamethylene terephthalamide, polyhexamethylene isophthalamide (Nylon 6I), polyhexamethylene terephthal/isophthalamide (Nylon 6T/6I), polybis(4-aminocyclohexyl) methane dodecamide (Nylon PACM12), polybis(3-methyl-4-aminocyclohexyl)methane dodecamide, (Nylon Dimethyl PACM12), polymetaxylylene adipamide (Nylon MXD6), polyundecamethylene terephthalamide (Nylon 11 T), and polyundecamethylene hexahydroterephthalamide (Nylon 11T(H)), as well as copolyamides thereof; copolymers and mixtures thereof. Examples further include poly(p-phenylene terephthalamide) and poly(p-phenylene terephthalamide-co-isophthalamide).

Examples of amino acids include ω-aminocaproic acid, ω-aminoenanthic acid, ω-aminocaprylic acid, ω-aminopergonic acid, ω-aminocapric acid, 11-aminoundecanoic acid, 12-aminododecanoic acid, and para-aminomethylbenzoic acid. Examples of lactams include ω-caprolactam, ω-enantholactam, ω-capryllactam, and ω-laurolactam.

The molecular weight of such a polyamide resin is not particularly limited. However, it is preferable that its relative viscosity measured at 25° C. in a 98% concentrated sulfuric acid solution having a polyamide resin concentration of 1 wt % is within a range of 2.0 to 4.0.

These amide resins can be produced according to a well known method, for example, "*Poriamido-Jusi Handobukku* (Polyamide Resin Handbook)" (written by Osamu FUKUMOTO, Nikkan Kogyo Shimbun (published on Jan. 30, 1988)).

Polyamides of the invention further include polyamides known as polyamide elastomers. Examples of such polyamides include graft and block copolymers obtained by a reaction of a polyamide-forming component having 6 or more carbon atoms with a poly(alkylene oxide) glycol. The linkage between the polyamide-forming component having 6 or more carbon atoms and the poly(alkylene oxide) glycol component is usually an ester bond or an amide bond. However, the linkage is not particularly limited thereto, and it is also possible to use a third component, such as a dicarboxylic acid or a diamine, as a reaction component for the two. Examples of poly(alkylene oxide) glycols include block and random copolymers of polyethylene oxide glycol, poly(1,2-propylene oxide) glycol, poly(1,3-propylene oxide) glycol, poly(tetramethylene oxide) glycol, poly(hexamethylene oxide) glycol, ethylene oxide, and propylene oxide and block and random copolymers of ethylene oxide and tetrahydrofuran. In terms of polymerizability and rigidity, the poly(alkylene oxide) glycol preferably has a number-average molecular weight of 200 to 6,000, and more preferably 300 to 4,000.

As the polyamide elastomer for use in the invention, a polyamide elastomer obtained by the polymerization of caprolactam, polyethylene glycol, and terephthalic acid is preferable. As can be easily understood from the raw materials, such a polyamide resin has carboxyl groups in an amount of 30 to 100 eq/ton and amino groups in an amount of 30 to 100 eq/ton, approximately. It is well known that carboxyl groups have an unfavorable effect on the stability of a polyamide.

The carboxyl groups are controlled to 20 eq/ton or less or to 10 eq/ton or less, or preferably further to a lower degree, by the cyclic carbodiimide compound of the invention without any safety problems, and also the molecular weight is more effectively prevented from decreasing by the cyclic carbodiimide compound; such a composition is of great importance.

<Polyamide-Imide>

A polyamide-imide resin for use in the invention has a main repeating structural unit represented by the following formula (I):

(I)

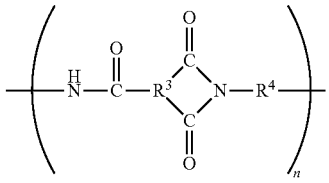

wherein $R^3$ represents a trivalent organic group, $R^4$ represents a divalent organic group, and n represents a positive integer.

Examples of typical methods for synthesizing such a polyamide-imide resin include (1) a method in which a diisocyanate reacts with a tribasic acid anhydride, (2) a method in which a diamine reacts with a tribasic acid anhydride, and (3) a method in which a diamine reacts with a tribasic acid anhydride chloride. However, the method for synthesizing a polyamide-imide resin for use in the invention is not limited to these methods. The following are typical compounds used in the above synthesizing methods.

First, preferred examples of diisocyanates include 4,4'-diphenylmethane diisocyanate, xylylene diisocyanate, 3,3'-diphenylmethane diisocyanate, 4,4'-diphenylether diisocyanate, 3,3'-diphenylether diisocyanate, and praraphenylene diisocyanate.

Preferred examples of diamines include 4,4'-diaminodiphenyl sulfone, 3,3'-diaminodiphenyl sulfone, 4,4'-diaminodiphenyl ether, 3,3'-diaminodiphenyl ether, 4,4'-diaminodiphenylmethane, 3,3'-diaminodiphenylmethane, xylylenediamine, and phenylenediamine. Among these, 4,4'-diphenylmethane diisocyanate, 3,3'-diphenylmethane diisocyanate, 4,4'-diphenylether diisocyanate, 3,3'-diphenylether diisocyanate, 4,4'-diaminodiphenyl ether, 3,3'-diaminodiphenyl ether, 4,4'-diaminodiphenylmethane, and 3,3'-diaminodiphenylmethane are more preferable.

Preferred examples of tribasic acid anhydrides include trimellitic anhydride, and examples of tribasic acid anhydride chlorides include trimellitic anhydride chloride.

In the synthesis of a polyamide-imide resin, a dicarboxylic acid, a tetracarboxylic dianhydride, or the like may be simultaneously subjected to the reaction in such a range that the properties of the polyamide-imide resin are not impaired. Examples of dicarboxylic acids include terephthalic acid, isophthalic acid, and adipic acid. Examples of tetracarboxylic dianhydrides include pyromellitic dianhydride, benzophenone tetracarboxylic dianhydride, and biphenyl tetracarboxylic dianhydride. It is preferable that they are used in an amount of 50 eq % or less based on the total acid components.

The durability of a polyamide-imide resin may decrease depending on the concentration of carboxyl groups in the polymer. Therefore, it is preferable that the concentration of carboxyl groups is controlled preferably to 1 to 10 eq/ton or less. The cyclic carbodiimide compound of the invention allows the above carboxyl group concentration range to be suitably achieved.

<Polyimide>

A polyimide resin of the invention is not particularly limited and may be a known polyimide resin. However, it is particularly preferable to select a thermoplastic polyimide resin.

Examples of such polyimide resins include polyimides containing the following diamine component and the following tetracarboxylic acid:

$$H_2N—R^5—NH_2$$

wherein $R^5$ is (i) a single bond; (ii) a $C_{2-12}$ aliphatic hydrocarbon group; (iii) a $C_{4-20}$ alicyclic group; (iv) a $C_{6-30}$ aromatic group; (v) a -Ph-O—$R^6$—O-Ph- group ($R^6$ represents a phenylene group or a -Ph-X-Ph- group wherein X represents a single bond, a $C_{1-4}$ alkylene group optionally substituted with a halogen atom, a —O-Ph-O— group, —O—, —CO—, —S—, —SO—, or a —$SO_2$— group); or (v) a —$R^7$—($SiR^8{}_2$—O)m-$SiR^8{}_2$—$R^7$— group ($R^7$ represents —$(CH_2)_s$—, —$(CH_2)_s$-Ph-, —$(CH_2)_s$—O-Ph-, or -Ph- wherein s represents an integer of 1 to 4, m is an integer of 1 to 100, and $R^8$ represents a $C_{1-6}$ alkyl group, a phenyl group, or a $C_{1-6}$ alkylphenyl group);

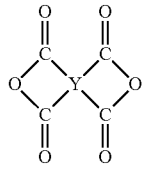

wherein Y is a $C_{2-12}$ tetravalent aliphatic group, a $C_{4-8}$ tetravalent alicyclic group, a $C_{6-14}$ monocyclic or fused-ring polycyclic tetravalent aromatic group, or a >Ph-X-Ph< group (X represents a single bond, a $C_{1-4}$ alkylene group optionally substituted with a halogen atom, —O-Ph-O—, —O—, —CO—, —S—, —SO—, or a —$SO_2$— group).

Specific examples of tetracarboxylic anhydrides for use in the production of a polyamide acid include, but are not limited to, pyromellitic anhydride (PMDA), 4,4'-oxydiphthalic anhydride (ODPA), biphenyl-3,3',4,4'-tetracarboxylic anhydride (BPDA), benzophenone-3,3',4,4'-tetracarboxylic anhydride (BTDA), ethylenetetracarboxylic anhydride, butanetetracarboxylic anhydride, cyclopentanetetracarboxylic anhydride, benzophenone-2,2',3,3'-tetracarboxylic anhydride, biphenyl-2,2',3,3'-tetracarboxylic anhydride, 2,2-bis(3,4-dicarboxyphenyl)propane anhydride, 2,2-bis(2,3-dicarboxyphenyl)propane anhydride, bis(3,4-dicarboxyphenyl)ether anhydride, bis(3,4-dicarboxyphenyl)sulfone anhydride, 1,1-bis(2,3-dicarboxyphenyl)ethane anhydride, bis(2,3-dicarboxyphenyl)methane anhydride, bis(3,4-dicarboxyphenyl)methane anhydride, 4,4'-(p-phenylenedioxy)diphthalic anhydride, 4,4'-(m-phenylenedioxy)diphthalic anhydride, naphthalene-2,3,6,7-tetracarboxylic anhydride, naphthalene-1,4,5,8-tetracarboxylic anhydride, naphthalene-1,2,5,6-tetracarboxylic anhydride, benzene-1,2,3,4-tetracarboxylic anhydride, perylene-3,4,9,10-tetracarboxylic anhydride, anthracene-2,3,6,7-tetracarboxylic anhydride, and phenanthrene-1,2,7,8-tetracarboxylic anhydride. These dicarboxylic anhydrides may be used alone, and it is also possible to use a mixture of two or more kinds. Among them, it is preferable to use pyromellitic anhydride (PMDA), 4,4'-oxydiphthalic anhydride (ODPA), biphenyl-3,3',4,4'-tetracarboxylic anhydride (BPDA), benzophenone-3,3',4,4'-tetracarboxylic anhydride, and biphenylsulfone-3,3',4,4'-tetracarboxylic anhydride (DSDA).

In the invention, specific example of diamines for use in the production of a polyimide include, but are not limited to, 4,4'-diaminodiphenyl ether, 4,4'-diaminodiphenylmethane, 4,4'-diaminodiphenyl sulfone, 4,4'-diaminodiphenyl thioether, 4,4'-di(meta-aminophenoxy)diphenyl sulfone, 4,4'-di(para-aminophenoxy)diphenyl sulfone, o-phenylenediamine, m-phenylenediamine, p-phenylenediamine, benzidine, 2,2'-diaminobenzophenone, 4,4'-diaminobenzophenone, 4,4'-diaminodiphenyl-2,2'-propane, 1,5-diaminonaphthalene, 1,8-diaminonaphthalene, trimethylenediamine, tetramethylenediamine, hexamethylenediamine, 4,4-dimethylheptamethylenediamine, 2,11-dodecadiamine, di(para-aminophenoxy)dimethylsilane, 1,4-di(3-aminopropyldiaminosilane)benzene, 1,4-diaminocyclohexane, orthotolyldiamine, meta-tolyldiamine, acetoguanamine, benzoguanamine, 1,3-bis(3-aminophenoxy)benzene (APB), bis[4-(3-aminophenoxy)phenyl]methane, 1,1-bis[4-(3-aminophenoxy)phenyl]ethane, 1,2-bis[4-(3-aminophenoxy)phenyl]ethane, 2,2-bis[4-(3-aminophenoxy)phenyl]ethane, 2,2-bis[4-(3-aminophenoxy)phenyl]propane, 2,2-bis[4-(3-aminophenoxy)phenyl]butane, 2,2-bis[4-(3-aminophenoxy)phenyl]-1,1,1,3,3,3-hexafluoropropane, 4,4'-di(3-aminophenoxy)biphenyl, di[4-(3-aminophenoxy)phenyl]ketone, di[4-(3-aminophenoxy)phenyl]sulfide, di[4-(3-aminophenoxy)phenyl]sulfoxide, di[4-(3-aminophenoxy)phenyl]sulfone, and di(4-(3-aminophenoxy)phenyl)ether. The above diamines may be used alone, and it is also possible to use a mixture of a large number of them.

Examples of thermoplastic polyimides include polyimide resins containing a tetracarboxylic anhydride as shown below and a known diamine such as p-phenylenediamine, cyclohexanediamine, or hydrogenated-bisphenol-A-type diamine, as well as those commercially available from General Electric under the trade name "Ultem", such as "Ultem" 1000, "Ultem" 1010, "Ultem" CRS5001, and "Ultem" XH6050, and "AURUM" 250AM manufactured by Mitsui Chemicals.

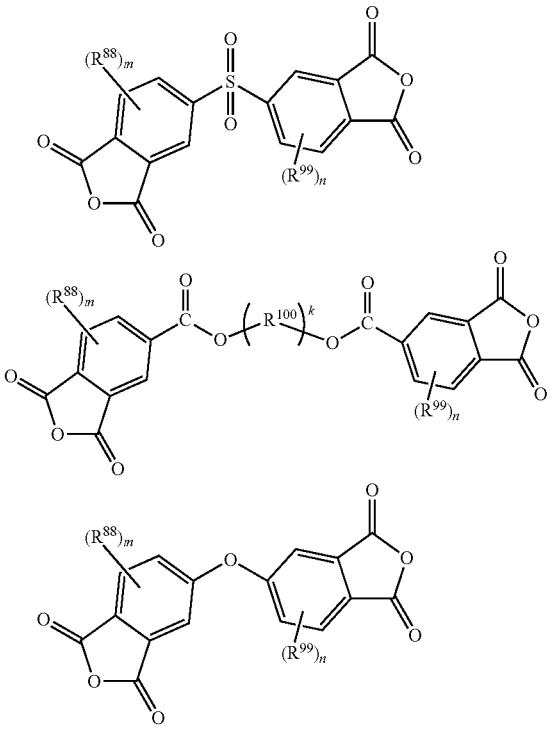

In the formulae, $R^{88}$ and $R^{99}$ each independently represent a hydrogen atom, a linear or branched $C_{1-10}$ alkyl group, or an aryl group, $R^{100}$ represents a $C_{6-30}$ arylene group or a $C_{2-20}$ alkylene group, m and n are each an integer of 0 to 5, and k is an integer of 1 to 3.

<Polyester Amide>

Examples of polyester amide resins of the invention include, but are not particularly limited to, known polyester amide resins obtained by the copolymerization of a polyester component and a polyamide component. In particular, a thermoplastic polyester amide resin is preferably selected.

The polyester amide resin of the invention can be synthesized by a known method, etc. For example, the polyamide component is first subjected to a polycondensation reaction so as to synthesize a polyamide terminated with functional groups, and then the polyester component is polymerized in the presence of the polyamide; the synthesis is possible by such a method. This polycondensation reaction is usually implemented by allowing an amidation reaction to proceed in the first stage and then an esterification reaction to proceed in the second stage.

The polyester component is preferably selected from the polyester components mentioned above. The polyamide component is preferably selected from the polyamide components mentioned above.

To these polymer components to which the cyclic carbodiimide compound is applied, any known additives and fillers may be added as long as the cyclic carbodiimide compound does not react with them to lose its effects. As additives, for example, in order to reduce melt viscosity, aliphatic polyester polymers such as polycaprolactone, polybutylene succinate, and polyethylene succinate and aliphatic polyether polymers such as polyethylene glycol, polypropylene glycol, and poly(ethylene-propylene)glycol may be added as internal plasticizers or external plasticizers. Further, as necessary, inorganic fine particles and organic compounds may also be added as delusterants, deodorants, flame retardants, yarn-friction-reducing agents, antioxidants, coloring pigments, etc.

<Method for Mixing Polymer Compound with Cyclic Carbodiimide Compound>

In the invention, a cyclic carbodiimide compound is mixed and reacted with a polymer compound having an acidic group, whereby the acidic groups can be capped. The method for adding and mixing the cyclic carbodiimide compound into the polymer compound is not particularly limited, and may be a known method. It is possible to employ a method in which the cyclic carbodiimide compound is added in the form of a solution, a melt, or a masterbatch of the polymer to be treated, a method in which the polymer compound in solid state is brought into contact with a liquid having dissolved, dispersed, or melted therein the cyclic carbodiimide compound, thereby impregnating the polymer compound with the cyclic carbodiimide compound, or the like.

In the case where a method in which the cyclic carbodiimide compound is added in the form of a solution, a melt, or a masterbatch of the polymer to be treated is employed, a known kneading apparatus may be used for addition. For kneading, kneading in the form of a solution or kneading in the form of a melt is preferable in terms of uniform kneading. The kneading apparatus is not particularly limited, and may be a known vertical reactor, mixing tank, or kneading tank, or a single-screw or multi-screw horizontal kneading apparatus, such as a single-screw or multi-screw extruder or kneader. The period of time for mixing with a polymer compound is not particularly limited. Although this depends on the mixing apparatus and the mixing temperature, it is 0.1 minutes to 2 hours, preferably 0.2 minutes to 60 minutes, and more preferably 1 minute to 30 minutes.

As the solvent, those inert to the polymer compound and the cyclic carbodiimide compound are usable. In particular, a solvent having affinity for both of them, which at least partially dissolves both of them or is at least partially dissolved in both of them, is preferable.

As the solvents, for example, hydrocarbon-based solvents, ketone-based solvents, ester-based solvents, ether-based solvents, halogen-based solvents, and amide-based solvents are usable.

Examples of hydrocarbon-based solvents include hexane, cyclohexane, benzene, toluene, xylene, heptane, and decane.

Examples of ketone-based solvents include acetone, methyl ethyl ketone, diethyl ketone, cyclohexanone, and isophorone.

Examples of ester-based solvents include ethyl acetate, methyl acetate, ethyl succinate, methyl carbonate, ethyl benzoate, and diethylene glycol diacetate.

Examples of ether-based solvents include diethyl ether, dibutyl ether, tetrahydrofuran, dioxane, diethylene glycol dimethyl ether, triethylene glycol diethyl ether, and diphenyl ether.

Examples of halogen-based solvents include dichloromethane, chloroform, tetrachloromethane, dichloroethane, 1,1',2,2'-tetrachloroethane, chlorobenzene, and dichlorobenzene.

Examples of amide-based solvents include formamide, dimethylformamide, dimethylacetamide, and N-methylpyrrolidone.

These solvents may be used alone. If desired, they may also be used as a mixed solvent.

In the invention, the solvent is used in an amount within a range of 1 to 1,000 wt % based on 100 wt % of the total of the polymer compound and the cyclic carbodiimide compound. When the amount is less than 1 wt %, the application of the solvent has no significance. There is no particular upper limit on the amount of the solvent to be used. However, in terms of operativity and reaction efficiency, the upper limit is about 1,000 wt %.

In the case where a method in which the polymer compound in solid state is brought into contact with a liquid having dissolved, dispersed, or melted therein the cyclic carbodiimide compound, thereby impregnating the polymer compound with the cyclic carbodiimide compound, is employed, a method in which the polymer compound in solid state is brought into contact with the cyclic carbodiimide compound dissolved in the solvent, a method in which the polymer compound in solid state is brought into contact with an emulsion of the cyclic carbodiimide compound, or the like may be employed. As a method of contact, a method in which the polymer compound is immersed, a method in which the cyclic carbodiimide compound is applied or sprayed to the polymer compound, or the like is preferably employed.

The capping reaction of the cyclic carbodiimide compound of the invention can take place at room temperature (25° C.) to about 300° C. However, in terms of reaction efficiency, the temperature is preferably within a range of 50 to 250° C., more preferably 80 to 200° C., whereby the reaction is further promoted. The reaction easily proceeds at a temperature where the polymer compound is molten. However, in order to prevent the cyclic carbodiimide compound from sublimation, decomposition, or the like, it is preferable to carry out the reaction at a temperature of less than 300° C. The application of the solvent is also effective in reducing the polymer melting temperature and increasing the stirring efficiency.

Although the reaction proceeds rapidly enough in the absence of a catalyst, it is also possible to use a catalyst to promote the reaction. As the catalyst, catalysts used for conventional linear carbodiimide compounds are usable. Examples thereof include alkali metal compounds, alkaline-earth metal compounds, tertiary amine compounds, imidazole compounds, quaternary ammonium salts, phosphine compounds, phosphonium salts, phosphoric acid esters, organic acids, and Lewis acid. They may be used alone, and it is also possible to use two or more kinds. The amount of the catalyst to be added is not particularly limited, but is preferably 0.001 to 1 wt %, more preferably 0.01 to 0.1 wt %, and most preferably 0.02 to 0.1 wt % based on 100 wt % of the total of the polymer compound and the cyclic carbodiimide compound.

The amount of the cyclic carbodiimide compound to be added is selected such that the amount of carbodiimide groups contained in the cyclic carbodiimide compound is within a range of 0.5 to 100 equivalents per equivalent of acidic groups. When the amount is less than 0.5 equivalents, the application of the cyclic carbodiimide compound may have no significance. When the amount is more than 100 equivalents, the properties of the substrate may change. From such points of view, based on the above basis, the amount is preferably within a range of 0.6 to 100 equivalents, more preferably 0.65 to 70 equivalents, still more preferably 0.7 to 50 equivalents, and particularly preferably 0.7 to 30 equivalents.

<Composition Obtained by Mixing Polymer Compound with Cyclic Carbodiimide Compound>

A composition obtained by mixing according to the method mentioned above can basically have the following modes depending on the ratio between the two, the reaction time, and the like.

(1) The composition is made of the following three components:

(a) a compound having at least a ring structure containing one carbodiimide group with the first nitrogen and second nitrogen thereof being linked together through a linking group;

(b) a polymer compound having an acidic group; and (c) a polymer compound whose acidic groups are capped with a compound having at least a ring structure containing one carbodiimide group with the first nitrogen and second nitrogen thereof being linked together through a linking group.

(2) The composition is made of the following two components:

(a) a compound having at least a ring structure containing one carbodiimide group with the first nitrogen and second nitrogen thereof being linked together through a linking group; and (c) a polymer compound whose acidic groups are capped with a compound having at least a ring structure containing one carbodiimide group with the first nitrogen and second nitrogen thereof being linked together through a linking group.

(3) The composition is made of the following component:

(c) a polymer compound whose acidic groups are capped with a compound having at least a ring structure containing one carbodiimide group with the first nitrogen and second nitrogen thereof being linked together through a linking group.

Here, (3) is not a composition but is a modified polymer compound. However, for convenience, it is referred to as "composition" in the invention.

Each mode is preferable. However, in the case where any unreacted cyclic carbodiimide compound is present in the composition, when the polymer compound undergoes chain scission at the time of melt molding due to some factors, such as the creation of a wet-heat atmosphere, the unreacted cyclic carbodiimide compound reacts with chain ends resulting from the scission, whereby the acidic group concentration can be kept low. Therefore, this mode is particularly preferable.

Incidentally, in the invention, the descriptions "three components", "two components", and "one component" merely indicate the possible modes of the polymer compound having an acidic group and the cyclic carbodiimide compound in the composition. Needless to say, without interfering with the object of the invention, the addition of any known additives and fillers mentioned above is not excluded.

<Fiber Containing Composition Obtained by Mixing Polymer Compound with Cyclic Carbodiimide Compound>

The fiber of the invention contains the above composition obtained by mixing a polymer compound with a cyclic carbodiimide compound. Here, the content of the composition in the fiber is not particularly limited as long as the composition is contained. The content may be suitably selected according to the use to which the fiber (or fiber structure) is to be put, the kind of polymer, the kinds of other components containing no cyclic carbodiimide compound, etc. The content may usually be 10 wt % or more.

With respect to the transverse cross-sectional shape of the fiber, it may be a solid round cross-section or may also be a modified-shaped cross-section, such as flat, trilobal to octalobal, C-shaped, H-shaped, or hollow. The fiber may also be a composite fiber (core-sheath configuration, eccentric sheath-core configuration, side-by-side configuration, split-fiber configuration) or a sea-island conjugate fiber, where the composition is incorporated as at least one component.

In the case where the fiber has a modified-shaped cross-section, in order to develop gloss, texture, and property, it is preferable that the ratio between the diameters of the circumscribed and inscribed circles of the transverse cross-sectional shape of the fiber is 2.5 to 10. When it is less than 2.5, the development of gloss, texture, property, or the like may be weak. On the contrary, when the ratio between the diameters of the circumscribed and inscribed circles is more than 10, it may be difficult to achieve stable yarn-making, weaving, knitting, and dyeing.

The circumscribed circle herein is a circle that passes through all the vertices in a modified cross-sectional shape, while the inscribed circle is a circle that contacts all the sides of a modified cross-sectional shape. In the case where the modified-shaped cross-section has a flat shape as shown in FIG. 1, B in the major-axis direction in FIG. 1 is the diameter of the circumscribed circle, and C2 that is the shortest in the minor-axis direction is the diameter of the inscribed circle.

Supposing that there is no constriction portion in FIG. 1, the diameter of the inscribed circle is C1. Also in the cases of other modified-shaped cross-sections that are substantially rectangular, the circumscribed circle and the inscribed circle may be determined as above.

When the fiber is a composite fiber, it is necessary to compound the composition of the invention mentioned above with at least one thermoplastic resin. The thermoplastic resin is not particularly limited, and may be suitably changed according to necessary functions.

Specific examples of thermoplastic resins to be compounded include aromatic polyester resins such as polyethylene terephthalate, polybutylene terephthalate, and polytrimethylene terephthalate; polyamide resins such as Nylon 6, Nylon 66, Nylon 610, and Nylon 11; acrylic resins such as polymethyl methacrylate; olefin resins such as polyethylene and polypropylene; polyvinyl alcohol resins; polyvinyl chloride resins; fluorine resins such as polytetrafluoroethylene; polyurethane resins; and PPS resins. Thus, various physical properties can be imparted. For example, by compounding polyethylene terephthalate with polylactic acid, the low wear resistance of polylactic acid can be improved, while fibers with a high biosourced material content can be achieved. In addition, heat resistance, flame retardancy, and like functions can be imparted, and environment-friendly fibers with a high biosourced material content can be realized.

The thermoplastic resin may be a copolymer or may also be a blend with organic and/or inorganic substances. Further, it is also possible to add inorganic fine particles and organic compounds, including delusterants, flame retardants, heat stabilizers, light stabilizers, UV absorbers, coloring pigments, and the like.

The compounding method for obtaining a composite fiber is not particularly limited. Examples thereof include methods in which compounding is performed at the time of the formation of fibers, such as melt compounding and solution compounding, and coating methods in which a melt coating is applied to a previously obtained fiber.

With respect to the composite shape, it is possible to employ the above-mentioned sheath-core composite, sea-island composite, side-by-side, blend type, etc. For example, in the case where the wear resistance or flame retardancy of the composite fiber is to be improved, the sheath-core composite configuration or the sea-island composite configuration is preferable. In the case where a crimping function is to be imparted, the side-by-side configuration or the eccentric sheath-core configuration may be employed, while in the case where the composition of the invention is to be dissolved together with the other thermoplastic resin, or one resin is to be microdispersed, the blend type may be employed.

In particular, in composite fibers of the sheath-core composite configuration, the sea-island composite configuration, and the blend type, which are expected to have a wear-resistance-improving effect, when a resin having excellent wear resistance, such as a polyamide resin, is used, a further wear-resistance-improving effect can be achieved.

Further, the components to be compounded may be three or more components. The proportions of resins to be compounded are not particularly limited either. However, as mentioned above, the higher the biosourced material content, the better. For example, the polylactic acid proportion is preferably 20 mass % or more, and still more preferably 30 mass % or more.

Further, as described below in detail, the fiber may also be post-processed, and various forms are possible, including false twisted textured yarns, hard-twist yarns, Taslan textured yarns, interlaced textured yarns, thick-and-thin yarns, and combined filament yarns and like filament yarns, as well as staple fibers, tows, spun yarns, etc.

When the composition obtained by mixing a polymer compound with a cyclic carbodiimide compound is formed into fibers, any known spinning method can be employed depending on the target polymer compound. Melt spinning, dry spinning, or wet spinning may be applied depending on the target polymer compound.

With respect to spinning conditions, there is no need to consider the presence of the cyclic carbodiimide compound of the invention, and commonly used spinning conditions known for each polymer compound may be directly employed. As necessary, a drawing treatment, a heat-setting treatment, and the like may be performed. Also in such a case, as above, conditions may be suitably selected from the drawing conditions, heat-setting conditions, and the like known for each polymer compound.

A specific method is as follows, for example. When the fiber is to be obtained by a melt spinning method, the composition is melted in an extruder-type or pressure-melter-type melt extruder, and then filtered in a spinning pack or the like and simultaneously spun through a spinneret with the spinneret shape and the number of spinnerets being suitably selected according to the intended use. In the case of forming a fiber having a modified-shaped cross-section as mentioned above, a spinneret for modified shapes including a hollow round cross-section may be used as the spinneret.

The spun yarn is cooled and solidified through a gas having a temperature lower than the melting point of the polymer compound, and then taken up while applying an oil thereto. In this case, the take-up rate is preferably 300 m/min or more, because, for example, the molecular orientation can be thereby improved. From the same point of view, the spinning draft is preferably 50 or more.

Further, it is also possible to establish a heating section immediately after spinning and before cooling and solidification, so that a yarn is heated to a temperature equal to or higher than the melting point of the polymer to increase fiber strength.

The undrawn yarn obtained by the above procedure can be subjected to a drawing process. The undrawn yarn may be once wound up and then subjected to the drawing process, or may also be subjected to the drawing process after spinning without winding up.

The drawing process may be either single-stage drawing or multi-stage drawing. Incidentally, when the draw ratio is too high, this may cause fiber whitening, which may lead to a decrease in the strength of the obtained fiber. Therefore, a draw ratio that does not cause fiber whitening is preferable. As the heat source for drawing, any commonly used method may be employed. For example, hot rollers, contact hot plates, non-contact hot plates, heat medium baths, pins, and the like are usable.

After the drawing process, the yarn is wound up. However, before that, a heat treatment is preferably performed at a temperature about 10 to 80° C. lower than the melting point of the polymer compound. The heat treatment may be performed by any method, such as using a hot roller, a contact hot plate, or a non-contact hot plate. Further, in terms of improving dimensional stability, the heat treatment may be followed by a 0 to 20% relaxation treatment.

Incidentally, in the case where polylactic acid, particularly stereocomplex polylactic acid, is selected as the polymer compound, when the rate of take-up after spinning is within a range of 300 m/min to 5000 m/min, the formation of stereocomplex crystals is encouraged. However, in terms of drawing properties in the subsequent drawing process, it is preferable that the take-up rate is such that the stereocomplex crystallinity (Sc) of the undrawn yarn is 0.

Stereocomplex crystallinity (Sc) herein is calculated from the diffraction peak intensity ratio obtained by wide-angle X ray diffraction (XRD) measurement, and is a value defined by the following equation:

$$Sc\ (\%)=[\Sigma I_{SCi}/(\Sigma I_{SCi}+I_{HM})]\times 100$$

wherein $\Sigma I_{Sci}=I_{SC1}+I_{SC2}+I_{SC3}$; $I_{SCi}$ (i=1 to 3) represents the integrated intensities of diffraction peaks near 2θ=12.0°, 20.7°, and 24.0°, respectively; and $I_{HM}$ represents the integrated intensity $I_{HM}$ of the diffraction peak near 2θ=16.5° due to homo-phase crystal.

<Fiber Structure Using Fiber Containing Composition Obtained by Mixing Polymer Compound with Cyclic Carbodiimide Compound>

The fiber structure of the invention is not particularly limited as long as it uses, at least in part, a fiber containing the composition of the invention. The content of the fiber in the fiber structure may be suitably selected according to the use to which the fiber structure is to be put, the kind of fiber-forming polymer, the properties of other fibers, etc. The content may usually be 10 wt % or more.

Specific examples of fiber structures of the invention include products in yarn form, such as sewing threads, embroidery threads, and strings; textured yarns; cloths such as woven fabrics, knitted fabrics, nonwoven fabrics, and felts; outer garments such as shirts, blousons, trousers, coats, sweaters, and uniforms; high-value-added garment products such as underwear, tights, socks, linings, interfacings, sportswear, women's dresses, and formal dresses; garment products such as cups and pads; products for daily-use materials, such as curtains, carpets, chair coverings, mats, furniture, bags, furniture coverings, wall materials, and various belts and slings; industrial material products, such as canvas, belts, nets, ropes, heavy fabrics, bags, felts, and filters; car interior products; artificial leather products; and like various textile products.

Among them, when a woven fabric or a knitted fabric is to be obtained, weaving or knitting may be performed using an ordinary weaving machine or knitting machine. In that case, examples of the weave structure of the woven fabric include three basic weaves including plain, twill, and satin, modifications thereof, single-backed double weaves such as warp-backed weave and weft-backed weave, and warp velvet. The knitted fabric may be a circular knitted fabric (weft-knitted fabric) or a warp-knitted fabric. Preferred examples of the structure of the circular knitted fabric (weft-knitted fabric) include plain stitch, rib stitch, interlock stitch, purl stitch, tuck stitch, float stitch, half cardigan stitch, lace stitch, and moquette stitch. Examples of the warp knitting structure include single denbigh stitch, single atlas stitch, double cord stitch, half tricot stitch, fleece stitch, and jacquard stitch. The structure may be single-layered or may also be multilayered including two or more layers. Further, a raised cloth made of a raised part having cut piles and/or loop piles and a ground weave part is also possible.

<Nonwoven Fabric>

In the case where the fiber structure of the invention is a nonwoven fabric, the kind of nonwoven fabric is not limited. The production method is not particularly limited either, but it is preferable to use a spunbonding process, a melt-blowing process, a flash-spinning process, a needle-punching process, a hydroentangling process, an air-laying process, a thermal bonding process, a resin bonding process, a wet process, or the like.

For example, in the case of a filament nonwoven fabric, it can be produced by a so-called spunbonding process, in which a molten polymer is extruded through a nozzle and drawn by suction with a high-speed suction gas, and then the resulting fibers are collected on a moving conveyer to form a web, successively followed by thermal bonding, entangling, or the like to integrate the fibers into a sheet; a so-called melt-blowing process, in which a heated high-speed gaseous fluid is blown onto a molten polymer to draw the molten polymer into ultrafine fibers, and the fibers are then collected to form a sheet; or the like.

For example, in the case of a staple-fiber nonwoven fabric, it can be produced by a combination of the following steps: a step in which a molten polymer is extruded through a nozzle, taken up by a roller, and drawn to produce a fiber; a step in which the fiber is crimped with a crimper and cut with a cutter to produce staple fibers; a step in which the obtained staple fibers are deposited to form a web, followed by thermal bonding, entangling, or the like to integrate the fibers into a sheet, or a step in which the staple fibers are dispersed in water, then separated from water in a paper-making manner, dewatered and dried to form a web, and further integrated by thermal bonding into a sheet; etc.

As raw materials for fibers to form the nonwoven fabric, in addition to the composition of the invention, several kinds of other resins, such as polyethylene terephthalate, may also be compounded together. Preferred methods for compounding resins include a method in which several kinds of molten resins are mixed and also a method in which two kinds of resins are formed into a composite fiber with a core-sheath configuration, a side-by-side configuration, a sea-island configuration, a multilobal configuration, etc.

<Industrial Material Goods>

Of the above, as industrial material goods, when nets and ropes, for example, are produced, the transverse cross-sectional shape of the fiber is not limited either. It is possible to employ a flat cross-section, a trilobal cross-section, a hollow cross-section, a Y-shaped cross-section, a square cross-section, a C-shaped cross-section, a W-shaped cross-section, a triangular cross-section, a combination thereof, or the like. When the cross-sectional shape is a modified shape, softness, fluffiness, bulkiness, lightweight properties, heat-retaining properties, and the like can be imparted. The fibers may be in the form of monofilaments, multifilaments, slit yarns, and the like. Fineness is not particularly limited either, and may be suitably changed according to the intended use.

The usable total fineness range is, for example, 20 to 10000 dtex, and preferably 300 to 3000 dtex. The single-fiber fineness range is, for example, 0.02 dtex to 10000 dtex, and preferably 0.1 dtex to 3000 dtex. When the total fineness is less than the above range, this leads to poor productivity. When the total fineness is more than the above range, this may lead to a lack of cooling power in melt spinning, resulting in poor yarn-making properties, for example. From a practical point of view, a fiber used for the net has a strength of 1.5 cN/dtex or more, more preferably 2.5 cN/dtex or more, and still more preferably 3.0 cN/dtex. Meanwhile, there is no particular upper limit on strength, but it is usually 9.0 cN/dtex or less in order to achieve stable production under today's technology. Also, elongation may be suitably selected as necessary, and may be within a range of 10 to 300%, for example. As more preferred ranges, when it is 10 to 100%, a net with high strength and excellent dimensional stability can be obtained, and when it is 100 to 300%, softness can be imparted to the net.

The boiling water shrinkage of the fiber is preferably 0 to 20%, because this provides a net or a rope with excellent dimensional stability. The fiber physical properties mentioned above can be controlled by the spinning temperature, spinning rate, drawing temperature, draw ratio, etc.

With respect to the mesh configuration of the net, it is preferable to use diamond-shaped mesh, hexagonal mesh, square mesh, staggered mesh, hexagonal mesh, or the like. When such a mesh configuration is employed, a commonly used net-making machine can be used, whereby an increase in the cost of net making can be suppressed. With respect to the kind of net fabric, it is preferable to use a knotted net with a single sheet bend knot, a square knot, or the like, a knotless net, a raschel net, a minnow net, a woven net, or the like. In particular, it is preferable to employ a net fabric with no knot, because net rupture is likely to be prevented by stress dispersion.

The mesh size (the size of mesh) is preferably 5 to 200 mm, preferably 10 to 150 mm, and still more preferably 15 to 100 mm. A mesh size of less than 5 mm causes the problem of clogging or the problem of increased cost due to the fine network, while a mesh size of more than 200 mm makes it difficult to capture the desired object. The net of the invention can be used for civil engineering, agriculture, fishing materials, forestry, architecture, and any other applications as a safety net, a covering net, a rockfall prevention net, a snow protection net, a slope protection net, a sports net, a shore protection net, a vegetation net, a fishing net, a young tree protection net, etc. The net of the invention may be coated with various resins or films. The net may also be multi-layered or have a nonwoven fabric, a film, or the like laminated thereto. A method for producing a net will be described hereinafter taking a knotless net as an example. However, as long as the effects of the invention are not impaired, it is not limited to the following method.

Several fibers in the form of multifilaments and/or monofilaments are arranged at a fineness necessary for a net yarn. The fineness of such a net yarn is not particularly limited, and may be suitably changed according to the intended use. The arranged yarn is first-twisted to give a first-twisted yarn, then two such first-twisted yarns are joined together and intermediate-twisted, and two such intermediate-twisted yarns are joined together and second-twisted to form a net yarn, while combining such net yarns with one another to form knot portions, which may then be formed into a knotless net using a knotless-net-making machine that simultaneously creates meshes. A method in which knitting is performed using a raschel knitting machine is also applicable. Incidentally, the obtained net is preferably heat-treated by a tenter or the like at a temperature within a range of 60 to 160° C. When the heat treatment temperature is 160° C. or less, a net with high quality can be obtained without the fusion of fibers, while when it is 60° C. or more, a desired heat-setting effect can be obtained. The heat-setting temperature range is preferably 80 to 150° C., and still more preferably 100 to 140° C. Incidentally, heat setting may be performed at the time of twisting before net making. The tension applied to the net in heat setting is preferably within a range of 0.05 to 2 cN/dtex, for example. However, the tension is not particularly limited thereto, and, according to the intended use, the most suitable tension may be applied. A method for measuring tension may be, for example, a method in which Tension Pickup (BTB1-R03) manufactured by Eiko Sokki is used as a detector, and Tension Meter (HS-3060) manufactured by Eiko Sokki is used for monitoring.

Further, with respect to a method for producing a rope, a known method can be used to make the rope. Fibers are joined together and then subjected to the yarn process and the strand process, and the resulting strand is made into a rope using a closer or a braiding machine. Subsequently, a heat treatment process is preferably performed at a temperature within a range of 60 to 160° C. in order to stabilize the shape, quality, and performance. When the heat treatment temperature is 160° C. or less, a rope with high quality can be obtained without the fusion of fibers, while when it is 60° C. or more, a desired heat-setting effect can be obtained. The heat-setting temperature range is preferably 80 to 150° C., and still more preferably 100 to 140° C.

Various methods are possible for the heat treatment, including resin finishing, steam, hot water, electric heat, etc. However, because the rope diameter is usually large, in order to uniformly heat-treat the outside and inside of the rope, it is preferable to use a high-frequency wave which generates heat from the inside. The method for plying is not particularly limited, and the methods of JIS L-2701:1992, JIS L-2703:1992, JIS L-2704:1992, JIS L-2705:1992, and JIS L-2706:1992, for example, can be suitably selected and used. The number of twists is not particularly limited. Usually, for example, a yarn is first-twisted 30 to 500 times/m and preferably 50 to 300 times/m, and second-twisted 20 to 200 times/m and preferably 20 to 100 times/m.

The rope structure may be suited for the intended use. Examples thereof include three-ply, four-ply, six-ply, eight-ply, and like laid ropes; plain-braided, twill-braided, 12-ply, 16-ply, and like stranded ropes and braided strings; and ropes with a special structure, such as solid-braided ropes, rock-resistant ropes, and long-lines. However, in order to make use of the high strength and high elastic modulus of the fiber to the full extent, it is preferable to select one with a small number of twists. At the time of twisting or braiding, it is effective to apply a sizing agent, an oil, and a surface-treating agent to the filaments as necessary. It is also possible to perform these treatments once the rope is produced. Such a surface treatment is preferable, because this is effective in terms of loss of physical properties due to friction and wear between fibers forming the rope; wear due to the contact of the rope or fibers with other materials, such as metal, during the production and use of the rope; and weatherability. Thus, a rope can be obtained. Such a rope is suitable, for example, as a rope for ships, such as a buoy rope, a tag line, a mooring line, a guy rope, or a strong rope, or as a land rope, such as a climbing rope, a ranger rope, or a lead. However, the rope can be used without limitation to these applications.

<Artificial Leather Products>

In the production of an artificial leather product mentioned above, a leather-like sheet using the fiber of the invention may be used as a material therefor. The obtained leather-like sheet can be used for sundries such as shoes, bags, and accessory cases, and also for various applications where a leather-like sheet is used, including upholstery materials such as sofa coverings, garments, car interiors, industrial materials, etc.

Such a leather-like sheet is made of, for example, a nonwoven fabric using the fiber of the invention and an elastomer. Specifically, for example, it can be obtained by combining the following steps.

That is, the steps are:

(a) a step in which a fiber capable of forming ultrafine fibers is obtained by composite spinning or blend spinning, followed by drawing, crimping, and cutting to thereby produce raw cotton capable of forming ultrafine fibers;

(b) a step in which the raw cotton is carded and cross-lapped as necessary, and then entangled to form a nonwoven fabric, (c) a step in which components other than those used for the substrate of a leather-like sheet are dissolved and removed, or physically or chemically separated, from the fibers capable of forming ultrafine fibers, followed by splitting to form ultrafine fibers, and, before and/or after that, an elastomer is applied to the nonwoven fabric and then substantially coagulated/solidified;

(d) a step in which a napping treatment is performed as necessary to raise the surface; and (e) a step in which dyeing is performed with a disperse dye or the like.

In the invention, in terms of improving the texture of the obtained leather-like sheet, it is preferable that the nonwoven fabric used as the substrate of the leather-like sheet has a single-fiber fineness of 3 dtex or less, still more preferably 2 dtex or less, and more preferably 1.5 dtex or less. So-called ultrafine fibers having a fineness of 1 dtex or less are particularly preferable.

Further, when the fiber component forming the leather-like sheet is mainly 0.5 dtex or less, preferably 0.3 dtex or less, and more preferably 0.1 dtex or less, the softness and feel as a leather-like sheet can be improved. In the case where a napping treatment is applied to form a suede-like sheet, excellent appearance can also be achieved.

As a method for obtaining such ultrafine fibers, a method in which desired ultrafine fibers are directly obtained or a method in which thick fibers capable of forming ultrafine fibers are once prepared, followed by the production of ultrafine fibers therefrom, can be employed. In terms of the ease of obtaining fine fibers or the softness of the resulting leather-like sheet, it is preferable to use the method in which thick fibers capable of forming ultrafine fibers are once prepared, and then ultrafine fibers are produced therefrom.

As such a method, it is possible to use, for example, a method in which a plurality of polymers having different solubilities are composite-spun or conjugate to obtain fibers capable of developing ultrafine fibers, and then at least one kind of polymer is removed to form ultrafine fibers; a method in which a separable/splittable composite fiber is split; etc.

With respect to the composite form in spinning such a fiber capable of developing ultrafine fibers, a side-by-side configuration, a multi-layer laminated configuration, and a sheath-core composite configuration, where polymers are in a laminate-like state, as well as a sea-island configuration and a multicore sheath-core configuration, where a polymer is present in the form of islands in another polymer, can be obtained by composite spinning, while a blend type where polymers are mixed like an alloy can be obtained by blend spinning.

With respect to the kind of polymer to be removed, a polymer having lower melt viscosity and higher surface tension than components not to be removed under spinning conditions is preferable, and a polymer having higher solubility or decomposability than components not to be removed and also having low compatibility with components not to be removed is satisfactory.

Examples of polymers to be removed include polyethylene, polystyrene, polyethylene copolymers, thermoplastic polyvinyl alcohol, and like polymers. For example, polystyrene can be easily extracted with toluene, and polyethylene can be easily extracted with trichloroethylene or the like. Thermoplastic polyvinyl alcohol can be removed by decomposition with hot water.

Thus, as a result of such polymer extraction or removal by decomposition, an ultrafine fiber bundle can be obtained.

The nonwoven fabric using fibers capable of forming ultrafine fibers may be a staple-fiber nonwoven fabric using fibers obtained by the fiber production method mentioned above or may also be a filament nonwoven fabric formed directly after melt spinning by a spunbonding process or the like.

In particular, in the case of a staple-fiber nonwoven fabric, the production may be as follows: drawn fibers are crimped to form raw cotton and then opened by carding, a fiber web is formed through a webber, and then the obtained fiber web is laminated depending on the thickness and weight of a leather-like sheet to be obtained, followed by an entangling treatment by a known method, such as a needle-punching process or a high-pressure hydroentangling process, thereby forming a nonwoven fabric. Alternatively, it is also possible to entangle such staple fibers or cut fibers with a previously woven or knitted fabric using streams of water, needles, or the like, and use the resulting cloth like a nonwoven fabric.

Incidentally, as necessary, a nonwoven fabric produced by the above method may be subjected to a treatment in which a polyvinyl-alcohol-based sizing agent is applied thereto or the surface of the constituent fibers is melted, so that the constituent fibers of the nonwoven fabric are bound together, thereby temporarily fixing the nonwoven fabric. Such a treatment can prevent the nonwoven fabric from structural destruction due to tension or the like in the subsequent process of applying an elastomer.

When the obtained nonwoven fabric is heat-treated, the fibers shrink, whereby the appearance can be improved.

The shrinking method may be a method in which the nonwoven fabric is placed in hot air or in hot water. However, a hot water bath is preferable, because heat is uniformly transferred within the nonwoven fabric, causing uniform shrinkage.

Next, the nonwoven fabric is impregnated with a solvent for an elastomer and then heat-dried to cause gelation or, alternatively, after the impregnation, the nonwoven fabric is immersed in a liquid containing a non-solvent for an elastomer to cause wet-coagulation. As a result, a dense foam of an elastomer can be formed. Examples of elastomers for impregnation include polyurethanes obtained by a reaction of the following components in a predetermined molar ratio and modified products thereof: at least one polymer diol having an average molecular weight of 500 to 3000 selected from diols such as polyester diols, polyether diols, and polycarbonate diols, composite diols such as polyester-polyether diols, and the like; at least one diisocyanate selected from aromatic diisocyanates, alicyclic diisocyanates, and aliphatic diisocyanates such as 4,4'-diphenylmethane diisocyanate, isophorone diisocyanate, and hexamethylene diisocyanate, etc.; and at least one low-molecular compound having at least two active hydrogen atoms (chain extender), such as ethylene glycol and isophoronediamine. In addition, elastomers such as polyester elastomers and hydrogenated styrene-isoprene block copolymers, acrylic and other resins, and the like are also mentioned. Compositions obtained by mixing them are also usable.

Of the above elastomers, polyurethanes using a polyester diol and ester-ester polyester elastomers are more preferable, and polyurethanes using polyethylene propylene adipate glycol and polyethylene adipate glycol, as well as polyester elastomers containing polybutylene terephthalate and polycaprolactone diol, are still more preferable.

In terms of softness, elastic recovery, sponge-forming properties, durability, and the like, the above polyurethanes are preferably used.

A nonwoven fabric is impregnated with a liquid elastomer obtained by dissolving or dispersing such an elastomer in a solvent or a dispersant. The nonwoven fabric is then treated with a non-solvent for resin to cause wet-coagulation, thereby forming a sponge, or is directly heat-dried to cause gelation, thereby forming a sponge; the sheet is obtained by such a method.

As necessary, additives such as colorants, coagulation regulators, antioxidants, and dispersants may be incorporated into the liquid elastomer.

The elastomer proportion is, as solids, 10 wt % or more, preferably within a range of 30 to 50 wt %, based on the total weight of the sheet. When the elastomer proportion of less than 10 wt %, this is likely to cause the pull-out of fibers forming the nonwoven fabric.

In the case where an ultrafine-fiber-forming fiber is used as the fiber, a sheet impregnated with the elastomer may be subjected to an extraction treatment or a separation/splitting treatment to form ultrafine fibers, or it is also possible to form ultrafine fibers before the sheet is impregnated with the elastomer. However, in terms of handling, it is preferable to form ultrafine fibers after or at the time when the sheet is impregnated with the elastomer.

In the invention, by fluffing up the surface of the leather-like sheet, a suede-like artificial leather can be obtained. As a method for fluffing, a method in which the surface is buffed with sandpaper, card clothing, or the like can be employed.

It is also possible to form a so-called grained leather-like sheet having a grain layer on the surface thereof. As methods for forming such a grain layer, a method in which a coating of a liquid resin for a grain layer is applied to a sheet made of a nonwoven fabric impregnated with an elastomer, then dried, and embossed is known, and also a release paper method is known, in which a resin layer coating for a grain layer separately applied onto a release paper is attached to a sheet made of a nonwoven fabric impregnated with an elastomer via a half-dry, polyurethane resin adhesion layer. Either of them can be employed.

The leather-like sheet of the invention can be dyed with a disperse dye. Because of its improved hydrolysis resistance, the leather-like sheet can be dyed even under high-temperature conditions, and can also be dyed a deep color.

<Textured Yarn>

In case the where a false twisted textured yarn, for example, is produced as the textured yarn mentioned above, the fiber (raw yarn) may be subjected to false-twist texturing. A raw yarn (usually an undrawn yarn) is heat-treated while twisting, then cooled in the twisted state to fix the structure, and subsequently untwisted, whereby a false-twist yarn can be obtained. Usually, the raw yarns are continuously fed and false-twist textured. Upon false-twist texturing, fibers are crimped, whereby bulkiness and stretchability can be imparted.

In the case where an entangled yarn, for example, is produced as the textured yarn, any techniques for entangling a raw yarn can be employed. Usually, fluid-entanglement, in which a fluid is applied to a raw yarn (multifilament) to entangle the yarn, may be employed. The raw yarn is usually continuously fed and fluid-entangled.

In this case, the entanglement state can be varied depending on the kind of fluid to be applied, the position of fluid application to the raw yarn, the application angle, the amount applied, and the application time, as well as the relation with the speed of feeding the raw yarn to the application position. Thus, it is possible to entangle the yarn in such a manner that single fibers forming a multifilament cross one another at various positions within the multifilament, thereby improving the bundling properties of the multifilament. It is also possible that, like a so-called "Taslan" yarn, some of single fibers forming a multifilament form loops on the multifilament surface along the lengthwise direction of the multifilament, thereby improving the design and bulkiness.

In the case where a twisted yarn is produced as the textured yarn, such a yarn can be obtained by twisting a raw yarn (usually a drawn yarn, multifilament). Although twisting is usually performed continuously, as long as the object of the invention can be achieved, any known methods are usable. By twisting the yarn, handleability can be improved.

In the case where a thick-and-thin yarn is produced as the textured yarn, usable methods are a method in which when a raw yarn (undrawn yarn) is continuously subjected to a drawing process, the drawing conditions (temperature, tension, etc.) are varied, thereby non-uniformly drawing the yarn (partial drawing); a method in which a filament for forming thick and thin portions is wound around a filament that serves as the core at varying pitches; and a method in which a filament that serves as the core and a filament for forming thick and thin portions are entangled constantly or randomly while overfeeding. Although this process is usually performed continuously, as long as the object of the invention can be achieved, any known methods are applicable. By forming a thick-and-thin yarn, in particular, the design can be improved.

In the case where a combined filament yarn is produced as the textured yarn, such a yarn can be obtained by joining at least two kinds of filaments having different properties together.

In addition to the textured yarns mentioned above, for example, as long as the effects of the invention can be achieved, any yarns can be employed, and also any known texturing methods can be employed.

As necessary, it is also possible to combine these texturing processes. For example, when two kinds of filaments having different heat shrinkages are combined, entangled, and then heat-treated, a bulky yarn can be obtained without the false-twist texturing process.

<Dyeing Treatment>

Further, the fiber structure (or fiber) may be subjected to a dyeing treatment. The dyeing treatment is not particularly limited, and may be a dyeing treatment using an ordinary disperse dye. For example, in the case where the fiber structure contains an aromatic polyester fiber, such as a polyethylene terephthalate fiber, the dyeing treatment may be performed at a temperature of 120° C. or more (preferably 120 to 135° C.) for 20 to 40 minutes using an aqueous dye solution containing, in addition to a disperse dye, a level dyeing agent, a pH adjuster, and the like. Preferred examples of dyes used for dyeing include, but are not particularly limited to, azo disperse dyes having excellent washing fastness. In particular, as disperse dyes easily decomposable in the below-mentioned clearing-treatment liquid, disperse dyes containing a diester group and azo disperse dyes, particularly a thiazole type and a thiophene type, are preferable, but dyes are not particularly limited thereto. Further, anthraquinone disperse dyes, benzodifuranone-type disperse dyes, disperse dyes having an alkylamine group, and the like are also mentioned.

In the fiber structure of the invention, when the lightness L* value is 40 to 90 and the chroma C* value is 40 to 80, this results in high chroma with excellent vivid-color-forming properties. Therefore, such a fiber structure is particularly suitable for applications to high-value-added garments, such as women's dresses and formal dresses.

A fiber structure that meets the above requirements can be obtained by dyeing the fiber structure of the invention with a disperse dye at a dye concentration of 0.1 to 20% owf. The dye herein means a dye that gives a chroma C* value of 40 to 80 when dyeing, and may be any dye as long as the chroma C* value of the resulting fiber structure is 40 to 80.

When the dye concentration is less than 0.1% owf, a fiber structure with high chroma having a lightness L* value of 40 to 80 may not be obtained. Meanwhile, even when the dye concentration is increased, the deep-color dyeing effect is saturated. Therefore, from the economical point of view, the concentration may be 20% owf or less.

With respect to the dyeing temperature, although this changes depending on the target polymer compound, in the case of an ordinary polyester, for example, when the temperature is less than 70° C., the diffusion of the dye into fibers may be insufficient, whereby color formation to an L* value of 40 to 80 may not be achieved, while when the temperature is too high, this may cause a decrease in fiber strength. Therefore, in terms of high dyeing properties, the dyeing temperature may be 70 to 130° C. Specifically, the temperature depends on the target polymer compound, but may be suitably selected from the above point of view.

Depending on the target polymer compound, before dyeing, as necessary, scouring under weakly alkaline conditions at 50° C. to 100° C. and/or weight reduction under alkaline conditions at 50 to 100° C. may be performed. After dyeing, as necessary, reduction clearing may also be performed under weakly alkaline conditions in the presence of a reducing agent. Further, in order to improve color-forming properties or impart other functions, a known resin coating may also be applied.

When, as a fiber structure, the lightness L* value is less than 40 and the chroma C* value is less than 40, the fiber structure has excellent deep-color properties. Therefore, such a fiber structure is particularly suitable for applications to black formal dresses, school uniforms, and Japanese clothes, for example. In particular, an L* value of 12 or less gives a deep blackish color, allowing applications for black formal dresses, and thus is particularly preferable. Incidentally, an L* value of less than 20 may be difficult to achieve when dyeing is performed under the so-called normal pressure. However, such a case may be dealt with by dyeing under high pressure.

A fiber structure that meets the above requirements can be obtained by dyeing a fiber structure with a disperse dye at a dye concentration of 0.1 to 30% owf.

The dye herein means a dye that gives a chroma C* value of less than 40 when dyeing, and may be a dye containing one or more kinds of dyes as long as the chroma C* value of the resulting fiber structure is less than 40.

When the dye concentration is less than 0.1% owf, the formation of a deep color with a lightness L* value of less than 40 may not be achieved. Meanwhile, even when the dye concentration is increased, the deep-color dyeing effect is saturated. Therefore, from the economical point of view, the concentration may be 30% owf or less.

With respect to the dyeing temperature, although this changes depending on the target polymer compound, in the case of an ordinary polyester, for example, when the temperature is less than 70° C., the diffusion of the dye into fibers may be insufficient, whereby the formation of a deep color with an L* value of less than 40 may not be achieved, while when the temperature is too high, this may cause a decrease in fiber strength. Therefore, in terms of high dyeing properties, the dyeing temperature may be 70 to 130° C. Specifically, the temperature depends on the target polymer compound, but may be suitably selected from the above point of view.

Depending on the target polymer, before dyeing, as necessary, scouring under weakly alkaline conditions at 50° C. to 100° C. and/or weight reduction under alkaline conditions at 50 to 100° C. may be performed. After dyeing, as necessary, reduction clearing may also be performed under weakly alkaline conditions in the presence of a reducing agent. Further, in order to improve color-forming properties or impart other functions, a known resin coating may also be applied.

In the case where a reduction clearing treatment is performed after the dyeing treatment mentioned above, it is preferable to perform the reduction clearing treatment in a reducing bath of pH 8 to 2. In the alkaline area of pH 8 or higher, the polymer contained in the fiber may be hydrolyzed, causing a decrease in fiber strength. Examples of reducing agents include tin-based reducing agents, Rongalite C, Rongalite Z, stannous chloride, sulfin-based reducing agents, and hydrosulfite. The reducing agent is preferably used at a concentration of 1 to 10 g/L. The concentration may be selected depending on the type of dye used, the dyeing concentration, and the temperature of the reducing bath. The treatment temperature of the reducing bath is not particularly limited, but is preferably within a range of 60 to 98° C. The treatment time is preferably 10 to 40 minutes.

Further, at the time of the treatment in the reducing bath, it is possible to use, as fiber-swelling agents, commonly used carriers such as chlorobenzene-based carriers, methylnaphthalene-based carriers, orthophenylphenol-based carriers, aromatic-ether-based carriers, and aromatic-ester-based carriers. Examples of such fiber-swelling agents include, but are not limited to, polyoxyethylene alkyl aryl ethers, polyoxyethylene alkylamines, polyoxyethylene alkylphenol ethers, polyoxyethylene alkyl ethers, polyoxyethylene alkylamine ethers, polyoxyethylene alkylbenzyl ammonium chlorides, and alkylpicolinium chlorides, which are expected to have affinity for fibers.

When the reduction clearing treatment is performed in a weak alkaline to acidic region of pH 8 or lower, at the time of the reduction clearing treatment, the excess dye on the fiber surface portion can be reduced and decomposed without the hydrolysis of the fiber-forming polymer, and the obtained fiber structure can serve as a fiber structure having excellent color fastness, whose fiber strength does not decrease much in a wet heat environment. For example, it is preferable that after the fiber structure that has undergone dyeing and the reduction treatment is treated for a week in an environment with a temperature of 70° C. and a humidity of 90% RH, the fiber strength of fibers contained in the fiber structure is 0.5 cN/dtex or more (more preferably 3 to 10 cN/dtex) (in the case where polylactic acid is selected as the polymer). It is also preferable that the dyed fiber structure has a washing fastness of Class 3 or higher as measured by the AATCC (American association of Textile Chemists and Colorists) IIA method.

Further, in dyeing the fiber structure of the invention, it is also possible that instead of the above disperse dye, a polymeric dispersant in a pigment dispersion is crosslinked using a crosslinking agent at the time of coloring, thereby binding the pigment onto the fibers.

That is, a coloring composition containing a pigment dispersion and a crosslinking agent is used, the pigment dispersion containing a pigment having an average particle size of 0.1 to 0.5 μm, a polymeric dispersant having a hydrophobic group and an ionic group as essential components, and an aqueous medium. The composition is subjected to a crosslinking reaction between the polymeric dispersant and the crosslinking agent at the time of coloring, thereby binding the pigment onto the fiber structure to achieve coloring. A coloring composition having these components dispersed and mixed therein is to be used.

The coloring composition is characterized in that a pigment dispersion containing a pigment and a polymeric dispersant as active ingredients and a crosslinking agent are incorporated.

The pigment dispersion is produced from (1) a pigment (a), (2) a polymeric dispersant (b), and (3) an aqueous medium (c). In terms of the texture of fibers upon the binding of the pigment thereto, etc., it is preferable that the pigment has an average particle size of 0.1 to 0.5 μm. The pigment used for the dispersion may be an organic pigment or an inorganic pigment, and any pigments that can be used as colorants for textile products are usable.

Examples of usable pigments include, but are not necessarily limited to, carbon black, iron black pigments, and the like as black pigments; quinacridone pigments, cromophtal pigments, azo pigments, diketopyrrolopyrrole pigments, anthraquinone pigments, and the like as red pigments; azo pigments, imidazolone pigments, titanium yellow pigments, and the like as yellow pigments; indanthrene pigments, azo pigments, and the like as orange pigments; phthalocyanine pigments, ultramarine blue, iron blue, and the like as blue pigments; phthalocyanine pigments and the like as green pigments; dioxazine pigments, quinacridone pigment, and the like as purple pigments; and titanium oxide, aluminum silicate, silicon oxide, and the like as white pigments.

Further, the polymeric dispersant is a polymeric dispersant having a hydrophobic group and an ionic group as essential components, and serves to improve the dispersibility of the pigment. Also, at the time of coloring, the polymeric dispersant is crosslinked by the action of the crosslinking agent, performing the function as a binder.

The polymeric dispersant has, as essential components, a hydrophobic group (an electrically neutral, nonpolar substance having low affinity for water) and an ionic group (an electrically ionic, polar substance having high affinity for water). The polymeric dispersant may have a linear or branched structure, and also may have a random, alternating, periodic, or block structure. It may also be a graft polymer with backbone and branch structures designed. Incidentally, when the polymeric dispersant is incorporated into the aqueous medium, it may be used in the form of an aqueous solution, a dispersion, or an emulsion.

The polymeric dispersant can be produced by the copolymerization of a monomer containing a hydrophobic group and a monomer containing an ionic group. Incidentally, each monomer may be used alone, and it is also possible to use two or more kinds. Examples of monomers containing a hydrophobic group include vinyl monomers, such as styrene monomers, phenyl-group-containing (meth)acrylate, (meth) acrylic acid alkyl esters, alkyl vinyl ethers, and (meth) acrylonitrile; urethane-group-containing vinyl monomers formed from a polyisocyanate and a polyol or a polyamine, etc.; epoxy-group-containing vinyl monomers formed from epichlorohydrin and bisphenol, etc.; ester-group-containing vinyl monomers formed from monomers such as a polycarboxylic acid and a polyalcohol, etc.; and silicone-group-containing vinyl monomers formed from organopolysiloxane, etc.

Ionic groups include anionic groups and cationic groups, and monomers that give such ionic groups are as follows. In the case of anionic groups, examples of monomers include unsaturated carboxylic acid monomers, such as (meth) acrylic acid, crotonic acid, sorbic acid, maleic acid, fumaric acid, itaconic acid, monoalkyl esters of unsaturated dicarboxylic acids, and anhydrides and salts thereof; unsaturated sulfonic acid monomers, such as styrenesulfonic acid, vinylsulfonic acid, 2-acrylamido-2-methylpropanesulfonic acid, sulfuric acid esters of 2-hydroxyalkyl (meth)acrylates, and salts thereof; and unsaturated phosphoric acid monomers, such as vinyl phosphoric acid, phosphoric acid esters of hydroxyalkyl (meth)acrylates ($C_{2-6}$), and alkylphosphonic acid (meth)acrylates. Examples of monomers containing an cationic group include unsaturated amine-containing monomers, such as vinylamine, allylamine, vinylpyridine, methyl vinyl pyridine, N,N-dialkylamino styrenes, N,N-dialkylamino alkyl (meth)acrylates, and dialkylamino ethyl vinyl ethers, and unsaturated ammonium-salt-containing monomers obtained by quaternizing the above unsaturated tertiary-amine-containing monomers with a quaternizing agent.

As a method for forming a polymeric dispersant, in addition to the above copolymerization method, it is also possible to employ, for example, a method in which a monomer containing a urethane-forming-group, which has an ionic group previously introduced thereinto, is subjected to urethane polymerization, or in which a monomer containing an epoxy-forming-group, which has an ionic group previously introduced thereinto, is subjected to epoxy polymerization, etc.

It is also possible to form a polymer as the backbone by polymerization, and then introduce desired ionic groups as branches to form a graft polymer, thereby forming the polymeric dispersant of the invention.

Further, in addition to hydrophobic groups and ionic groups as essential components, the polymeric dispersant of the invention may also contain other components. For example, nonionic polyethylene oxides having a hydroxyl group or an amide group, monomers containing a polyol or a hydroxyalkyl ester, acrylamides, hydroxyalkyl acrylates, vinyl acetate, vinyl alcohol, N-ethylmethacrylamide, N-isopropylacrylamide, N-vinyl pyrrolidone, and the like may be used as monomers for copolymerization.

As an aqueous medium, water, a water-soluble organic solvent, or the like may be used. Examples of water-soluble organic solvents include methanol, ethanol, n-propanol, isopropanol, n-butanol, isobutanol, tert-butanol, trimethylolpropane, ethylene glycol, diethylene glycol, triethylene glycol, polyethylene glycol, propylene glycol, butylene glycol, 1,2,6-hexanetriol, thioglycol, hexylene glycol, glycerol, diglycerol, 2-pyrrolidone, N-methyl-2-pyrrolidone, 1,5-pentanediol, ethylene glycol monoethyl ether, and ethylene glycol monobutyl ether.

With respect to the pigment dispersion, the above pigment, polymeric dispersant, and aqueous medium are mixed and treated in a dispersion mill using glass beads, zirconia beads, titania beads, and the like, whereby the pigment dispersion can be obtained. An average particle size of 0.1 to 0.5 μm leads to excellent color concentration, vividness, and fastness, and thus is preferable. When the average particle size is less than 0.1 μm, it takes a long period of time to complete dispersion, possibly causing an operational problem due to the aggregation of the pigment or the problem of decreased color concentration. When the average particle size is 0.5 μm or more, this leads to low color concentration, resulting in a colorant with less vividness, and, also, the colored fabric has poor fastness. Therefore, this is undesirable.

To such a pigment dispersion, as humectants, glycol solvents such as ethylene glycol, propylene glycol, diethylene glycol, glycerin, and polyethylene glycol, urea, hyaluronic acid, sucrose, and the like may be added as necessary.

In addition, as dispersion aids, nonionic surfactants and anionic surfactants may also be added thereto, but these surfactants decrease the performance as the pigment dispersion of the invention. Therefore, it is undesirable to incorporate large amounts.

A crosslinking agent crosslinks ionic groups of the polymeric dispersant having, as a pigment dispersant, hydrophobic group and ionic groups. As a result, the hydrophilic ionic groups are capped, whereby the polymeric dispersant becomes a highly water-insoluble, resin-like polymer, performing the function of a binder for the pigment.

Crosslinking agents are not particularly limited, as long as they are oxazoline compounds, isocyanate compounds, blocked isocyanate compounds, epoxy resin compounds, ethyleneurea compounds, ethyleneimine compounds, melamine compounds, organic acid dihydrazide compounds, and crosslinking-group-containing compounds having diacetone acrylamide, a carbodiimide, and a silane-coupling agent. Several crosslinking agents may be used together.

Incidentally, because of its reactivity, a crosslinking agent gradually promotes the curing of a color ink, and it is necessary to consider the so-called pot life; therefore, a crosslinking agent is incorporated immediately before coloring. However, a crosslinking agent having its functional group blocked or protected does not promote the curing of the ink, and thus can be previously incorporated into the below-mentioned reducer and used.

A color ink is an ink for coloring fibers, and can be obtained by incorporating the coloring composition mentioned above with the reducer mentioned below. For the reasons of pigment concentration or viscosity, fibers cannot be directly colored using the coloring composition. Therefore, the coloring composition is arbitrarily diluted with a reducer having a viscosity appropriate for the processing method, and used as a color ink having a pigment concentration suitable for the processing method.

The reducer in the invention refers to an aqueous diluent. Both turpentine reducers containing turpentine or turpentine-free reducers containing no turpentine are usable.

A turpentine reducer is a paste obtained by emulsifying water and turpentine with a nonionic surfactant. By changing the kind of nonionic surfactant and also changing the ratio between water and turpentine, reducers can be provided with various viscosity properties and viscosities appropriate for the processing method.

As a turpentine-free reducer, it is possible to use an aqueous solution of a water-soluble thickener, such as carboxymethyl cellulose, hydroxyethyl cellulose, methyl cellulose, or algin, or it is also possible to use a paste obtained by arbitrarily diluting an alkali-soluble crosslinked acrylic resin, an alkali-thickened acrylic acid polymer, or the like with water. Depending on their kinds or concentrations, reducers can be provided with various viscosity properties and viscosities. In terms of the fastness of a colored cloth, it is preferable to apply not a water-soluble thickener but a resin-type thickener to a turpentine-free reducer.

The viscosity and viscosity properties of the color ink should be adjusted according to the processing method. Approximately, an ink adjusted to 100 to 1,000 mPa/s is used in the case of a padding method, an ink adjusted to 1,000 to 5,000 mPa/s is used in the case of roller printing, an ink adjusted to 3,000 to 100,000 mPa/s is used in the case of screen printing, and an ink adjusted to 1,000 to 5,000 mPa/s is used in the case of knife coating. Usually, this viscosity is achieved by pre-adjusting the viscosity of the reducer.

The amount of the coloring composition in the color ink depends on the pigment concentration of the coloring composition or the desired ink concentration, but is preferably 0.1 to 20 wt %. Further, binders, humectants, plasticizers, other additives, and the like may be suitably incorporated into the color ink. For such incorporation, an additive may be previously mixed with the reducer or added to the color ink later.

Examples of coloring methods for coloring the fiber structure include a padding method in which fibers are immersed in the color ink and squeezed with a mangle or the like, followed by drying to bind the pigment, a roller printing method in which the color ink is applied onto fibers using an intaglio printing plate, followed by drying to bind the pigment, and a screen printing method in which the color ink is printed onto fibers using a screen printing plate, followed by drying to bind the pigment.

Incidentally, examples of processing machines for the screen printing method include an automatic screen-printing machine, a manual screen-printing machine, a rotary printing machine, a circular automatic printing machine, and an elliptic automatic printing machine.

Coloring methods also include a coating method in which a coating of the color ink is applied over the entire fibers, followed by drying to bind the pigment. Examples of coating machines are knife coaters, wire coaters, comma coaters, etc. Coloring methods also include an exhaust dyeing method in which cellulose fibers are pretreated with a cationizing agent, and then allowed to ionically adsorb the pigment dispersion of the invention. As a dyeing machine, it is possible to use a paddle-type dyeing machine, a drum-type dyeing machine, a winch-type dyeing machine, a jet dyeing machine, or the like.

Incidentally, the coloring method is not limited to those mentioned as examples, and any method is applicable as long as the method is capable of coloring fibers with the coloring composition of the invention.

In a colored cloth obtained by coloring fibers with the color ink, the polymeric dispersant in the coloring composition is crosslinked and cured with the crosslinking agent. After drying the colored cloth, although a crosslinking reaction gradually proceeds even at room temperature, it is preferable to heat-treat the colored cloth in order to further promote crosslinking and curing. Usually, the purpose can be achieved by a heat treatment at 100° C. to 180° C. for 3 to 10 minutes.

Further, as a post-treatment, a padding treatment may be performed to apply a post-treatment agent over the entire surface of the colored cloth, whereby a colored cloth having a texture with improved softness and fastness (in particular, friction fastness) can be obtained.

Examples of post-treatment agents for softening include cationic/anionic/nonionic surfactants, dimethyl silicone oil, amino silicone oil, carboxy-modified silicone oil, hydroxy-modified silicone oil, fatty acid, fatty acid amide, mineral oil, vegetable oil, animal oil, and plasticizers. Examples of post-treatment agents for improving slidability on the surface of the colored fibers include metallic soap, paraffin wax, carnauba wax, microcrystalline wax, dimethyl silicone oil, amino silicone oil, carboxy-modified silicone oil, and hydroxy-modified silicone oil.

In the padding treatment, a colored cloth is immersed in such a post-treatment agent emulsified by stirring with a mixer, thermally emulsified, or dispersed in an aqueous solvent, and the colored cloth is then squeezed with a mangle or the like, dried, and heat-treated. When a small amount of a resin emulsion is incorporated into the post-treatment agent as a binder, the friction fastness of the colored cloth can be improved. The resin emulsion to be incorporated as a binder is not particularly limited, and may be an acrylic acid ester resin emulsion, a urethane resin emulsion, an EVA resin emulsion, a silicone/acrylic resin emulsion, a polyester resin emulsion, or the like. In order to provide the colored cloth with a soft texture, it is preferable that these resin emulsions have a glass transition temperature of 0° C. or less.

The thus-obtained dyed fiber structure is a fiber structure having excellent color fastness, whose fiber strength does not decrease much in a wet heat environment. In that case, it is preferable that after the dyed fiber structure is treated for a week in an environment with a temperature of 70° C. and a humidity of 90% RH, the fiber strength of the polylactic acid fibers contained in the fiber structure is 0.5 cN/dtex (0.5 g/dtex) or more (more preferably 2.9 to 9.8 cN/dtex (3 to 10 g/dtex). It is also preferable that the color of the dyed fiber structure is as deep as a lightness index L* value of 80 or less, because this allows the effect of dyeing to be even more expressed. It is also preferable that the dyed fiber structure has a washing fastness of Class 3 or higher as measured by the AATCC IIA method.

Dyeing with the disperse dye mentioned above may be combined with the above coloring method. The coloring method may be applied after dyeing with the disperse dye.

<Combined Use with Other Fibers>

The fiber structure may also be, for example, a combination product with fibers made of a different polymer compound containing a cyclic carbodiimide compound, or with fibers other than fibers made of the composition of the invention, including natural fibers such as cotton, silk, hemp, and wool, regenerated fibers such as rayon and acetate, and fibers made of a polymer compound containing no cyclic carbodiimide compound. Examples of modes of combined use include various combinations with a fiber structure made of a different kind of fiber, as well as combined filament yarns, composite false-twist yarns, blend-spun yarns, filament and staple composite yarns, fluid-textured yarns, covering yarns, plying yarns, combined weaving fabrics, combined knitting fabrics, woven pile fabrics, cotton blended wadding, mixed nonwoven fabrics made of filaments and staple fibers, and felts, which contain other fibers.

In particular, when a polylactic acid fiber is selected as the fiber of the invention and a silk fiber is selected as the other fiber, such a fiber structure made of a polylactic acid fiber and a silk fiber allows the silk fiber and the polylactic acid fiber to bring out or complement each other's characteristics, and thus can be mentioned as a preferred combination for combined use.

Specific examples thereof include woven fabrics, knitted fabrics, nonwoven fabrics, other fabrics, sewn products made thereof, and composite yarns such as piled yarns, combined filament yarns, combined-filament entangled yarns, and composite false twisted textured yarns. The ratio of combination may be such that the weight ratio between silk fibers and polylactic acid fibers is about (10:90) to (90:10). A ratio of (20:80) to (80:20) is particularly preferable.

As an example of the mode of combined use of silk fibers with polylactic acid fibers in a fiber structure, in the case of a woven fabric made of warp and weft yarns, it is possible to use the silk fibers for one or both of the warp and weft and use the polylactic acid fibers for one or both of the warp and weft. However, the silk fibers and the polylactic acid fibers are preferably mixed almost uniformly in the entire textile product. For example, in the case of the woven fabric mentioned above, it is preferable to use silk fibers for either the warp or weft and use polylactic acid fibers for the other, and it is also preferable that one to several silk fibers and polylactic acid fibers are alternately used for the warp and/or weft. In a knitted fabric, it is preferable to apply a combination of silk fibers and polylactic acid fibers to tricot using two or more reeds. A composite yarn obtained by compounding silk fibers with polylactic acid fibers is also possible.

Here, silk fibers may be used as a yarn of about 20 to 200 dtex, and polylactic acid fibers may be used as a yarn of about 30 to 300 dtex. These thicknesses may be selected considering the characteristics of the fiber structure to be obtained. When it is desired to emphasize the characteristics as a silk fabric, it is possible to increase the amount of silk fibers used and/or increase the thickness of silk fiber yarns (or reduce the thickness of polylactic acid fibers). When it is desired to emphasize the characteristics as a polylactic acid fiber woven fabric, it is possible to do the opposite to the above. However, when it is extreme, the effect of the combined use is not obtained. Therefore, usually, the thickness of a polylactic acid fiber yarn is preferably not less than 1.2 times the thickness of a silk fiber yarn, more preferably not less than 1.5 times, and particularly preferably not less than 2.0 times. Meanwhile, it is preferably not more than 8.0 times the thickness of a silk fiber yarn, more preferably not more than 6.0 times, and particularly preferably not more than 4.0 times.

Incidentally, specific examples of polylactic acid fibers to be used in combination include multifilaments, staple fibers, spunbond yarns, monofilaments, and flat yarns. In particular, a multifilament is effective, because it is characterized in that the generation of fluffs due to breakage of single yarns, which is a common problem, is hardly seen, and also that combined knitting or combined weaving with silk fibers is easy.

Incidentally, a cloth containing silk fibers (raw silk) is subjected to so-called scouring in order to remove sericin contained in the silk fibers (raw silk) and create softness, feel, and gloss.

The conditions for scouring may be suitably selected from known conditions according the texture of the fiber structure to be obtained, etc. For example, a cloth can be scoured with Marseille soap, sodium hydrogen carbonate, sodium silicate, an enzyme (alkaline proteolytic enzyme), etc.

Because of end capping by the cyclic carbodiimide compound, the fiber of the invention has improved hydrolysis resistance. Therefore, there is no need to worry about a decrease in strength through the scouring process even when the fiber is a polylactic acid fiber.

Incidentally, a silk fiber and a polylactic acid fiber are different in dye affinity. Therefore, as necessary, in the fiber structure of the invention, fibers that have been separately dyed may be combined and used, and it is also possible to perform dyeing by printing or the like after fibers are made into a textile product.

Such products made of silk fibers and the fibers of the invention are widely applicable for, similarly to conventional silk fiber products, kimono (Japanese traditional clothes), small articles for kimono, garments (blouses, shirts, coats, jackets, etc.), neckties, bags, bedding fabrics, etc., as products having excellent texture and gloss together with high-class looking.

<Heat-Retaining Fiber Structure>

Further, it is also possible to attach an IR absorber to the fiber structure of the invention, giving a heat-retaining fiber structure. Specifically, in the case where the fiber structure is a cloth, such as a woven fabric or a knitted fabric, an IR absorber is attached to at least one side of the cloth. In that case, the IR absorber is usually attached to the cloth using a binder resin. The IR absorber and binder resin may be attached to both sides of the cloth, but are preferably attached to only one side. When they are attached to only one side, and such a side is the back of the cloth, i.e., the side closer to the human's skin in application to a garment, even in the case where the IR absorber and binder resin are colored, such an agent or resin does not appear on the front of the cloth. Therefore, there is no risk of problems with the appearance. Further, when the IR absorber is attached only to the back, the transfer of heat from the back to the front of the cloth is suppressed, allowing effective heat retention. Further, when polylactic acid fibers are contained in the fiber structure, because polylactic acid fibers have higher light permeability than ordinary polyester fibers such as polyethylene terephthalate fibers, the IR absorber is more likely to absorb IR radiation, whereby excellent heat-retaining properties are obtained.

The IR absorber is not particularly limited as long as it is a substance that has an absorbance of 10% or more in the infrared region at wavelengths of 700 to 2000 nm, examples thereof including metal oxide fine particles, carbon black, and IR-absorbing pigments for organic compounds. Of such IR absorbers, those having a thermal conductivity of 10 W/(m·K) or more (more preferably 20 W/(m·K) or more) are preferable. When an IR absorber having such thermal conductivity is heated by IR radiation such as sunlight, the cloth is likely to be heated extremely rapidly, whereby excellent heat-retaining properties are obtained. Specifically, metal oxide fine particles having an average particle size of 100 nm or less, such as antimony-doped tin oxide (ATO) and tin-doped indium oxide (ITO), are preferable, for example. Such metal oxide fine particles are also transparent materials that transmit visible light. They thus do not change the hue of the cloth itself, and are preferable also in this respect. This type of metal oxide fine particles can be obtained as a dispersion in water or a dispersion in a solvent such as toluene. In the case where the cloth is a deep-colored product with a black, navy blue, or deep red hue, carbon black is also suitable. The particle size of such carbon black may be about several micrometers. Incidentally, when carbon black is applied to a light-colored cloth, the cloth surface tends to be grey.

The amount of the IR absorber to be bound to a cloth is preferably within a range of 0.02 to 50 g/m$^2$ (more preferably 0.5 to 20 g/m$^2$) of the cloth. When the amount of the IR absorber attached is less than this range, even when IR radiation such as sunlight is applied to the cloth, the cloth may not be sufficiently heated. On the contrary, when the amount of the IR absorber attached is less than the range, although the heat-retaining effect is sufficient, this is uneconomical.

Examples of binder resins include, but are not particularly limited to, urethane resin, acrylic resin, polyester resin, silicone resin, vinyl chloride resin, and nylon resin. The amount of the binder resin attached is, based on resin solids, preferably within a range of 0.01 to 40 g/m$^2$ (more preferably 5 to 30 g/m$^2$) of the cloth.

Usually, the IR absorber and binder resin are applied to the fiber structure as a blend composition of the two. In that case, the blend composition may be either an aqueous or solvent-based composition, but is preferably an aqueous composition in terms of the working environment in the processing process. Examples of solvents include toluene, isopropyl alcohol, dimethylformamide, methyl ethyl ketone, and ethyl acetate. The blend composition may also contain a crosslinking agent, such as an epoxy crosslinking agent. Further, for the purpose of improving attachment to the fiber structure itself, etc., appropriate additives may be further incorporated thereinto.

The ratio between the IR absorber and binder resin (based on resin solids) incorporated is preferably within a range of 1:0.5 to 1:50 (preferably 1:5 to 1:40). When the proportion of binder resin incorporated is less than this range, after the fiber structure is made into a product, the IR absorber is likely to come off during washing, whereby the washing durability related to heat-retaining performance may decrease. On the contrary, even when the proportion of binder resin incorporated is more than the range, this does not change the effect on washing durability much, and thus is uneconomical.

It is also preferable that the IR absorber is attached to the fiber structure (cloth) in a pattern that has an application region and a non-application region, where the application region continuously surrounds the non-application region. In particular, it is preferable that the whole pattern is a grid pattern. In the case where such a grid pattern is employed, when the IR absorber is heated by IR radiation such as sunlight, heat is rapidly transferred along the grid pattern, and the fiber structure is quickly heated. It is also preferable that the area percentage of the application region in the pattern is 10 to 85% (more preferably 25 to 70%). Incidentally, the area percentage of the application region is represented by the following equation.

Area Percentage of Application Region=Area of Application Region/(Area of Application Region+Area of Non-Application Region)×100 (%)

In the case where the area percentage of the application region is less than 10%, when IR radiation is applied to the fiber structure (cloth), the cloth may not be sufficiently heated. On the contrary, in the case where the area percentage of the application region is more than 85%, the texture of the fiber structure (cloth) may be degraded. In the grid pattern mentioned above, a grid interval of about 2 to 30 mm is appropriate.

The technique for applying the IR absorber and binder resin to the fiber structure may as follows. First, the two are formed into the blend composition mentioned above, and then the blend composition is applied by a known application technique such as gravure coating or screen printing.

Before and/or after the application of the IR absorber, it is possible to additionally apply conventional dyeing, alkali weight-reduction, water-repellent processing, napping, UV shielding, or other various processes for imparting the functions of an antibacterial agent, a deodorant, an insect repellant, a phosphorescent agent, a retroreflective agent, a minus ion generator, etc.

<Water-Absorbing Fiber Structure>

It is also possible to subject to the fiber structure of the invention to water-absorbing processing, giving a water-absorbing fiber structure. Specifically, the fiber structure is preferably such that the rate of water absorption of a water-absorbing fiber structure as measured by the method of JIS L-1018:1998 A (falling-drop method) is 5 seconds or less. The fiber structure is preferably a multifilament (filaments) having a single-yarn fineness of 0.01 to 20 dtex (more preferably 0.1 to 7 dtex) and a total fineness of 30 to 500 dtex, in which the number of filaments is within a range of 20 to 200. Such a yarn may also be subjected to twisting, air texturing, false-twist crimping, or the like. The single-fiber transverse cross-sectional shape of the fibers is not particularly limited, and may be an ordinary round cross-section, a round hollow cross-section, a triangular cross-section, a square cross-section, a flat cross-section, or the flat cross-section with constrictions schematically shown in FIG. 1. When it is a modified-shaped cross-section having a greater surface area than a round cross-section, this leads to better water-absorbing properties and thus is preferable.

When the fibers have a void and/or a crack in the single-fiber surface, this improves water-absorbing properties and thus is preferable.

The configuration of the fiber structure mentioned above is not particularly limited, but is preferably a woven fabric or knitted fabric obtained by knitting or weaving with an ordinary weaving machine or knitting machine. Needless to say, it may also be a nonwoven fabric or a fiber structure made of matrix fibers and heat-adhesive fibers. For example, examples of the weave structure of the woven fabric include three basic weaves including plain, twill, and satin, modifications thereof, single-backed double weaves such as warp-backed weave and weft-backed weave, and warp velvet. The knitted fabric may be a circular knitted fabric (weft-knitted fabric) or a warp-knitted fabric. Preferred examples of the structure of the circular knitted fabric (weft-knitted fabric) include plain stitch, rib stitch, interlock stitch, purl stitch, tuck stitch, float stitch, half cardigan stitch, lace stitch, and pile stitch. Examples of the warp knitting structure include single denbigh stitch, single atlas stitch, double cord stitch, half tricot stitch, fleece stitch, and jacquard stitch. The structure may be single-layered or may also be multilayered including two or more layers. Further, a raised cloth made of a raised part having cut piles and/or loop piles and a ground weave part is also possible.

Such a fiber structure is subjected to water-absorbing processing. In that case, the conditions for water-absorbing processing may be such that a hydrophilizing agent, such as PEG diacrylate, a derivative thereof, or a polyethylene terephthalate-polyethylene glycol copolymer, is applied to the fiber structure by a padding method or in the same bath as dyeing, followed by drying at a temperature of 60 to 150° C. for 0.2 to 5 minutes. In that case, it is preferable that the amount of the hydrophilizing agent attached is 0.1 to 10 wt % relative to the weight of the fiber structure before the water-absorbing processing.

In addition, before and/or after the water-absorbing processing, it is possible to additionally apply conventional dyeing, alkali weight-reduction, water-repellent processing, napping, UV shielding, or other various processes for imparting the functions of an antibacterial agent, a deodorant, an insect repellant, a phosphorescent agent, a retroreflective agent, a minus-ion generator, etc.

Figure 2:
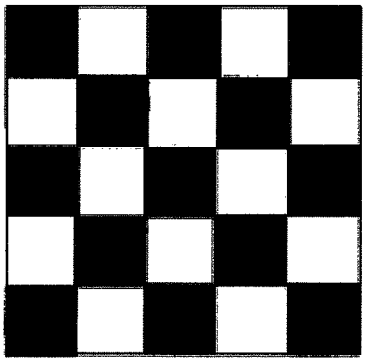
FIG. 2 schematically shows an example of the attachment pattern of a heat-retaining-property-imparting agent, a water-repellent agent, or the like usable in the invention (pattern in which squares are connected at their corners). The black part is the region where the agent is attached.
Figure 3:
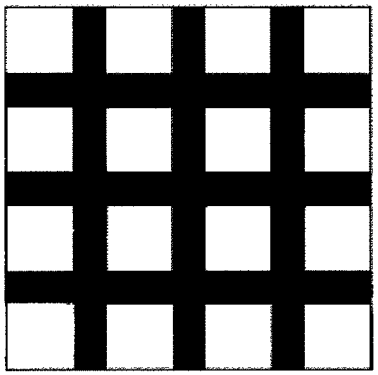
FIG. 3 schematically shows an example of the attachment pattern of a heat-retaining-property-imparting agent, a water-repellent agent, or the like usable in the invention (grid pattern). The black part is the region where the agent is attached.

In particular, it is preferable that as described in JP-A-2007-162150, following the water-absorbing processing, only one side of the fiber structure is subjected to water-repellent processing to attach a water-repellent agent to only one side of the polylactic acid fiber structure. It is particularly preferable that, as schematically shown in FIG. 2, the water-repellent agent is attached partially to one side of the fiber structure in a pattern that has a portion where polygons are connected at their corners. When the water-repellent agent attachment pattern is continuous in the warp and weft directions, the non-attachment region is present in the form of islands. Accordingly, moisture absorbed by the non-attachment region does not spread but smoothly transfers to the other side. In addition, there is no risk of impairing the soft texture. Meanwhile, as schematically shown in FIG. 3, when the water-repellent agent is attached in the grid pattern made of horizontal and vertical lines, although moisture absorbed by the non-attachment region does not spread but smoothly transfers to the other side, the soft texture may be imparted.

In that case, as the polygon mentioned above, a quadrilateral or triangle is preferable. With respect to the size of the polygon, it is preferable that the length of one side of the polygon is within a range of 0.5 to 2.0 mm (more preferably 0.7 to 1.5 mm). When the length is less than 0.5 mm or conversely more than 2.0 mm, sufficient water-absorbing properties may not be obtained. With respect to the size of the grid pattern, it is preferable that the width of the attachment region is within a range of 0.5 to 3.0 mm and the width of the non-attachment region is within a range of 1.0 to 5.0 mm.

In the water-repellent agent attachment pattern, the area percentage of the water-repellent agent attachment region is preferably within a range of 30 to 85% (more preferably 40 to 70%). When the area percentage of the attachment region is less than 30%, at the time of water absorption, water may spread in the plane direction, whereby wetness cannot be sufficiently reduced. On the contrary, when the area percentage of the attachment region is more than 85%, not only that water-absorbing properties may be degraded, but also that the soft texture may be impaired. The area percentage of the attachment region is represented by the following equation.

$$\text{Area Percentage of Attachment Region} = \text{Area of Attachment Region}/(\text{Area of Attachment Region} + \text{Area of Non-Attachment Region}) \times 100\ (\%)$$

The thus-obtained water-absorbing fiber structure has excellent water-absorbing properties. Here, in the case where a polylactic acid fiber is selected as the fiber, because polylactic acid has a lower glass transition temperature than ordinary polyethylene terephthalate, such fibers are excellent in terms of the exhaustion of a hydrophilizing agent, and have higher water-absorbing properties than polyethylene terephthalate fibers.

<Stabilizer>

The fiber and fiber structure of the invention may contain a stabilizer. As the stabilizer, known agents used as stabilizers for thermoplastic resins are usable. Examples thereof include antioxidants and optical stabilizers. By incorporating such agents, a fiber and a fiber structure which have excellent mechanical properties, moldability, heat resistance, and durability can be obtained.

Examples of antioxidants include hindered phenol compounds, hindered amine compounds, phosphite compounds, and thioether compounds.

Examples of hindered phenol compounds include n-octadecyl-3-(3',5'-di-tert-butyl-4'-hydroxyphenyl)-propionate, n-octadecyl-3-(3'-methyl-5'-tert-butyl-4'-hydroxyphenyl)-propionate, n-tetradecyl-3-(3',5'-di-tert-butyl-4'-hydroxyphenyl)-propionate, 1,6-hexanediol-bis[3-(3,5-di-tert-butyl-4-hydroxyphenyl)-propionate], 1,4-butanediol-bis[3-(3,5-di-tert-butyl-4-hydroxyphenyl)-propionate], 2,2'-methylene-bis(4-methyl-tert-butylphenol), triethylene glycol-bis[3-(3-tert-butyl-5-methyl-4-hydroxyphenyl)-propionate], tetrakis[methylene-3-(3',5'-di-tert-butyl-4-hydroxyphenyl)propionate]methane, and 3,9-bis[2-{3-(3-tert-butyl-4-hydroxy-5-methylphenyl)propionyloxy}-1,1-dimethylethyl]2,4,8,10-tetraoxaspiro(5,5)undecane.

Examples of hindered amine compounds include N,N'-bis-3-(3',5'-di-tert-butyl-4'-hydroxyphenyl)propionyl hexamethylenediamine, N,N'-tetramethylene-bis[3-(3'-methyl-5'-tert-butyl-4'-hydroxyphenyl)propionyl]diamine, N,N'-bis[3-(3,5-di-tert-butyl-4-hydroxyphenyl)-propionyl] hydrazine, N-salicyloyl-N'-salicylidenehydrazine, 3-(N-salicyloyl)amino-1,2,4-triazole, and N,N'-bis[2-{3-(3,5-di-tert-butyl-4-hydroxyphenyl)propionyloxy}ethyl]oxyamide. Triethylene glycol-bis[3-{3-tert-butyl-5-methyl-4-hydroxyphenyl}-propionate], tetrakis[methylene-3-(3',5'-di-tert-butyl-4-hydroxyphenyl)propionate]methane and the like are preferable.

As phosphite compounds, those having at least one P—O bond to an aromatic group are preferable, specific examples thereof including tris(2,6-di-tert-butylphenyl)phosphite, tetrakis(2,6-di-tert-butylphenyl)4,4'-biphenylenephosphite, bis(2,6-di-tert-butyl-4-methylphenyl)pentaerythritol-diphosphite, 2,2-methylenebis(4,6-di-tert-butylphenyl)octyl phosphite, 4,4'-butylidene-bis(3-methyl-6-tert-butylphenyl-di-tridecyl)phosphite, 1,1,3-tris(2-methyl-4-ditridecylphosphite-5-tert-butylphenyl)butane, tris(mixed mono- and di-nonylphenyl)phosphite, tris(nonylphenyl)phosphite, and 4,4'-isopropylidenebis(phenyl-dialkyl phosphite).

In particular, tris(2,6-di-tert-butylphenyl)phosphite, 2,2-methylenebis(4,6-di-tert-butylphenyl)octylphosphite, bis(2,6-di-tert-butyl-4-methylphenyl)pentaerythritol-diphosphite, tetrakis(2,6-di-tert-butylphenyl)4,4'-biphenylenephosphite, and the like are suitable.

Specific examples of thioether compounds include dilauryl thiodipropionate, ditridecyl thiodipropionate, dimyristyl thiodipropionate, distearyl thiodipropionate, pentaerythritol-tetrakis(3-laurylthiopropionate), pentaerythritol-tetrakis(3-dodecylthiopropionate), pentaerythritol-tetrakis(3-octadecylthiopropionate), pentaerythritol-tetrakis(3-myristylthiopropionate), and pentaerythritol-tetrakis(3-stearylthiopropionate).

Specific examples of optical stabilizers include benzophenone compounds, benzotriazole compounds, aromatic benzoate compounds, oxalic acid anilide compounds, cyanoacrylate compounds, and hindered amine compounds.

Examples of benzophenone compounds include benzophenone, 2,4-dihydroxybenzophenone, 2,2'-dihydroxybenzophenone, 2,2',4,4'-tetrahydroxybenzophenone, 2-hydroxy-4-methoxybenzophenone, 2,2'-dihydroxy-4,4'-dimethoxybenzophenone, 2,2'-dihydroxy-4,4'-dimethoxy-5-sulfobenzophenone, 2-hydroxy-4-octoxybenzophenone, 2-hydroxy-4-dodecyloxybenzophenone, 2-hydroxy-4-octoxybenzophenone, 2-hydroxy-4-methoxy-5-sulfobenzophenone, 5-chloro-2-hydroxybenzophenone, 2-hydroxy-4-octoxybenzophenone, 2-hydroxy-4-methoxy-2'-carboxybenzophenone, and 2-hydroxy-4-(2-hydroxy-3-methyl-acryloxyisopropoxy)benzophenone.

Examples of benzotriazole compounds include 2-(5-methyl-2-hydroxyphenyl)benzotriazole, 2-(3,5-di-tert-butyl-2-hydroxyphenyl)benzotriazole, 2-(3,5-di-tert-amyl-2-hydroxyphenyl)benzotriazole, 2-(3',5'-di-tert-butyl-4'-methyl-2'-hydroxyphenyl)benzotriazole, 2-(3,5-di-tert-amyl-2-hydroxyphenyl)-5-chlorobenzotriazole, 2-(5-tert-butyl-2-hydroxyphenyl)benzotriazole, 2-[2'-hydroxy-3',5'-bis(α,α-dimethylbenzyl)phenyl]benzotriazole, 2-[2'-hydroxy-3',5'-bis(α,α-dimethylbenzyl)phenyl]-2H-benzotriazole, and 2-(4'-octoxy-2'-hydroxyphenyl)benzotriazole.

Examples of aromatic benzoate compounds include alkylphenyl salicylates such as p-tert-butylphenyl salicylate and p-octylphenyl salicylate.

Examples of oxalic acid anilide compounds include 2-ethoxy-2'-ethyloxalic acid bisanilide, 2-ethoxy-5-tert-butyl-2'-ethyloxalic acid bisanilide, and 2-ethoxy-3'-dodecyloxalic acid bisanilide.

Examples of cyanoacrylate compounds include ethyl-2-cyano-3,3'-diphenyl acrylate and 2-ethylhexyl-cyano-3,3'-diphenyl acrylate.

Examples of hindered amine compounds include 4-acetoxy-2,2,6,6-tetramethylpiperidine, 4-stearoyloxy-2,2,6,6-tetramethylpiperidine, 4-acryloyloxy-2,2,6,6-tetramethylpiperidine, 4-(phenylacetoxy)-2,2,6,6-tetramethylpiperidine, 4-benzoyloxy-2,2,6,6-tetramethylpiperidine, 4-methoxy-2,2,6,6-tetramethylpiperidine, 4-octadecyloxy-2,2,6,6-tetramethylpiperidine, 4-cyclohexyloxy-2,2,6,6-tetramethylpiperidine, 4-benzyloxy-2,2,6,6-tetramethylpiperidine, 4-phenoxy-2,2,6,6-tetramethylpiperidine, 4-(ethylcarbamoyloxy)-2,2,6,6-tetramethylpiperidine, 4-(cyclohexylcarbamoyloxy)-2,2,6,6-tetramethylpiperidine, 4-(phenylcarbamoyloxy)-2,2,6,6-tetramethylpiperidine, bis(2,2,6,6-tetramethyl-4-piperidyl)carbonate, bis(2,2,6,6-tetramethyl-4-piperidyl)oxalate, bis(2,2,6,6-tetramethyl-4-piperidyl)malonate, bis(2,2,6,6-tetramethyl-4-piperidyl)sebacate, bis(2,2,6,6-tetramethyl-4-piperidyl)adipate, bis(2,2,6,6-tetramethyl-4-piperidyl)terephthalate, 1,2-bis(2,2,6,6-tetramethyl-4-piperidyloxy)-ethane, α,α'-bis(2,2,6,6-tetramethyl-4-piperidyloxy)-p-xylene, bis(2,2,6,6-tetramethyl-4-piperidyl)-tolylene-2,4-dicarbamate, bis(2,2,6,6-tetramethyl-4-piperidyl)-hexamethylene-1,6-dicarbamate, tris(2,2,6,6-tetramethyl-4-piperidyl)-benzene-1,3,5-tricarboxylate, tris(2,2,6,6-tetramethyl-4-piperidyl)-benzene-1,3,4-tricarboxylate, 1-[2-{3-(3,5-di-tert-butyl-4-hydroxyphenyl)propionyloxy}-2,2,6,6-tetramethylpiperidine, and condensates of 1,2,3,4-butanetetracarboxylic acid, 1,2,2,6,6-pentamethyl-4-piperidinol, and β,β,β',β'-tetramethyl-3,9-[2,4,8,10-tetraoxaspiro(5,5)undecane]dimethanol. In the invention, the above stabilizer components may be used alone, and it is also possible to use two or more kinds in combination. As the stabilizer component, a hindered phenol compound and/or a benzotriazole compound is preferable. The stabilizer content is preferably 0.01 to 3 parts by weight, more preferably 0.03 to 2 parts by weight, based on 100 parts by weight of the fiber structure of the invention.

<Anti-Wear Agent>

In the invention, in order to improve the wear resistance of the fiber and fiber structure, a fatty acid bisamide and/or an alkyl-substituted monoamide may be contained. An aliphatic bisamide refers to a compound having two amide bonds in one molecule, such as a saturated fatty acid bisamide, an unsaturated fatty acid bisamide, or an aromatic fatty acid bisamide. Examples thereof include methylenebis caprylic acid amide, methylenebis capric acid amide, methylenebis lauric acid amide, methylenebis myristic acid amide, methylenebis palmitic acid amide, methylenebis stearic acid amide, methylenebis isostearic acid amide, methylenebis behenic acid amide, methylenebis oleic acid amide, methylenebis erucic acid amide, ethylenebis caprylic acid amide, ethylenebis capric acid amide, ethylenebis lauric acid amide, ethylenebis myristic acid amide, ethylenebis palmitic acid amide, ethylenebis stearic acid amide, ethylenebis isostearic acid amide, ethylenebis behenic acid amide, ethylenebis oleic acid amide, ethylenebis erucic acid amide, butylenebis stearic acid amide, butylenebis behenic acid amide, butylenebis oleic acid amide, butylenebis erucic acid amide, hexamethylenebis stearic acid amide, hexamethylenebis behenic acid amide, hexamethylenebis oleic acid amide, hexamethylenebis erucic acid amide, m-xylylenebis stearic acid amide, m-xylylenebis-12-hydroxystearic acid amide, p-xylylenebis stearic acid amide, p-phenylenebis stearic acid amide, N,N'-distearyl adipic acid amide, N,N'-distearyl sebacic acid amide, N,N'-dioleoyl adipic acid amide, N,N'-distearyl terephthalic acid amide, methylenebis hydroxystearic acid amide, ethylenebis hydroxystearic acid amide, butylenebis hydroxystearic acid amide, and hexamethylenebis hydroxystearic acid amide.

An alkyl-substituted monoamide herein refers to a compound in which an amide hydrogen of a monoamide, such as a saturated fatty acid monoamide or an unsaturated fatty acid monoamide, is substituted with an alkyl group. Examples thereof include N-lauryl lauric acid amide, N-palmityl palmitic acid amide, N-stearyl stearic acid amide, N-behenyl behenic acid amide, N-oleyl oleic acid amide, N-stearyl oleic acid amide, N-oleyl stearic acid amide, N-stearyl erucic acid amide, and N-oleyl palmitic acid amide. The alkyl group may have a substituent, such as a hydroxyl group, introduced into its structure. Thus, alkyl-substituted fatty acid amides of the invention also include, for example, methylol stearic acid amide, N-stearyl-12-hydroxystearic acid amide, N-oleyl-12-hydroxystearic acid amide, and the like.

These compounds have lower amide reactivity than ordinary fatty acid monoamides, and are less likely to react with polylactic acid at the time of melt molding. In addition, many of them have a high molecular weight, and thus are characterized in that they generally have excellent heat resistance and are unlikely to sublimate. In particular, fatty acid bisamides have even lower amide reactivity and are less likely to react with polylactic acid. Fatty acid bisamides also have a high molecular weight, and they thus have excellent heat resistance and are unlikely to sublimate. Accordingly, they can be used as more preferred anti-wear agents. Preferred examples of such anti-wear agents include ethylenebis stearic acid amide, ethylenebis isostearic acid amide, ethylenebis behenic acid amide, butylenebis stearic acid amide, butylenebis behenic acid amide, hexamethylenebis behenic acid amide, and m-xylylenebis stearic acid amide.

In the invention, the content of fatty acid bisamide and/or alkyl-substituted monoamide (hereinafter collectively abbreviated as fatty acid amide) is preferably 0.1 to 1.5 wt %, more preferably 0.5 to 1.0 wt %, based on the entire fiber. When the fatty acid amide content is 0.1 wt % or less, the resulting effect is insufficient to achieve the purpose. A content of 1.5 wt % or more improves the slidability of the fiber, but its effect is too much, which causes quality loss in making staple fibers, for example, including poor operability due to poor entangling properties, reduced crimping uniformity, etc. The fatty acid amide may be a single component or may also be a mixture of a plurality of components.

<Crystallization Promoter>

The composition in the invention may contain an organic or inorganic crystallization promoter. When a crystallization promoter is contained, a fiber and a fiber structure which have excellent mechanical properties and heat resistance can be obtained.

That is, the application of a crystallization promoter makes it possible to obtain a fiber and a fiber structure, in which crystallization has occurred well and which have excellent heat resistance and stability to moisture and heat. As the crystallization promoter for use in the invention, those generally used as crystal-nucleating agents for crystalline resins are usable. Both inorganic crystal-nucleating agents and organic crystal-nucleating agents may be used.

Examples of inorganic crystal-nucleating agents include talc, kaolin, silica, synthetic mica, clay, zeolite, graphite, carbon black, zinc oxide, magnesium oxide, titanium oxide, calcium carbonate, calcium sulfate, barium sulfate, calcium sulfide, boron nitride, montmorillonite, neodymium oxide, aluminum oxide, and phenylphosphonate metal salts. In order to improve their dispersibility in the composition together with their effects, these inorganic crystal-nucleating agents are preferably treated with various dispersion aids and thus in a highly dispersed state such that the primary particle size thereof is about 0.01 to 0.5 μm.

Examples of organic crystal-nucleating agents include organic carboxylic acid metal salts such as calcium benzoate, sodium benzoate, lithium benzoate, potassium benzoate, magnesium benzoate, barium benzoate, calcium oxalate, disodium terephthalate, dilithium terephthalate, dipotassium terephthalate, sodium laurate, potassium laurate, sodium myristate, potassium myristate, calcium myristate, barium myristate, sodium octanoate, calcium octanoate, sodium stearate, potassium stearate, lithium stearate, calcium stearate, magnesium stearate, barium stearate, sodium montanate, calcium montanate, sodium toluoylate, sodium salicylate, potassium salicylate, zinc salicylate, aluminum dibenzoate, sodium β-naphthoate, potassium β-naphthoate, and sodium cyclohexanecarboxylate, and organic sulfonic acid metal salts such as sodium p-toluenesulfonate and sodium sulfoisophthalate.

Organic crystal-nucleating agents also include organic carboxylic acid amides such as stearic acid amide, ethylenebis lauric acid amide, palmitic acid amide, hydroxystearic acid amide, erucic acid amide, and trimesic acid tris(tert-butylamide), low-density polyethylene, high-density polyethylene, polyisopropylene, polybutene, poly-4-methylpentene, poly-3-methylbutene-1, polyvinyl cycloalkanes, polyvinyl trialkylsilanes, high-melting-point polylactic acid, sodium salts of ethylene-acrylic acid copolymers, sodium salts of styrene-maleic anhydride copolymers (so-called ionomers), and benzylidene sorbitols and derivatives thereof, such as dibenzylidene sorbitol.

Of these, talc and at least one member selected from organic carboxylic acid metal salts are preferable. In the invention, the crystal-nucleating agents may be used alone, and it is also possible to use two or more kinds together.

The crystallization promoter content is preferably 0.01 to 30 parts by weight, more preferably 0.05 to 20 parts by weight, based on 100 parts by weight of the composition of the invention.

<Antistatic Agent>

The fiber and fiber structure of the invention may contain an antistatic agent. Examples of antistatic agents include quaternary ammonium salt compounds, sulfonic acid compounds, and alkyl phosphate compounds, such as (β-lauramidepropionyl)trimethylammonium sulfate and sodium dodecylbenzenesulfonate. In the invention, such antistatic agents may be used alone, and it is also possible to use two or more kinds in combination. The antistatic agent content is preferably 0.05 to 5 parts by weight, more preferably 0.1 to 5 parts by weight, based on 100 parts by weight of the fiber structure of the invention.

<Plasticizer>

The fiber and fiber structure of the invention may contain a plasticizer. As the plasticizer, a commonly known plasticizer may be used. Examples thereof include polyester plasticizers, glycerin plasticizers, polycarboxylic acid ester plasticizers, phosphoric acid ester plasticizers, polyalkylene glycol plasticizers, and epoxy plasticizers.

Examples of polyester plasticizers include polyesters containing adipic acid, sebacic acid, terephthalic acid, isophthalic acid, naphthalenedicarboxylic acid, diphenyldicarboxylic acid, or the like as an acid component and ethylene glycol, propylene glycol, 1,3-butanediol, 1,4-butanediol, 1,6-hexanediol, diethylene glycol, or the like as a diol component, as well as polyesters of hydroxycarboxylic acids, such as polycaprolactone. These polyesters may be end-capped with a monofunctional carboxylic acid or a monofunctional alcohol.

Examples of glycerin plasticizers include glycerin monostearate, glycerin distearate, glycerin monoacetomonolaurate, glycerin monoacetomonostearate, glycerin diacetomonooleate, and glycerin monoacetomonomontanate.

Examples of polycarboxylic acid plasticizers include phthalic acid esters such as dimethyl phthalate, diethyl phthalate, dibutyl phthalate, diheptyl phthalate, dibenzyl phthalate, and butyl benzyl phthalate; trimellitic acid esters such as tributyl trimellitate, trioctyl trimellitate, and trihexyl trimellitate; adipic acid esters such as isodecyl adipate and n-decyl-n-octyl adipate; citric acid esters such as tributyl acetylcitrate; azelaic acid esters such as bis(2-ethylhexyl) azelate; and sebacic acid esters such as dibutyl sebacate and bis(2-ethylhexyl)sebacate.

Examples of phosphoric acid ester plasticizers include tributyl phosphate, tris(2-ethylhexyl)phosphate, trioctyl phosphate, triphenyl phosphate, tricresyl phosphate, and diphenyl-2-ethylhexyl phosphate.

Examples of polyalkylene glycol plasticizers include polyalkylene glycols such as polyethylene glycol, polypropylene glycol, polytetramethylene glycol, poly(ethylene oxide-propylene oxide) block or random copolymers, ethylene oxide addition polymers of bisphenols, and tetrahydrofuran addition polymers of bisphenols, as well as end-capping agent compounds such as terminal-epoxy-modified compounds, terminal-ester-modified compounds, and terminal-ether-modified compounds thereof.

Examples of epoxy plasticizers include epoxy triglycerides containing an alkyl epoxystearate and soybean oil and also epoxy resins obtained from bisphenol A and epichlorohydrin as raw materials.

Other specific examples of plasticizers include benzoic acid esters of aliphatic polyols, such as neopentyl glycol dibenzoate, diethylene glycol dibenzoate, and triethylene glycol-bis(2-ethylbutyrate); fatty acid amides such as stearic acid amide; fatty acid esters such as butyl oleate; oxyacid esters such as methyl acetyl ricinoleate and butyl acetyl ricinoleate; pentaerythritol; various sorbitols; polyacrylic acid esters; silicone oil; and paraffins.

As the plasticizer, one containing at least one member selected from polyester plasticizers and polyalkylene plasticizers is particularly suitable. They may be used alone, and it is also possible to use two or more kinds together.

The plasticizer content is preferably 0.01 to 30 parts by weight, more preferably 0.05 to 20 parts by weight, still more preferably 0.1 to 10 parts by weight, based on 100 parts by weight of the composition of the invention. In the invention, a crystal-nucleating agent and a plasticizer may be used independently, but are still more preferably used in combination.

<Method for Producing Cyclic Carbodiimide Compound>

The cyclic carbodiimide compound can be produced by combining known methods. Examples of methods include production from an amine compound via an isocyanate compound, production from an amine compound via an isothiocyanate compound, production from an amine compound via a triphenylphosphine compound, production from an amine compound via a urea compound, production from an amine compound via a thiourea compound, production from a carboxylic acid compound via an isocyanate compound, and production by deriving a lactam compound.

The cyclic carbodiimide compound of the invention may be produced by combining and modifying the methods described in the following documents. A method appropriate for the compound to be produced can be employed.

Tetrahedron Letters, Vol. 34, No. 32, 515-5158, 1993.

Medium- and Large-Membered Rings from Bis(iminophosphoranes): An Efficient Preparation of Cyclic Carbodiimides, Pedro Molina et al.

Journal of Organic Chemistry, Vol. 61, No. 13, 4289-4299, 1996.

New Models for the Study of the Racemization Mechanism of Carbodiimides.

Synthesis and Structure (X-ray Crystallography and $^1$H NMR) of Cyclic Carbodiimides, Pedro Molina et al.

Journal of Organic Chemistry, Vol. 43, No. 8, 1944-1946, 1978.

Macrocyclic Ureas as Masked Isocyanates, Henri Ulrich et al.

Journal of Organic Chemistry, Vol. 48, No. 10, 1694-1700, 1983.

Synthesis and Reactions of Cyclic Carbodiimides, R. Richter et al.

Journal of Organic Chemistry, Vol. 59, No. 24, 7306-7315, 1994.

A New and Efficient Preparation of Cyclic Carbodiimides from Bis(iminophosphoranea) and the System $Boc_2O$/DMAP, Pedro Molina et al.

A method appropriate for the compound to be produced may be employed. For example, as a cyclic carbodiimide compound for use in the invention of the present application, one produced through the following steps is suitable:

(1) a step in which a nitrophenol represented by the following formula (a-1), a nitrophenol represented by the following formula (a-2), and a compound represented by the following formula (b) are allowed to react to give a nitro compound represented by the following formula (c):

$$HO—Ar^1—NO_2 \quad \text{(a-1)}$$

$$HO—Ar^2—NO_2 \quad \text{(a-2)}$$

$$E^1—X-E^2 \quad \text{(b)}$$

(c)

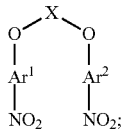

(2) a step in which the obtained nitro compound is reduced to give an amine compound represented by the following formula (d):

(d)

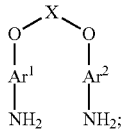

(3) a step in which the obtained amine compound is allowed to react with triphenylphosphine dibromide to give a triphenylphosphine compound represented by the following formula (e):

(e)

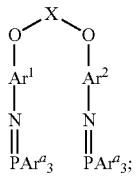

and (4) the conversion of the obtained triphenylphosphine compound into an isocyanate in the reaction system, followed by direct decarboxylation.

In the above formulae, $Ar^1$ and $Ar^2$ are each independently an aromatic group optionally substituted with a $C_{1-6}$ alkyl group, a phenyl group, or the like. $E^1$ and $E^2$ are each independently a group selected from the group consisting of a halogen atom, a toluenesulfonyloxy group, a methanesulfonyloxy group, a benzenesulfonyloxy group, and a p-bromobenzenesulfonyloxy group.

$Ar_a$ is a phenyl group. X is a linking group of the following formulae (i-1) to (i-3);

$$-(CH_2)_n- \quad \text{(i-1)}$$

wherein n is an integer of 1 to 6;

(i-2)

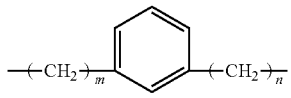

wherein m and n are each independently an integer of 0 to 3;

(i-3)

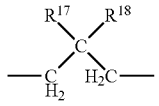

wherein $R^{17}$ and $R^{18}$ each independently represent a $C_{1-6}$ alkyl group or a phenyl group.

Incidentally, although the cyclic carbodiimide compound is capable of effectively capping acidic groups of a polymer compound, if desired, without departing from the gist of the invention, for example, a known carboxyl-group-capping agent for polymers can be used together. Examples of such known carboxyl-group-capping agents include agents described in JP-A-2005-2174, such as an epoxy compound, an oxazoline compound, and an oxazine compound.

EXAMPLES

Hereinafter, the invention will be described in further detail through examples. Incidentally, the property values in the examples were determined by the following methods.

A. Melting Point, Stereocomplex Crystallinity (S):

Measurement was performed using TA-2920 manufactured by TA Instruments at a temperature rise rate of 20° C./min. The peak temperature of the obtained melting peak was defined as melting point.

Also, using TA-2920, a sample was heated in a nitrogen gas stream to 250° C. at 10° C./min in the first cycle, and glass transition temperature (Tg), stereocomplex-phase polylactic acid crystal melting temperature (Tm*), stereocomplex-phase polylactic acid crystal melting enthalpy ($\Delta Hm_s$), and homo-phase polylactic acid crystal melting enthalpy ($\Delta Hm_h$) were measured.

The measurement sample was rapidly cooled, and second-cycle measurement was performed under the same conditions to measure crystallization onset temperature (Tc*) and crystallization temperature (Tc). From the stereocomplex-phase and homo-phase polylactic acid crystal melting enthalpies obtained in the above measurement, stereocomplex crystallinity (S) was determined using the following equation:

$$S=[\Delta Hm_s/(\Delta Hm_h+\Delta Hm_s)]\times 100(\%)$$

wherein $\Delta Hm_s$ is the melting enthalpy of complex-phase crystal, and $\Delta Hm_h$ is the melting enthalpy of homo-phase polylactic acid crystal.

B. Carboxyl End Group Concentration (eq/ton):

Carboxyl Group Concentration: A sample was dissolved in purified o-cresol in a nitrogen stream and titrated with an ethanol solution of 0.05 N potassium hydroxide using bromocresol blue as an indicator.

C. Isocyanate Gas Generation Test:

A sample was heated at 160° C. for 5 minutes, and qualitative/quantitative determination was performed by pyrolysis-GC/MS analysis. Incidentally, quantitative determination was performed using a calibration curve prepared with isocyanate. For GC/MS, GC/MS Jms Q1000GC K9 manufactured by JEOL was used.

D. Stability to Hydrolysis:

An obtained fiber sample was treated in a thermo-hygrostat at 80° C. and 95% RH for 100 hours, and the retention of reduced viscosity was then evaluated.

The stability of a fiber to hydrolysis is rated as "acceptable" when the retention of reduced viscosity is 80 to less than 90%, "excellent" when it is 90% to less than 95%, and "particularly excellent" when it is 95% to 100%.

E. Measurement of Reduced Viscosity ($\eta_{sp/c}$):

A sample weighing 1.2 mg was dissolved in 100 ml of a [tetrachloroethane/phenol=(6/4) wt % mixed solvent], and measurement was performed at 35° C. using an Ubbelohde viscosity tube. The retention of reduced viscosity was determined taking the reduced viscosity of the sample before treatment as 100%.

F. Measurement of Tensile Strength:

Using a tensile strength tester manufactured by A&D, a sample was subjected to a tensile test with a chuck-to-chuck distance of 100 mm and at a tensile rate of 5 cm/min according to the test method of JIS L-1013:2010.

G. L* Value, C* Value

Two dyed cloth samples were stacked, and the values were determined using a spectrocolorimeter SD-5000 manufactured by Nippon Denshoku Industries.

H. Wear:

In the case where the sample was a monofilament, a weight having a load of 100 g was attached at the end of the filament, and, while dropping a 0.5% aqueous suspension of "Escalon #800" manufactured by Sankyo Seifun, which is a calcium carbonate powder for use as a filler in neutralized paper making, onto the surface of a 60-cm-diameter ceramic cylinder rotating at 1500 rpm, the filament was brought into contact with the surface. The time for the fiber to break was measured.

In the case where the sample was a multifilament, a single fiber was randomly extracted from the fibers forming the multifilament, and subjected to the above evaluation. The evaluation index is wear (mm)/hour.

I. Cover Factor (CF)

The warp total fineness (dtex), warp weaving density (yarns/2.54 cm), weft total fineness (dtex), and weft weaving density (yarns/dtex) of a woven fabric were determined, and calculation was performed using the following equation.

$$CF = \sqrt{\frac{DWp}{1.1}} \times MWp + \sqrt{\frac{DWf}{1.1}} \times MWf$$

DWp is the warp total fineness, MWp is the warp weaving density, DWf is the weft total fineness, and MWf is the weft weaving density.

Reference Example 1

Tin octylate was added in an amount of 0.005 wt % based on 100 wt % of L-lactide (manufactured by Musashino Chemical Laboratory, optical purity: 100%), and the mixture was allowed to react in a nitrogen atmosphere in a reactor equipped with a stirring blade at 180° C. for 2 hours. As a catalyst deactivator, phosphoric acid was added thereto in an amount of 1.2 equivalents of tin octylate, then the residual lactide was removed at 13.3 Pa, and the resulting product was formed into chips. Poly(L-lactic acid) was thus obtained.

The obtained poly(L-lactic acid) had a weight-average molecular weight of 152,000, a glass transition temperature (Tg) of 55° C., and a melting point of 175° C. The carboxyl group concentration was 14 eq/ton, and the retention of reduced viscosity in hydrolysis was 9.5%.

Reference Example 2

Polymerization was performed under the same conditions as in Reference Example 1, except that L-lactide was replaced with D-lactide (manufactured by Musashino Chemical Laboratory, optical purity: 100%). Poly(D-lactic acid) was thus obtained. The obtained poly(D-lactic acid) had a weight-average molecular weight of 151,000, a glass transition temperature (Tg) of 55° C., and a melting point of 175° C. The carboxyl group concentration was 15 eq/ton, and the retention of reduced viscosity in hydrolysis was 9.1%. The obtained poly(D-lactic acid) and the poly(L-lactic acid) obtained by the procedure of Reference Example 1 each in an amount of 50 wt % were mixed with a phosphoric acid ester metal salt ("ADK STAB" NA-11 manufactured by ADEKA) in an amount of 0.3 wt % in a blender, and vacuum-dried at 110° C. for 5 hours. After that, the mixture was melt-kneaded while evacuating at a cylinder temperature of 230° C. and a vent pressure of 13.3 Pa, then extruded into strands in a water bath, and formed into chips with a chip cutter. Thus, a composition having a stereocomplex crystallinity (S) of 100% and a crystal melting temperature of 216° C. was obtained.

The carboxyl group concentration of the composition was 11 eq/ton, and the retention of reduced viscosity in hydrolysis was 10%.

Reference Example 3 o-Nitrophenol (0.11 mol), 1,2-dibromoethane (0.05 mol), potassium carbonate (0.33 mol), and 200 ml of N,N-dimethylformamide (DMF) were charged to a reactor equipped with a stirrer and a heater in a $N_2$ atmosphere, and allowed to react at 130° C. for 12 hours. DMF was then removed by reducing the pressure, and the resulting solid matter was dissolved in 200 ml of dichloromethane, followed by separation three times with 100 ml of water. The organic layer was dried over 5 g of sodium sulfate, and dichloromethane was removed by reducing the pressure. An intermediate product A (nitro compound) was thus obtained.

Next, the intermediate product A (0.1 mol), 5% palladium carbon (Pd/C) (1 g), and 200 ml of ethanol/dichloromethane (70/30) were charged to a reactor equipped with a stirrer, and the atmosphere was replaced with hydrogen five times. The mixture was allowed to react at 25° C. under a constant supply of hydrogen. The reaction is terminated when hydrogen stops decreasing. Pd/C was recovered, and the mixed solvent was removed. An intermediate product B (amine compound) was thus obtained.

Next, in a $N_2$ atmosphere, triphenylphosphine dibromide (0.11 mol) and 150 ml of 1,2-dichloroethane are charged to a reactor equipped with a stirrer, a heater, and a dropping funnel, followed by stirring. Then, a solution of the intermediate product B (0.05 mol) and triethylamine (0.25 mol) dissolved in 50 ml of 1,2-dichloroethane is slowly added dropwise thereto at 25° C. After the completion of dropping, the mixture is allowed to react at 70° C. for 5 hours. Subsequently, the reaction solution was filtered, and the filtrate was separated five times with 100 ml of water. The organic layer was dried over 5 g of sodium sulfate, and 1,2-dichloroethane was removed by reducing the pressure. An intermediate product C (triphenylphosphine compound) was thus obtained.

Next, in a $N_2$ atmosphere, di-tert-butyl dicarbonate (0.11 mol), N,N-dimethyl-4-aminopyridine (0.055 mol), and 150 ml of dichloromethane were charged to a reactor equipped with a stirrer and a dropping funnel, followed by stirring. Then, at 25° C., 100 ml of dichloromethane having dissolved therein the intermediate product C (0.05 mol) was slowly added dropwise thereto. After the completion of dropping, the mixture is allowed to react for 12 hours. Subsequently, dichloromethane was removed, and the resulting solid matter was purified to give a cyclic carbodiimide compound (1) (MW=252) represented by the following structural formula. The structure was confirmed by NMR and IR.

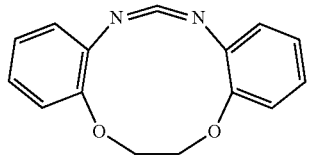

Reference Example 4 o-Nitrophenol (0.11 mol), pentaerythrityl tetrabromide (0.025 mol), potassium carbonate (0.33 mol), and 200 ml of N,N-dimethylformamide were charged to a reactor equipped with a stirrer and a heater in a $N_2$ atmosphere, and allowed to react at 130° C. for 12 hours. DMF was then removed by reducing the pressure, and the resulting solid matter was dissolved in 200 ml of dichloromethane, followed by separation three times with 100 ml of water. The organic layer was dried over 5 g of sodium sulfate, and dichloromethane was removed by reducing the pressure. An intermediate product D (nitro compound) was thus obtained.

Next, the intermediate product D (0.1 mol), 5% palladium carbon (Pd/C) (2 g), and 400 ml of ethanol/dichloromethane (70/30) were charged to a reactor equipped with a stirrer, and the atmosphere was replaced with hydrogen five times. The mixture was allowed to react at 25° C. under a constant supply of hydrogen. The reaction was terminated when hydrogen stopped decreasing. Pd/C was recovered, and the mixed solvent was removed. An intermediate product E (amine compound) was thus obtained.

Next, in a $N_2$ atmosphere, triphenylphosphine dibromide (0.11 mol) and 150 ml of 1,2-dichloroethane were charged to a reactor equipped with a stirrer, a heater, and a dropping funnel, followed by stirring. Then, a solution of the intermediate product E (0.025 mol) and triethylamine (0.25 mol) dissolved in 50 ml of 1,2-dichloroethane was slowly added dropwise thereto at 25° C. After the completion of dropping, the mixture is allowed to react at 70° C. for 5 hours. Subsequently, the reaction solution was filtered, and the filtrate was separated five times with 100 ml of water. The organic layer was dried over 5 g of sodium sulfate, and 1,2-dichloroethane was removed by reducing the pressure. An intermediate product F (triphenylphosphine compound) was thus obtained.

Next, in a $N_2$ atmosphere, di-tert-butyl dicarbonate (0.11 mol), N,N-dimethyl-4-aminopyridine (0.055 mol), and 150 ml of dichloromethane are charged to a reactor equipped with a stirrer and a dropping funnel, followed by stirring. Then, at 25° C., 100 ml of dichloromethane having dissolved therein the intermediate product F (0.025 mol) was slowly added dropwise thereto. After the completion of dropping, the mixture is allowed to react for 12 hours. Subsequently, dichloromethane was removed, and the resulting solid matter was purified to give a cyclic carbodiimide compound (2) (MW=516) represented by the following structural formula. The structure was confirmed by NMR and IR.

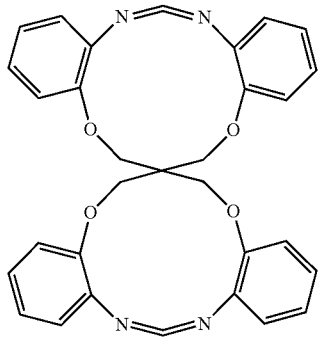

Reference Example 5

The poly(L-lactic acid) obtained by the procedure of Reference Example 1 in an amount of 100 wt % was vacuum-dried at 110° C. for 5 hours, then fed through a first feed port of a twin-screw kneader, and melt-kneaded while evacuating at a cylinder temperature of 210° C. and a vent pressure of 13.3 Pa. After that, the cyclic carbodiimide compound (1) obtained by the procedure of Reference Example 3 in an amount of 1 wt % was fed through a second feed port, melt-kneaded at a cylinder temperature of 210° C., extruded into strands in a water bath, and formed into chips with a chip cutter. During the production of the composition, no isocyanate odor was detected.

Reference Example 6

The same procedure as in Reference Example 5 was performed, except that the cyclic carbodiimide compound (2) obtained by the procedure of Reference Example 4 was used as the cyclic carbodiimide compound. During the production of the composition, no isocyanate odor was detected.

Reference Example 7

A composition was obtained by the same procedure as in Reference Example 2, except that after the obtained poly (D-lactic acid) and the poly(L-lactic acid) obtained by the procedure of Reference Example 1 each in an amount of 50 wt % were mixed with a phosphoric acid ester metal salt ("ADK STAB" NA-11 manufactured by ADEKA) in an amount of 0.3 wt % in a blender, and vacuum-dried at 110° C. for 5 hours, the mixture was, through a first feed port of a kneader, melt-kneaded while evacuating at a cylinder temperature of 230° C. and a vent pressure of 13.3 Pa, and then the cyclic carbodiimide compound (1) obtained by the procedure of Reference Example 3 was fed in an amount of 1 wt % through a second feed port and melt-kneaded at a cylinder temperature of 230° C. During the production of the composition, no isocyanate odor was detected.

Reference Example 8

A composition was obtained by the same procedure as in Reference Example 7, except that the cyclic carbodiimide compound (2) obtained by the procedure of Reference Example 4 was used as the cyclic carbodiimide compound. During the production of the composition, no isocyanate odor was detected.

Example 1

The chips of poly(L-lactic acid) having a melting point of 170° C. and a carboxyl end group concentration of 0 eq/ton obtained in Reference Example 5 were dried for 12 hours in a vacuum dryer set at 110° C. The dried chips were melted in a single-screw extrusion spinning machine at an extrusion temperature of 210° C., and spun through a 36-hole spinneret at a spinneret temperature of 210° C. The spun yarn was taken up at 500 m/min to give an undrawn yarn. In the course of spinning, the pungent odor of isocyanate gas was not detected.

Using a hot-roller-type drawing machine, the undrawn yarn was drawn under conditions of a drawing temperature of 90° C., a heat-setting temperature of 120° C., a draw ratio of 3.8, and a drawing rate of 800 m/min, thereby giving a drawn yarn of 168 dtex/36 filaments. The obtained drawn yarn had a strength of 4.8 cN/dtex and a boiling water shrinkage of 8%. The obtained fibers were subjected to an isocyanate gas generation test. As a result, no isocyanate was detected.

Example 2

The chips of poly(L-lactic acid) having a melting point of 170° C. and a carboxyl end group concentration of 0 eq/ton obtained in Reference Example 6 were dried for 12 hours in a vacuum dryer set at 110° C. The dried chips were melted in a single-screw extrusion spinning machine at an extrusion temperature of 210° C., and spun through a 36-hole spinneret at a spinneret temperature of 210° C. The spun yarn was taken up at 500 m/min to give an undrawn yarn. In the course of spinning, the pungent odor of isocyanate gas was not detected.

Using a hot-roller-type drawing machine, the undrawn yarn was drawn under conditions of a drawing temperature of 90° C., a heat-setting temperature of 120° C., a draw ratio of 3.8, and a drawing rate of 800 m/min, thereby giving a drawn yarn of 168 dtex/36 filaments. The obtained drawn yarn had a strength of 4.8 cN/dtex and a boiling water shrinkage of 8%. The obtained fibers were subjected to an isocyanate gas generation test. As a result, no isocyanate was detected.

Example 3

The chips of stereocomplex polylactic acid having a melting point of 213° C. and a carboxyl end group concentration of 0 eq/ton obtained in Reference Example 7 were dried for 12 hours in a vacuum dryer set at 110° C. The dried chips were melted in a single-screw extrusion spinning machine at an extrusion temperature of 230° C., and spun through a 36-hole spinneret at a spinneret temperature of 230° C. The spun yarn was taken up at 500 m/min to give an undrawn yarn. In the course of spinning, the pungent odor of isocyanate gas was not detected.

Using a hot-roller-type drawing machine, the undrawn yarn was drawn under conditions of a drawing temperature of 90° C., a heat-setting temperature of 180° C., a draw ratio of 3.8, and a drawing rate of 800 m/min, thereby giving a drawn yarn of 168 dtex/36 filaments. The obtained drawn yarn had a strength of 4.2 cN/dtex and a boiling water shrinkage of 8%. The obtained fibers were subjected to an isocyanate gas generation test. As a result, no isocyanate was detected.

Example 4

The chips of stereocomplex polylactic acid having a melting point of 213° C. and a carboxyl end group concentration of 0 eq/ton obtained in Reference Example 8 were dried for 12 hours in a vacuum dryer set at 110° C. The dried chips were melted in a single-screw extrusion spinning machine at an extrusion temperature of 230° C., and spun through a 36-hole spinneret at a spinneret temperature of 230° C. The spun yarn was taken up at 500 m/min to give an undrawn yarn. In the course of spinning, the pungent odor of isocyanate gas was not detected.

Using a hot-roller-type drawing machine, the undrawn yarn was drawn under conditions of a drawing temperature of 90° C., a heat-setting temperature of 180° C., a draw ratio of 3.8, and a drawing rate of 800 m/min, thereby giving a drawn yarn of 168 dtex/36 filaments. The obtained drawn yarn had a strength of 4.3 cN/dtex and a boiling water shrinkage of 8%. The obtained fibers were subjected to an isocyanate gas generation test. As a result, no isocyanate was detected.

Comparative Example 1

Together with the resin produced in Reference Example 1, a commercially available linear polycarbodiimide compound ("CARBODILITE" LA-1 manufactured by Nisshinbo Chemical) in an amount of 1% was kneaded at 210° C. using a twin-screw extruder. From the resulting chips, a drawn yarn of 168 dtex/36 filaments was obtained in the same manner as in Example 1. The drawn yarn had a strength of 4.2 cN/dtex and a boiling water shrinkage of 7%. During spinning, the pungent isocyanate odor was detected near the pack. Further, as a result of an isocyanate gas generation test on the fibers, 30 ppm of isocyanate gas was generated.

Comparative Example 2

Together with the resin produced in Reference Example 2, a commercially available linear polycarbodiimide ("Carbodilite" LA-1 manufactured by Nisshinbo Chemical) in an amount of 1% was kneaded at 210° C. using a twin-screw extruder. From the resulting chips, a drawn yarn of 168 dtex/36 filaments was obtained in the same manner as in Example 1. The drawn yarn had a strength of 4.2 cN/dtex and a boiling water shrinkage of 7%. During spinning, the pungent isocyanate odor was detected near the pack. Further, as a result of an isocyanate gas generation test on the fibers, 46 ppm of isocyanate gas was generated.

Example 5

A plain woven fabric was prepared using the drawn yarn obtained by the procedure of Example 1, scoured at 80° C.×20 minutes, and then subjected to dry heat setting at 150° C.×2 minutes. The woven fabric was dyed in a dye bath adjusted to the following conditions at 100° C.×30 minutes, subsequently soaped in a bath adjusted to the following conditions for 10 minutes while maintaining mild boiling, and then water-cooled at 60° C. or less and removed, followed by the removal of moisture with waste. After that, heat setting was performed with an iron set at 120° C.

The obtained cloth had an L* value of 53.46 and a C* value of 63.85. Thus, a cloth having excellent color-forming properties was obtained.

<Dye Bath>

Dye: "Dianix Red E-Plus" (3% owf) manufactured by DyStar

Dyeing Assistant: Deep-color promoter (for professional use) (16.8% owf) manufactured by Katsuraya Fine Goods Bath Ratio: 1:80

<Soaping Bath>

Soaping Agent: Soaping agent (for professional use) 16.8% owf manufactured by Katsuraya Fine Goods Bath Ratio: 1:500

Example 6

The same procedure as in Example 5 was performed, except that a plain woven fabric was produced using the drawn yarn obtained by the procedure of Example 2, and that the dye was changed from "Dianix Red E-Plus" (3% owf) manufactured by DyStar to "Dianix Blue E-Plus" (3% owf) manufactured by DyStar. As a result, a cloth having excellent color-forming properties with an L* value of 41.34 and a C* value of 45.78 was obtained.

Example 7

The same procedure as in Example 5 was performed, except that a plain woven fabric was produced using the drawn yarn obtained by the procedure of Example 3, and that the dye was changed from "Dianix Red E-Plus" (3% owf) manufactured by DyStar to "Dianix Yellow E-Plus" (3% owf) manufactured by DyStar. As a result, a cloth having excellent color-forming properties with an L* value of 86.67 and a C* value of 61.67 was obtained.

Example 8

The same procedure as in Example 5 was performed, except that a plain woven fabric was produced using the drawn yarn obtained by the procedure of Example 4, and dyed. The obtained fiber structure had an L* value of 53.48 and a C* value of 63.86. Thus, a fiber structure having excellent color-forming properties was obtained.

Comparative Example 3

The same procedure as in Example 5 was performed, except that a plain woven fabric was produced in the same manner using the drawn yarn obtained by the procedure of Comparative Example 1, and dyed. The obtained fiber structure had an L* value of 53.44 and a C* value of 63.80. Thus, a fiber structure having excellent color-forming properties was obtained.

Comparative Example 4

The same procedure as in Example 5 was performed, except that a plain woven fabric was produced in the same manner using the drawn yarn obtained by the procedure of Comparative Example 2, and dyed. The obtained fiber structure had an L* value of 53.45 and a C* value of 63.84. Thus, a fiber structure having excellent color-forming properties was obtained.

Example 9

A plain woven fabric was prepared using the drawn yarn obtained by the procedure of Example 1, scoured at 80° C.×20 minutes, and then subjected to dry heat setting at 150° C.×2 minutes. The woven fabric was dyed in a dye bath adjusted to the following conditions at 100° C.×30 minutes, subsequently soaped in a bath adjusted to the following conditions for 10 minutes while maintaining mild boiling, and then water-cooled at 60° C. or less and removed, followed by the removal of moisture with waste. After that, heat setting was performed with an iron set at 120° C.

The obtained cloth had an L* value of 25.60 and a C* value of 3.27. Thus, a cloth having excellent deep-color properties was obtained.

<Dye Bath>

Dye: "Dianix BL HLA953" (3% owf) manufactured by DyStar

Dyeing Assistant: Deep-color promoter (for professional use) (16.8% owf) manufactured by Katsuraya Fine Goods Bath Ratio: 1:80

<Soaping Bath>

Soaping Agent: Soaping agent (for professional use) 16.8% owf manufactured by Katsuraya Fine Goods Bath Ratio: 1:500

Example 10

The same procedure as in Example 9 was performed, except that the drawn yarn obtained by the procedure of Example 2 was used. As a result, as in Example 9, a cloth having excellent deep-color properties was obtained.

Comparative Example 5

The same procedure as in Example 9 was performed, except that the drawn yarn obtained by the procedure of Comparative Example 1 was used. As a result, the obtained fiber structure had an L* value of 25.60 and a C* value of 3.28. Thus, a fiber structure having excellent deep-color properties was obtained.

Example 11

PET chips (polyethylene terephthalate "TR-8580" manufactured by Teijin Fibers Limited, reduced viscosity: 0.35 dl/g) in an amount of 88 wt % and polyester thermoplastic elastomer chips ("HYTREL" 4057 manufactured by DuPont-Toray), a thermoplastic elastomer, in an amount of 11 wt % were mixed in a V-shaped blender in a nitrogen atmosphere to give blend chips.

Next, the blend chips were fed through a first feed port of an extruder-type melt-spinning machine equipped with a nozzle having a diameter of 1.5 mm, and melt-kneaded while evacuating at a cylinder temperature of 270° C. and a vent pressure of 13.3 Pa. After that, the cyclic carbodiimide compound (2) obtained by the procedure of Reference Example 4 was fed in an amount of 1 wt % from a second feed port, and melt-kneaded at a cylinder temperature of 270° C., followed by spinning. The yarn was once cooled, then drawn to 5.7 times its original length at 120° C., and subjected to relaxation heat setting to 0.9 times its original length to give a polyester fiber (monofilament) having a diameter of 0.22 mm and a strength of 3.6 cN/dtex.

The wear resistance of the monofilament was evaluated. As a result, it took 90 minutes to break (wear resistance=0.15 mm/h). At the time of melt-kneading and spinning, no isocyanate odor was detected. Also, upon melting at 300° C. for 5 minutes, the result of isocyanate odor evaluation was acceptable. Further, the retention of reduced viscosity of a sample treated in a pressure cooker at 120° C. and 100% RH for 50 hours was evaluated. The rating is "acceptable" when the retention of reduced viscosity is 80 to less than 90%, "excellent" when it is 90% to less than 95%, and "particularly excellent" when it is 95% to 100%. In this example, it was excellent.

Example 12

A polyester fiber (monofilament) was obtained by the same procedure as in Example 11, except that the cyclic carbodiimide compound (1) obtained by the procedure of Reference Example 3 was used in place of the cyclic carbodiimide compound (2).

Evaluation of the wear resistance of the monofilament showed a wear resistance of 0.15 mm/h. At the time of melt-kneading and spinning, no isocyanate odor was detected. Also, upon melting at 300° C. for 5 minutes, the result of isocyanate odor evaluation was acceptable. Further, with respect to a sample treated in a pressure cooker at 120° C. and 100% RH for 50 hours, the retention of reduced viscosity was rated as excellent.

Example 13

A polyester fiber (monofilament) was obtained by the same procedure as in Example 11, except that a polyolefin elastomer ("THERMORUN" 3550 manufactured by Mitsubishi Chemical) was used as the thermoplastic elastomer.

Evaluation of the wear resistance of the monofilament showed a wear resistance of 0.07 mm/h. At the time of melt-kneading and spinning, no isocyanate odor was detected. Also, upon melting at 300° C. for 5 minutes, the result of isocyanate odor evaluation was acceptable. Further, with respect to a sample treated in a pressure cooker at 120°

C. and 100% RH for 50 hours, the retention of reduced viscosity was rated as excellent.

Example 14

A polyester fiber (monofilament) was obtained by the same procedure as in Example 11, except that a styrene thermoplastic elastomer ("RABALON" MJ5301C manufactured by Mitsubishi Chemical) was used as the thermoplastic elastomer.

Evaluation of the wear resistance of the monofilament showed a wear resistance of 0.09 mm/h. At the time of melt-kneading and spinning, no isocyanate odor was detected. Also, upon melting at 300° C. for 5 minutes, the result of isocyanate odor evaluation was acceptable. Further, with respect to a sample treated in a pressure cooker at 120° C. and 100% RH for 50 hours, the retention of reduced viscosity was rated as excellent.

Comparative Example 6

A polyester fiber (monofilament) was obtained by the same procedure as in Example 11, except that neither a thermoplastic elastomer nor a cyclic carbodiimide compound was used.

Evaluation of the wear resistance of the monofilament showed a wear resistance of 1.32 mm/h. At the time of melt-kneading and spinning, no isocyanate odor was detected. Also, upon melting at 300° C. for 5 minutes, the result of isocyanate odor evaluation was acceptable. Further, with respect to a sample treated in a pressure cooker at 120° C. and 100% RH for 50 hours, the retention of reduced viscosity was rated as unacceptable.

Example 15

A polyester fiber (monofilament) was obtained by the same procedure as in Example 11, except that no thermoplastic elastomer was added (polyester: 99 wt %, cyclic carbodiimide compound: 1 wt %).

Evaluation of the wear resistance of the monofilament showed a wear resistance of 0.88 mm/h. At the time of melt-kneading and spinning, no isocyanate odor was detected. Also, upon melting at 300° C. for 5 minutes, the result of isocyanate odor evaluation was acceptable. Further, with respect to a sample treated in a pressure cooker at 120° C. and 100% RH for 50 hours, the retention of reduced viscosity was rated as excellent.

Comparative Example 7

A polyester fiber (monofilament) was obtained by the same procedure as in Example 11, except that a carbodiimide having a linear structure ("CARBODILITE" LA-1 manufactured by Nisshinbo Chemical) was used as the cyclic carbodiimide compound.

Evaluation of the wear resistance of the monofilament showed a wear resistance of 0.22 mm/h. At the time of melt-kneading and spinning, an isocyanate odor was detected. Also, upon melting at 300° C. for 5 minutes, the result of isocyanate odor evaluation was unacceptable. Further, with respect to a sample treated in a pressure cooker at 120° C. and 100% RH for 50 hours, the retention of reduced viscosity was rated as excellent.

Comparative Example 8

A polyester fiber (monofilament) was obtained by the same procedure as in Example 11, except that no cyclic carbodiimide compound was added (polyester: 89 wt %, thermoplastic elastomer: 11 wt %).

Evaluation of the wear resistance of the monofilament showed a wear resistance of 0.22 mm/h. At the time of melt-kneading and spinning, no isocyanate odor was detected. Also, upon melting at 300° C. for 5 minutes, the result of isocyanate odor evaluation was acceptable. However, the retention of reduced viscosity of a sample treated in a pressure cooker at 120° C. and 100% RH for 50 hours was unacceptable.

Example 16

Polylactic acid chips (manufactured by NatureWorks; 6201D, melting point: 170° C.), ethylene bis stearamide (EBA) (manufactured by NOF Corporation; "ALFLOW" H-50S) which is a fatty acid bisamide, and the cyclic carbodiimide compound (2) were separately dried and then mixed in a weight ratio of 80:10:10. The mixture was melt-kneaded at 220° C. and formed into chips to give aliphatic polyamide masterchips.

The produced masterchips and polylactic acid chips (manufactured by NatureWorks; 6201D, melting point: 170° C.) were mixed in a weight ratio of 10:90 (as a composition, EBA content: 1.0 wt %, cyclic carbodiimide compound content: 1.0 wt %), and melt-spun in an extruder-type spinning machine at a spinning temperature of 230° C. The spun yarn was cooled, and an isotridecyl stearate/octyl palmitate composite oil component, which is a fatty-acid-ester-based component, was applied thereto in an amount of 0.5 wt % relative to the weight of the yarn. The yarn was bundled and then taken up at a take-up rate of 1000 m/min to give an undrawn yarn.

The obtained undrawn yarn was bundled into 80 ktex, drawn to 4.0 times its original length in a hot water bath of 90° C., then mechanically crimped in a stuffer box to give crimps/25 mm, and heat-treated at 145° C.×10 minutes. After that, an alkyl-ester-based oil component was applied thereto in an amount of 0.5 wt % relative to the weight of the yarn. The yarn was cut to a fiber length of 51 mm to give polylactic acid fibers (staple fibers). At the time of melt-kneading and spinning, no isocyanate odor was detected. Also, upon melting at 300° C. for 5 minutes, the result of isocyanate odor evaluation was acceptable. The fineness, strength, and friction coefficient of the obtained staple fibers were determined according to the method of JIS L-1015: 1999. As a result, the staple-fiber fineness was 6.6 dtex, the strength was 2.4 cN/dtex, the carboxyl end group concentration was 0 eq/ton, and the friction coefficient was 0.21.

Example 17

The same procedure as in Example 16 was performed, except that the cyclic carbodiimide compound (1) was used in place of the cyclic carbodiimide compound (2). At the time of melt-kneading and spinning, no isocyanate odor was detected. Also, upon melting at 300° C. for 5 minutes, the result of isocyanate odor evaluation was acceptable. The fineness, strength, and friction coefficient of the obtained staple fibers were determined according to the method of JIS L-1015:1999. As a result, the staple-fiber fineness was 6.6 dtex, the strength was 2.4 cN/dtex, the carboxyl end group concentration was 0 eq/ton, and the friction coefficient was 0.21.

Comparative Example 9

The same procedure as in Example 16 was performed, except that a linear polycarbodiimide compound [manufactured by Nisshinbo Chemical; "CARBODILITE" HMV-8CA] was used in place of the cyclic carbodiimide compound (component C). At the time of melt-kneading and spinning, an isocyanate odor was detected. Also, upon melting at 300° C. for 5 minutes, the result of isocyanate odor evaluation was unacceptable. The fineness, strength, and friction coefficient of the obtained staple fibers were determined according to the method of JIS L-1015:1999. As a result, the staple-fiber fineness was 6.6 dtex, the strength was 2.4 cN/dtex, the carboxyl end group concentration was 5.8 eq/ton, and the friction coefficient was 0.21.

Comparative Example 10

The same procedure as in Example 16 was performed, except that no cyclic carbodiimide compound was used. At the time of melt-kneading and spinning, no isocyanate odor was detected. Also, upon melting at 300° C. for 5 minutes, the result of isocyanate odor evaluation was acceptable. The fineness, strength, and friction coefficient of the obtained staple fibers were determined according to the method of JIS L-1015:1999. As a result, the staple-fiber fineness was 6.6 dtex, the strength was 2.5 cN/dtex, the carboxyl end group concentration was 25.8 eq/ton, and the friction coefficient was 0.25.

Comparative Example 11

Polylactic acid chips (manufactured by NatureWorks; 6201D, melting point: 170° C.) were dried and subsequently melt-spun at a spinning temperature of 230° C. in an extruder-type spinning machine. The spun yarn was cooled, and an isotridecyl stearate/octyl palmitate composite oil component, which is a fatty-acid-ester-based component, was applied thereto in an amount of 0.5 wt % relative to the fiber. The yarn was bundled and then taken up at a take-up rate of 1000 m/min to give an undrawn yarn.

The obtained undrawn yarn was bundled into 80 ktex, drawn to 4.0 times its original length in a hot water bath of 90° C., then mechanically crimped in a stuffer box to give crimps/25 mm, and heat-treated at 145° C.×10 minutes. After that, an alkyl-ester-based oil component was applied thereto in an amount of 0.5 wt % relative to the weight of the yarn. The yarn was cut to a fiber length of 51 mm to give polylactic acid staple fibers. At the time of melt-kneading and spinning, no isocyanate odor was detected. Also, upon melting at 300° C. for 5 minutes, the result of isocyanate odor evaluation was acceptable. The fineness, strength, and friction coefficient of the obtained staple fibers were determined according to the method of JIS L-1015:1999. As a result, the staple-fiber fineness was 6.6 dtex, the strength was 2.6 cN/dtex, the carboxyl end group concentration was 25.2 eq/ton, and the friction coefficient was 0.38.

Reference Example 9

Tin octylate was added in an amount of 0.005 wt % based on 100 wt % of L-lactide (manufactured by Musashino Chemical Laboratory, optical purity: 100%), and the mixture was allowed to react in a nitrogen atmosphere in a reactor equipped with a stirring blade at 180° C. for 2 hours. Phosphoric acid was added thereto in an amount of 1.2 equivalents of tin octylate, then the residual lactide was removed at 13.3 kPa, and the resulting product was formed into chips. Poly(L-lactic acid) was thus obtained. The obtained Poly(L-lactic acid) had a weight-average molecular weight of 150,000, a glass transition temperature (Tg) of 63° C., and a melting point of 180° C.

Meanwhile, tin octylate was added in an amount of 0.005 wt % based on 100 wt % of D-lactide (manufactured by Musashino Chemical Laboratory, optical purity: 100%), and the mixture was allowed to react in a nitrogen atmosphere in a reactor equipped with a stirring blade at 180° C. for 2 hours. Phosphoric acid was added thereto in an amount of 1.2 equivalents of tin octylate, then the residual lactide was removed at 13.3 kPa, and the resulting product was formed into chips. Poly(D-lactic acid) was thus obtained. The obtained poly(D-lactic acid) had a weight-average molecular weight of 150,000, a glass transition temperature (Tg) of 63° C., and a melting point of 180° C.

The poly(L-lactic acid) and the poly(D-lactic acid) obtained by the above procedure each in an amount of 50 wt % together with a phosphoric acid ester metal salt (2,2-methylenebis(4,6-di-tert-butylphenol)phosphate sodium salt, average particle size: 5 μm, "ADK STAB" NA-11 manufactured by ADEKA) in an amount of 0.1 wt % were melt-kneaded at 230° C., then formed into strands in a water bath, and formed into chips with a chip cutter to give stereocomplex polylactic acid chips. The obtained stereocomplex polylactic acid resin had a Mw of 135,000, a melting point (Tm) of 217° C., and a stereocomplex crystallinity of 100%.

Example 18

The poly(L-lactic acid) chips obtained by the procedure of Reference Example 9 and the cyclic carbodiimide compound (1) were separately dried and then mixed in a weight ratio of 99:1. The mixture was melted in an extruder-type spinning machine at a temperature of 220° C., and spun at a spinning temperature of 255° C. at a discharge rate of 8.35 g/min using a spinneret having 36 discharge holes of 0.27 mmϕ. After that, the undrawn yarn was wound up at a rate of 500 m/min. The wound undrawn yarn was drawn to 4.9 times its original length in a drawing machine at a preheating temperature of 80° C. The drawn yarn was wound up and then heat-treated at 140° C. The process-passing properties were excellent in the spinning process and the drawing process. The wound drawn yarn was a multifilament having a fineness of 167 dtex/36 filaments.

Two of the obtained polylactic acid filaments were joined together, twisted 160 times/m, and woven as the warp and weft into a woven fabric having a twill weave structure. After that, the woven fabric was subjected to dry heat setting at a temperature of 140° C. for 2 minutes, and then dyed at a temperature of 120° C. for 30 minutes using a jet dyeing machine.

At that time, the fabric was dyed using the following disperse dye and cleared in the following reducing bath (pH=5.5).

Dyeing Conditions:

Disperse dye: C.I. Disperse Blue 79: 1% owf

Bath ratio: 1:20

Temperature×Time: 120° C.×30 minutes

Reducing Bath Composition and Cleaning Conditions:

Thiourea dioxide: 1 g/l

Bath ratio: 1:20

Temperature×Time: 70° C.×15 minutes

Next, drying was performed at a temperature of 130° C. for 10 minutes, followed by dry heat setting at a temperature of 140° C. for 2 minutes. Using the woven fabric, a uniform, a car interior material (car seat skin material), and an upholstery material (chair covering) were obtained. They had excellent washing fastness together with excellent durability.

At the time of melt-kneading, spinning, and processing, no isocyanate odor was detected. Also, upon melting at 300° C. for 5 minutes, the result of isocyanate odor evaluation was acceptable. The carboxyl end group concentration of a polylactic acid filament sampled immediately after spinning was 0 eq/ton, and the carboxyl end group concentration of a polylactic acid fiber extracted from the woven fabric obtained by dyeing with a disperse dye, reduction clearing, and dry heat setting was 0 eq/ton.

Example 19

The stereocomplex polylactic acid chip obtained by the procedure of Reference Example 9 and the cyclic carbodiimide compound (2) were separately dried and then mixed in a weight ratio of 99:1. The mixture was melted in an extruder-type spinning machine at a temperature of 220° C., and spun at a spinning temperature of 255° C. at a discharge rate of 8.35 g/min using a spinneret having 36 discharge holes of 0.27 mmϕ. After that, the undrawn yarn was wound up at a rate of 500 m/min. The wound undrawn yarn was drawn to 4.9 times its original length in a drawing machine at a preheating temperature of 80° C. The drawn yarn was wound up and then heat-treated at 180° C. The process-passing properties were excellent in the spinning process and the drawing process. The wound drawn yarn was a multifilament having a fineness of 167 dtex/36 filaments, a strength of 3.6 cN/dtex, and an elongation of 35%. In DSC measurement, it showed a single melting peak, and the melting peak temperature (melting point) was 224° C., while the stereocomplex crystallinity was 100%.

Two of the obtained stereocomplex polylactic acid filaments were joined together, twisted 160 times/m, and woven as the warp and weft into a woven fabric having a twill weave structure. After that, the woven fabric was subjected to dry heat setting at a temperature of 150° C. for 2 minutes, and then dyed at a temperature of 120° C. for 30 minutes using a jet dyeing machine. At that time, the same disperse dye as in Example 18 was used, and dyeing and reduction clearing were performed under the same conditions.

Dyeing Conditions:

Disperse dye: C.I. Disperse Blue 79: 1% owf

Bath ratio: 1:20

Temperature×Time: 120° C.×30 minutes

Reducing Bath Composition and Cleaning Conditions:

Thiourea dioxide: 1 g/l

Bath ratio: 1:20

Temperature×Time: 70° C.×15 minutes

Next, drying was performed at a temperature of 130° C. for 10 minutes, followed by dry heat setting at a temperature of 160° C. for 2 minutes. Using the woven fabric, a uniform, a car interior material (car seat skin material), and an upholstery material (chair covering) were obtained. They had excellent washing fastness together with excellent durability.

At the time of melt-kneading, spinning, and processing, no isocyanate odor was detected. Also, upon melting at 300° C. for 5 minutes, the result of isocyanate odor evaluation was acceptable. The carboxyl end group concentration of a polylactic acid filament sampled immediately after spinning was 0 eq/ton, and the carboxyl end group concentration of a polylactic acid fiber extracted from the woven fabric obtained by dyeing with a disperse dye, reduction clearing, and dry heat setting was 0 eq/ton.

Comparative Example 12

The same procedure as in Example 18 was performed, except that a linear polycarbodiimide compound [manufactured by Nisshinbo Chemical; "CARBODILITE" HMV-8CA] was used in place of the cyclic carbodiimide compound (1). The carboxyl end group concentration of a polylactic acid filament sampled immediately after spinning was 1 eq/ton, and the carboxyl end group concentration of a polylactic acid fiber extracted from the woven fabric obtained by dyeing with a disperse dye, reduction clearing, and dry heat setting was 2 eq/ton. However, an isocyanate odor was detected especially at the time of spinning. Also, upon melting at 300° C. for 5 minutes, the result of isocyanate odor evaluation was unacceptable.

Comparative Example 13

The same procedure as in Example 18 was performed, except that the cyclic carbodiimide compound (1) was not used. At the time of melt-kneading, spinning, and processing, no isocyanate odor was detected. Also, upon melting at 300° C. for 5 minutes, the result of isocyanate odor evaluation was acceptable. However, the carboxyl end group concentration of a polylactic acid filament sampled immediately after spinning was 15 eq/ton, and the carboxyl end group concentration of a polylactic acid fiber extracted from the woven fabric obtained by dyeing with a disperse dye, reduction clearing, and dry heat setting was 18 eq/ton, indicating poor hydrolysis resistance.

Example 20

The poly(L-lactic acid) chips obtained by the procedure of Reference Example 9 and the cyclic carbodiimide compound (1) were separately dried, then mixed in a weight ratio of 99:1, and melt-spun at a spinning temperature of 250° C. in an extruder-type spinning machine. The polymer melted in the extruder was guided to a spinning pack, filtered through a 20-μm metal nonwoven fabric filter, then weighed with a gear pump to a total fineness of 400 dtex, and spun through a spinneret having 96 holes of 0.6 ϕ. A 15-cm heating cylinder and a 15-cm heat-insulating cylinder were attached 3 cm below the spinneret surface, and heated so that the ambient temperature in the cylinder was 250° C.

The ambient temperature in the cylinder herein is the temperature of the air space at the longitudinal center of the heating cylinder, 1 cm from the inner wall. Immediately below the heating cylinder, a circular blowing chimney was attached. Cold air of 30° C. was blown to the yarn at a rate of 30 m/min to cool and solidify the yarn, and then an oil was applied thereto. As the oil, an 18% emulsion of TRN-4627, manufactured by Takemoto Oil & Fat, prepared with ion-exchange water was used.

The undrawn yarn having the oil applied thereto was wound around a first roller rotating at a surface velocity of 375 m/min, and thus taken up. Next, without winding up, the taken yarn was successively stretched 1.5% between the take-up roller and the second roller, followed by three-stage hot drawing to give 1.5% relaxation. The yarn was then wound up at a rate of 3000 m/min. The first roller was set at 60° C., the second roller was set at 100° C., the first drawing roller was set at 115° C., the second drawing roller was set at 140° C., and the third drawing roller was set at 140° C.

The relaxation roller was not heated. An entangling nozzle was placed between the relaxation roller and the winding machine to entangle fibers. Entanglement was performed by applying high-pressure air of 0.2 MPa (2 kg/cm$^2$) in the direction substantially perpendicular to the running yarn in the entangling apparatus, thereby giving polylactic acid fibers. Incidentally, based on the total draw ratio, the first-stage draw ratio was set at 34%, the second-stage draw ratio was set at 33%, and the third-stage draw ratio was set at 33%. The obtained polylactic acid fibers were knitted using a raschel knitting machine into a knitted fabric having a front of 7,000 dtex and a back of 4,700 dtex to give a net having a mesh size of 25 mm. At the time of melt-kneading, spinning, and processing, no isocyanate odor was detected. Also, upon melting at 300° C. for 5 minutes, the result of isocyanate odor evaluation was acceptable.

The carboxyl end group concentration of a polylactic acid filament sampled immediately after spinning was 0 eq/ton, and the carboxyl end group concentration of a polylactic acid fiber extracted from the obtained net was 0 eq/ton.

Example 21

The same procedure as in Example 20 was performed, except that the stereocomplex polylactic acid chips obtained by the procedure of Reference Example 9 as the polymer and the cyclic carbodiimide compound (2) were separately dried and then mixed in a weight ratio of 99:1, and such a mixture was used.

At the time of melt-kneading, spinning, and processing, no isocyanate odor was detected. Further, the carboxyl end group concentration of a polylactic acid filament sampled immediately after spinning was 0 eq/ton, and the carboxyl end group concentration of a polylactic acid fiber extracted from the obtained net was 0 eq/ton.

Example 22

The same procedure as in Example 20 was performed, except that the number of spinneret holes was 144. Six of the obtained polylactic acid fibers of 1000 dtex were twisted together 50 times/m, and further ten of the twisted yarns were plied 40 times/m to give a strand of 60000 dtex. Three of the strands were plied 15 times/m to give a three-ply rope of 180000 dtex having a diameter of 11 mm.

At the time of melt-kneading, spinning, and processing, no isocyanate odor was detected. Further, the carboxyl end group concentration of a polylactic acid filament sampled immediately after spinning was 0 eq/ton, and the carboxyl end group concentration of a polylactic acid fiber extracted from the obtained rope was 0 eq/ton.

Comparative Example 14

A net was obtained by the same procedure as in Example 20, except that a linear polycarbodiimide compound [manufactured by Nisshinbo Chemical; "CARBODILITE" HMV-8CA] was used in place of the cyclic carbodiimide compound. The carboxyl end group concentration of a polylactic acid filament sampled immediately after spinning was 1 eq/ton, and the carboxyl end group concentration of a polylactic acid fiber extracted from the obtained net was 2 eq/ton. However, an isocyanate odor was detected especially at the time of spinning.

Comparative Example 15

The same procedure as in Example 20 was performed, except that no cyclic carbodiimide compound was used. At the time of melt-kneading, spinning, and processing, no isocyanate odor was detected. Also, upon melting at 300° C. for 5 minutes, the result of isocyanate odor evaluation was acceptable. However, the carboxyl end group concentration of a polylactic acid filament sampled immediately after spinning was 15 eq/ton, and the carboxyl end group concentration of a polylactic acid fiber extracted from the obtained net was 18 eq/ton, indicating poor hydrolysis resistance.

Example 23

The poly(L-lactic acid) chips obtained by the procedure of Reference Example 9 and the cyclic carbodiimide compound (1) were separately dried and then mixed in a weight ratio of 99:1. The mixture was melt-spun in an extruder-type spinning machine at a spinning temperature of 250° C. and a spinning rate of 1000 m/min, and drawn in hot water of 60° C. to give a tow made of fibers having a single-fiber fineness of 1.5 dtex. The tow was fed to a stuffing-type crimper and crimped, then dried, and further cut with a rotary cutter to give raw cotton having a cut length of about 51 mm. The obtained raw cotton was subjected to carding and cross-lapping processes to give a fiber web, and the fiber web was needle-punched to give a nonwoven fabric.

The obtained nonwoven fabric was subjected to a shrinking treatment in hot water of 85° C., then impregnated with an aqueous polyvinyl alcohol solution, and further hot-pressed with a calender roll to give an entangled nonwoven fabric having a flat, smooth surface. The entangled nonwoven fabric was impregnated with a dimethylformamide solution of polyurethane having a solid content of 13% and containing polytetramethylene ether polyurethane as a main component, and then immersed in a DMF/water mixture to cause wet coagulation, thereby giving a fiber sheet. The fiber sheet was abraded with sandpaper to raise the surface, forming a leather-like sheet (suede-like). The mass ratio of polyurethane in the leather-like sheet was 30%.

Meanwhile, onto a granulated release paper, a polyurethane resin solution for forming a grain layer containing 100 parts of polyether polyurethane, 30 parts of DMF, and 30 parts of methyl ethyl ketone was applied to a dry thickness of 50 μm, and dried at 100° C. for 5 minutes to give a coating layer for forming a grain layer. A two-pack curable polyether polyurethane solution was applied thereonto to a dry thickness of 30 μm and dried at 50° C. for 3 minutes. While the applied coating was still sticky, the fiber sheet was attached thereto, dried at 100° C. for 2 minutes, and then allowed to stand at 40° C. for three days. After that, the release paper was removed to give a leather-like sheet (grained).

Both of the obtained leather-like sheets, the suede-like sheet and the grained sheet, had an excellent feel.

At the time of melt-kneading, spinning, and processing, no isocyanate odor was detected.

Further, the carboxyl end group concentration of a polylactic acid filament sampled immediately after spinning was 0 eq/ton, and the carboxyl end group concentration of a polylactic acid fiber extracted from the obtained leather-like sheets was 0 eq/ton.

Example 24

The same procedure as in Example 23 was performed, except that the stereocomplex polylactic acid chips obtained by the procedure of Reference Example 9 and the cyclic carbodiimide compound (2) were separately dried and then mixed in a weight ratio of 99:1, and such a obtained mixture was used as filaments.

Both of the obtained leather-like sheets, a suede-like sheet and a grained sheet, had an excellent feel.

At the time of melt-kneading, spinning, and processing, no isocyanate odor was detected.

Further, the carboxyl end group concentration of a polylactic acid filament sampled immediately after spinning was 0 eq/ton, and the carboxyl end group concentration of a polylactic acid fiber extracted from the obtained leather-like sheets was 0 eq/ton.

Comparative Example 16

The same procedure as in Example 23 was performed, except that a linear polycarbodiimide compound [manufactured by Nisshinbo Chemical; "CARBODILITE" HMV-8CA] was used in place of the cyclic carbodiimide compound (1). Both of the obtained leather-like sheets, a suede-like sheet and a grained sheet, had an excellent feel.

The carboxyl end group concentration of a polylactic acid filament sampled immediately after spinning was 1 eq/ton, and the carboxyl end group concentration of a polylactic acid fiber extracted from the obtained leather-like sheets was 2 eq/ton. However, an isocyanate odor was detected especially at the time of spinning.

Comparative Example 17

The same procedure as in Example 23 was performed, except that no cyclic carbodiimide compound was used. Both of the obtained leather-like sheets, a suede-like sheet and a grained sheet, had an excellent feel. At the time of melt-kneading, spinning, and processing, no isocyanate odor was detected. Further, the carboxyl end group concentration of a polylactic acid filament sampled immediately after spinning was 15 eq/ton, and the carboxyl end group concentration of a polylactic acid fiber extracted from the obtained leather-like sheets was 25 eq/ton, indicating lower hydrolysis resistance as compared with those obtained by the procedures of Examples 23 and 24.

Example 25

The poly(L-lactic acid) chips obtained by the procedure of Reference Example 9 and the cyclic carbodiimide compound (1) were separately dried and then mixed in a weight ratio of 99:1. The mixture was melted in an extruder-type spinning machine at a temperature of 220° C., and spun through a spinneret having 36 holes with a diameter of 0.27 mmϕ to give a multifilament yarn. The yarn was cooled and solidified with cooling air, and then bundled in an oil feeder, and an oil for spinning was applied thereto. The yarn was subsequently passed through an entangling apparatus and thus entangled by air flows, and then wound up at a wind-up rate of 500 m/min.

Next, using a friction-type false-twist texturing machine, false-twist texturing was performed at a texturing rate of 400 m/min to give a polylactic acid textured yarn (entangled, false twisted textured yarn). The obtained textured yarn had excellent dimensional stability and crimping characteristics. At the time of melt-kneading, spinning, and processing, no isocyanate odor was detected.

Also, upon melting at 300° C. for 5 minutes, the result of isocyanate odor evaluation was acceptable. The carboxyl end group concentration of a polylactic acid filament sampled immediately after spinning was 0 eq/ton, and the carboxyl end group concentration of the polylactic acid textured yarn was 0 eq/ton.

Example 26

The stereocomplex polylactic acid chips obtained by the procedure of Reference Example 9 and the cyclic carbodiimide compound (2) were separately dried and then mixed in a weight ratio of 99:1. The mixture was melted in an extruder-type spinning machine at a temperature of 220° C., and spun through a spinneret having 36 holes with a diameter of 0.27 mmϕ to give a multifilament yarn. The yarn was cooled and solidified with cooling air, and then bundled in an oil feeder, and an oil for spinning was applied thereto, followed by winding up at a wind-up rate of 500 m/min to give an undrawn yarn.

The obtained undrawn yarn was drawn to 4.9 times its original length in a drawing machine at a preheating temperature of 80° C. The drawn yarn was wound up and then heat-treated at 180° C. to give a drawn yarn. The obtained stereocomplex polylactic acid filament (drawn yarn) was fed to a twister and twisted to form 160 twists/m, thereby giving a textured yarn (twisted yarn).

At the time of melt-kneading, spinning, and processing, no isocyanate odor was detected. Also, upon melting at 300° C. for 5 minutes, the result of isocyanate odor evaluation was acceptable. The carboxyl end group concentration of a polylactic acid filament sampled immediately after spinning was 0 eq/ton, and the carboxyl end group concentration of the polylactic acid textured yarn was 0 eq/ton.

Example 27

The stereocomplex polylactic acid chips obtained by the procedure of Reference Example 9 and the cyclic carbodiimide compound (2) were separately dried and then mixed in a weight ratio of 99:1. The mixture was melted in an extruder-type spinning machine at a temperature of 220° C., and spun through a spinneret having 36 holes with a diameter of 0.27 mmϕ to give a multifilament yarn. The yarn was cooled and solidified with cooling air, and then bundled in an oil feeder, and an oil for spinning was applied thereto, followed by winding up at a wind-up rate of 500 m/min to give an undrawn yarn.

The obtained undrawn yarn was preheated using a heating roller (80° C.), and then subjected to a relaxing heat treatment using a non-contact heat-setting heater at a temperature set at 180° C. and an overfeed of 10%, thereby giving a polylactic acid textured yarn (thick-and-thin yarn). At the time of melt-kneading, spinning, and processing, no isocyanate odor was detected. Also, upon melting at 300° C. for 5 minutes, the result of isocyanate odor evaluation was acceptable. The carboxyl end group concentration of a polylactic acid filament sampled immediately after spinning was 0 eq/ton, and the carboxyl end group concentration of the polylactic acid textured yarn was 0 eq/ton.

Example 28

The poly(L-lactic acid) chips obtained by the procedure of Reference Example 9 and the cyclic carbodiimide compound (2) were separately dried and then mixed in a weight ratio of 99:1. The mixture was melted in an extruder-type spinning machine at a temperature of 220° C., and spun through a spinneret having 36 holes with a diameter of 0.27 mmϕ to give a multifilament yarn. The yarn was cooled and solidified with cooling air, and then bundled in an oil feeder, and an oil for spinning was applied thereto, followed by winding up at a wind-up rate of 450 m/min to give a polylactic acid undrawn filament A.

Also, the poly(L-lactic acid) chips obtained by the procedure of Reference Example 9 and the cyclic carbodiimide compound (2) were separately dried and then mixed in a weight ratio of 99:1. The mixture was melted in an extruder-type spinning machine at a temperature of 220° C., and spun through a spinneret having 36 holes with a diameter of 0.27 mmϕ to give a multifilament yarn. The yarn was cooled and solidified with cooling air, and then bundled in an oil feeder, and an oil for spinning was applied thereto, followed by winding up at a wind-up rate of 500 m/min to give a polylactic acid undrawn filament B.

The obtained polylactic acid undrawn filament A and polylactic acid undrawn filament B were joined together into a combined filament, then passed through an entangling apparatus, and thus entangled by air flows, thereby giving a polylactic acid textured yarn (combined filament yarn). The obtained polylactic acid fibers were treated with hot water. As a result, the filaments developed bulkiness.

At the time of melt-kneading, spinning, and processing, no isocyanate odor was detected. Also, upon melting at 300° C. for 5 minutes, the result of isocyanate odor evaluation was acceptable. The carboxyl end group concentration of a polylactic acid filament sampled immediately after spinning was 0 eq/ton, and the carboxyl end group concentration of the polylactic acid textured yarn was 0 eq/ton.

Comparative Example 18

The same procedure as in Example 25 was performed, except that a linear polycarbodiimide compound [manufactured by Nisshinbo Chemical; "CARBODILITE" HMV-8CA] was used in place of the cyclic carbodiimide compound (1).

The carboxyl end group concentration of a polylactic acid filament sampled immediately after spinning was 1 eq/ton, and the carboxyl end group concentration of the polylactic acid textured yarn was 2 eq/ton. However, an isocyanate odor was detected especially at the time of spinning. Also, upon melting at 300° C. for 5 minutes, the result of isocyanate odor evaluation was unacceptable.

Comparative Example 19

The same procedure as in Example 25 was performed, except that no cyclic carbodiimide compound was used. At the time of melt-kneading, spinning, and processing, no isocyanate odor was detected. Also, upon melting at 300° C. for 5 minutes, the result of isocyanate odor evaluation was acceptable. However, the carboxyl end group concentration of a polylactic acid filament sampled immediately after spinning was 15 eq/ton, and the carboxyl end group concentration of the polylactic acid textured yarn was 18 eq/ton, indicating poor hydrolysis resistance.

Example 29

The poly(L-lactic acid) chips obtained by the procedure of Reference Example 9 and the cyclic carbodiimide compound (1) were separately dried and then mixed in a weight ratio of 99:1. The mixture was melted in an extruder-type spinning machine at a temperature of 220° C., discharged from a spinneret having 30 discharge holes each having the cross-sectional shape with three constriction portions shown in FIG. 1, and then cooled in a spinning chimney. After that, an oil was applied thereto, and the undrawn yarn was wound up at a rate of 500 m/min. Incidentally, in FIG. 1, circumscribed circle/inscribed circle (B/C2)=3.9, flatness (B/C1)=3.0, and modification degree (C1/C2)=1.3.

The undrawn yarn was drawn to 3.6 times its original length at a preheating temperature of 80° C. and further to 1.4 times its original length (total draw ratio: 5). The yarn was subsequently heat-treated at 120° C. and wound up as a fiber of 84 dtex/30 filaments.

The obtained fiber was loosely twisted 100 times/m and used as the warp, while a non-twisted fiber was used as the weft. The fibers were woven into a plain woven fabric with a cover factor of 2000, and then dyed. Evaluation of the resulting cloth showed that softness, greasiness, and anti-visibility were all excellent.

At the time of melt-kneading and yarn making, no isocyanate odor was detected. Also, when the obtained woven fabric was melted at 300° C. for 5 minutes, the result of isocyanate odor evaluation was acceptable.

The carboxyl end group concentration of a polylactic acid filament sampled immediately after spinning was 1 eq/ton, and the carboxyl end group concentration of the polylactic acid yarn having a modified cross-sectional shape was 2 eq/ton.

Example 30

The example was performed in the same manner as in Example 29, except that the stereocomplex polylactic acid chips obtained by the procedure of Reference Example 9 and the cyclic carbodiimide compound (2) were used.

At the time of melt-kneading and yarn making, no isocyanate odor was detected. Also, when the obtained woven fabric was melted at 300° C. for 5 minutes, the result of isocyanate odor evaluation was acceptable. The carboxyl end group concentration of a polylactic acid filament sampled immediately after spinning was 1 eq/ton, and the carboxyl end group concentration of the polylactic acid yarn having a modified cross-sectional shape was 1 eq/ton.

Example 31

The example was performed in the same manner as in Example 29, except that in FIG. 1, circumscribed circle/inscribed circle (B/C2)=3.4, flatness (B/C1)=2.8, and modification degree (C1/C2)=1.2.

At the time of melt-kneading and yarn making, no isocyanate odor was detected. Also, when the obtained woven fabric was melted at 300° C. for 5 minutes, the result of isocyanate odor evaluation was acceptable. The carboxyl end group concentration of a polylactic acid filament sampled immediately after spinning was 1 eq/ton, and the carboxyl end group concentration of the polylactic acid yarn having a modified cross-sectional shape was 1 eq/ton.

Example 32

The example was performed in the same manner as in Example 2, except that in Example 29, in FIG. 1, circumscribed circle/inscribed circle (B/C2)=4.8, flatness (B/C1)=3.7, and modification degree (C1/C2)=1.3.

At the time of melt-kneading and yarn making, no isocyanate odor was detected. Also, when the obtained woven fabric was melted at 300° C. for 5 minutes, the result of isocyanate odor evaluation was acceptable. The carboxyl end group concentration of a polylactic acid filament sampled immediately after spinning was 1 eq/ton, and the carboxyl end group concentration of the polylactic acid yarn having a modified cross-sectional shape was 1 eq/ton.

Example 33

The example was performed in the same manner as in Example 2, except that in Example 29, in FIG. 1, circumscribed circle/inscribed circle (B/C2)=5.9, flatness (B/C1)=4.5, and modification degree (C1/C2)=1.3.

At the time of melt-kneading and yarn making, no isocyanate odor was detected. Also, when the obtained woven fabric was melted at 300° C. for 5 minutes, the result of isocyanate odor evaluation was acceptable. The carboxyl end group concentration of a polylactic acid filament sampled immediately after spinning was 1 eq/ton, and the carboxyl end group concentration of the polylactic acid yarn having a modified cross-sectional shape was 1 eq/ton.

Example 34

The same procedure as in Example 29 was performed, except that the spinneret had a hole shape that provides a fiber with a triangular cross-section. At the time of melt-kneading and yarn making, no isocyanate odor was detected. Also, when the obtained woven fabric was melted at 300° C. for 5 minutes, the result of isocyanate odor evaluation was acceptable. The carboxyl end group concentration of a polylactic acid filament sampled immediately after spinning was 1 eq/ton, and the carboxyl end group concentration of the polylactic acid yarn having a modified cross-sectional shape was 2 eq/ton.

Example 35

The same procedure as in Example 29 was performed, except that the spinneret had a hole shape that provides a fiber with a hollow cross-section. At the time of melt-kneading and yarn making, no isocyanate odor was detected. Also, when the obtained woven fabric was melted at 300° C. for 5 minutes, the result of isocyanate odor evaluation was acceptable. The carboxyl end group concentration of a polylactic acid filament sampled immediately after spinning was 1 eq/ton, and the carboxyl end group concentration of the polylactic acid yarn having a modified cross-sectional shape was 1 eq/ton.

Comparative Example 20

The same procedure as in Example 29 was performed, except that a linear polycarbodiimide compound [manufactured by Nisshinbo Chemical; "CARBODILITE" HMV-8CA] was used in place of the cyclic carbodiimide compound (1).

The carboxyl end group concentration of a polylactic acid filament sampled immediately after spinning was 2 eq/ton, and the carboxyl end group concentration of the polylactic acid yarn having a modified cross-sectional shape was 2 eq/ton. However, an isocyanate odor was detected especially at the time of spinning. Also, when the obtained yarn having a modified cross-sectional shape was melted at 300° C. for 5 minutes, the result of isocyanate odor evaluation was unacceptable.

Comparative Example 21

The same procedure as in Example 29 was performed, except that the cyclic carbodiimide compound (1) was not used. At the time of melt-kneading and spinning, no isocyanate odor was detected. Also, upon melting at 300° C. for 5 minutes, the result of isocyanate odor evaluation was acceptable. However, the carboxyl end group concentration of a polylactic acid filament sampled immediately after spinning was 30 eq/ton, and the carboxyl end group concentration of the polylactic acid yarn having a modified cross-sectional shape was 39 eq/ton, indicating poor hydrolysis resistance.

Example 36

The poly(L-lactic acid) chips obtained by the procedure of Reference Example 9 and the cyclic carbodiimide compound (1) were separately dried and then melt-blended in a weight ratio of 99:1. The resulting pellets were fed to a twin-screw melt extruder (using a vent), and discharged at 325 g/min from one side of a side-by-side spinneret having 260 discharge holes. Meanwhile, polybutylene terephthalate ("DURANEX" TRE-DM2 manufactured by WinTech Polymer) was fed to a twin-screw melt extruder (using a vent) from a loss-in-weight-type weight feeder, and discharged at 325 g/min from the other side of the side-by-side spinneret.

Subsequently, the undrawn yarn was wound up at a rate of 800 m/min while blowing air of 25° C. thereto at a position 40 mm below the spinneret for cooling and solidification. The undrawn yarn was bundled into a tow of 500,000 dtex (hereinafter sometimes referred to as undrawn tow), then drawn to 3.47 times its original length in hot water of 60° C., and subsequently drawn to 1.05 times its original length in hot water of 90° C., thereby drawing the tow to a total draw ratio of 3.64. Subsequently, six metal rollers heated with steam of 0.85 MPa were passed thereover. With the tow temperature being 185° C. after the passage, the tow was subjected to a fixed-length heat treatment (1.0 time its original length), and an oil containing a stearyl phosphate potassium salt was applied thereto. The tow was then heated to 80° C. with steam, fed to a stuffing-type crimper and thus provided with 14 crimps/25 mm, and subjected to a relaxing heat treatment through circulating hot air of 60° C. for 50 minutes. Subsequently, the tow was cut with a rotary cutter into staple fibers of 8.95 dtex and 64 mm. The obtained fiber has a fiber strength of 2.56 cN/dtex.

At the time of melt-kneading and yarn making, no isocyanate odor was detected. Also, when the obtained composite fiber was melted at 300° C. for 5 minutes, the result of isocyanate odor evaluation was acceptable.

The carboxyl end group concentration of the polylactic acid resin pellets obtained by melt-blending the cyclic carbodiimide compound (1) was 1 eq/ton, and the carboxyl end group concentration of a discharged yarn obtained when, at the time of composite spinning, only the polylactic-acid side was spun was 2 eq/ton.

Example 37

Staple fibers of 8.95 dtex and 64 mm were obtained in the same manner as in Example 36, except that the stereocomplex polylactic acid chips obtained by the procedure of Reference Example 9 and the cyclic carbodiimide compound (2) were used. The obtained fiber has a fiber strength of 2.60 cN/dtex.

At the time of melt-kneading and yarn making, no isocyanate odor was detected. Also, when the obtained composite fiber was melted at 300° C. for 5 minutes, the result of isocyanate odor evaluation was acceptable.

The carboxyl end group concentration of the polylactic acid resin pellets obtained by melt-blending the cyclic carbodiimide compound was 1 eq/ton, and the carboxyl end group concentration of a discharged yarn obtained when, at the time of composite spinning, only the polylactic-acid side was spun was 1 eq/ton.

Example 38

In the production of the side-by-side composite fiber of Example 37, the pack structure and the spinneret were changed to the core-sheath configuration. The stereocomplex polylactic acid chips obtained by the procedure of Reference Example 9 and the cyclic carbodiimide compound (2) were melt-blended at a weight ratio of 99:1, and the resulting pellets were discharged at 325 g/min from the sheath side of 260 discharge holes. Meanwhile, polybutylene terephthalate ("DURANEX" TRE-DM2 manufactured by WinTech Polymer) was fed to a twin-screw melt extruder (using a vent) from a loss-in-weight-type weight feeder, and discharged at 325 g/min through the core side of the core-sheath spinneret.

Subsequently, the undrawn yarn was wound up at a rate of 800 m/min while blowing air of 25° C. thereto at a position 40 mm below the spinneret for cooling and solidification. The undrawn yarn was bundled into a tow of 500,000 dtex, then drawn to 3.5 times its original length in hot water of 60° C., and subsequently drawn to 1.05 times its original length in hot water of 90° C., thereby drawing the tow to a total draw ratio of 3.25. Subsequently, six metal rollers heated with steam of 0.85 MPa were passed thereover. With the tow temperature being 185° C. after the passage, the tow was subjected to a fixed-length heat treatment (1.0 time its original length), and an oil containing a stearyl phosphate potassium salt was applied thereto. The tow was then heated to 80° C. with steam, fed to a stuffing-type crimper and thus provided with 14 crimps/25 mm, and subjected to a relaxing heat treatment through circulating hot air of 60° C. for 50 minutes. Subsequently, the tow was cut with a rotary cutter into staple fibers of 9.0 dtex and 64 mm. The obtained fiber has a fiber strength of 2.50 cN/dtex.

At the time of melt-kneading and yarn making, no isocyanate odor was detected. Also, when the obtained composite fiber was melted at 300° C. for 5 minutes, the result of isocyanate odor evaluation was acceptable. The carboxyl end group concentration of the polylactic acid resin pellets obtained by melt-blending the cyclic carbodiimide compound (2) was 1 eq/ton, and the carboxyl end group concentration of a discharged yarn obtained when, at the time of composite spinning, only the polylactic-acid side was spun was 2 eq/ton.

Comparative Example 22

The same procedure as in Example 36 was performed, except that a linear polycarbodiimide compound [manufactured by Nisshinbo Chemical; "CARBODILITE" HMV-8CA] was used in place of the cyclic carbodiimide compound (1).

The carboxyl end group concentration of the polylactic acid resin pellets obtained by melt-blending a polylactic acid compound and the linear carbodiimide compound was 2 eq/ton, and the carboxyl end group concentration of a discharged yarn obtained when, at the time of composite spinning, only the polylactic-acid side was spun was 3 eq/ton. However, an isocyanate odor was detected especially at the time of spinning. Also, when the obtained side-by-side composite yarn was melted at 300° C. for 5 minutes, the result of isocyanate odor evaluation was unacceptable.

Comparative Example 23

The same procedure as in Example 36 was performed, except that the cyclic carbodiimide compound (1) was not used. At the time of melt-kneading and spinning, no isocyanate odor was detected. Also, upon melting at 300° C. for 5 minutes, the result of isocyanate odor evaluation was acceptable. However, the carboxyl end group concentration of a discharged yarn obtained when, at the time of composite spinning, only the polylactic-acid side was spun was 39 eq/ton, indicating poor hydrolysis resistance.

Example 39

The poly(L-lactic acid) chips obtained in Reference Example 9 and Nylon 6 chips having a 98% sulfuric acid relative viscosity $\eta_r$ of 3.30 were each fed to an extruder-type melt spinning apparatus in a poly(L-lactic acid)/Nylon 6 weight ratio of 40/60, followed by melt-spinning. The spinning temperature was set at 250° C. They were filtered through a metal filter having 15-μm pores, and spun through a spinneret having 96 holes into the so-called core-sheath configuration, with the Nylon 6 being the sheath and the polylactic acid being the core.

The spun yarn was passed to 130 mm below the spinneret surface in a high temperature atmosphere of 240° C., and then cooled and solidified by blowing cold air of about 20° C. Subsequently, an oil was applied thereto using an oiling roller, and the yarn was then taken up by a first godet roller. Without winding up, the obtained undrawn yarn was pre-stretched 1.86% between the first godet roller and a second godet roller. Then the yarn was drawn to 2.44 times its original length between the second godet roller and a third godet roller, drawn to 1.63 times its original length between the third godet roller and a fourth godet roller, drawn to 1.45 times its original length between the fourth godet roller and a fifth godet roller, then relaxed 3% between the fifth godet roller and a sixth godet roller, and wound up by a winder at a rate of 3000 m/min to give a drawn yarn.

The temperature of each godet roller was as follows: first godet roller=60° C., second godet roller=95° C., third godet roller=105° C., fourth godet roller=140° C., fifth godet roller=160° C., sixth godet roller=not heated.

Also, in winding the yarn, the number of turns on each godet roller was as follows: first godet roller=5 turns, second godet roller=7 turns, third godet roller=7 turns, fourth godet roller=7 turns, fifth godet roller=11 turns, sixth godet roller=4.5 turns.

The carboxyl end group concentration of a filament sampled immediately after spinning was 15 eq/ton. Subsequently, the drawn yarn was crimped with an ordinary crimper configured such that mechanical buckling is given by stuffing. The yarn was then cut to a length of 6 mm to give drawn staple fibers of a polyamide composite fiber containing polylactic acid. The plant-derived component content in the obtained polyamide composite fiber containing polylactic acid was 40 wt %.

Further, a drawn yarn obtained by spinning using the above Nylon 6 alone under the same conditions was crimped with an ordinary crimper configured such that mechanical buckling is given by stuffing. The yarn was then cut to a length of 6 mm to give crimpled polyamide drawn staple fibers.

The drawn staple fibers of a polyamide composite fiber containing polylactic acid and the polyamide drawn staple fibers were mixed and stirred in a weight ratio of 50/50, formed into paper of 50 g/m$^2$ using TAPPI (square sheet machine manufactured by Kumagai Riki Kogyo), and then subjected to yankee dryer drying (120° C.×2 minutes) and calendering (160° C.×1176 N/cm (120 kg/cm), metal/paper roller) to give a sheet-like fiber structure.

Example 40

The stereocomplex polylactic acid resin obtained in Reference Example 9 and the cyclic carbodiimide compound (2) were separately dried and mixed in a weight ratio of 99:1, and the resulting mixture and Nylon 6 chips having a 98% sulfuric acid relative viscosity $\eta_r$ of 3.30 were each fed to an extruder-type melt spinning apparatus in a stereocomplex polylactic acid/Nylon 6 weight ratio of 40/60, followed by melt-spinning. The spinning temperature was set at 250° C. They were filtered through a metal filter having 15-μm pores, and spun through a spinneret having 96 holes into the so-called core-sheath configuration, with the Nylon 6 being the sheath and the polylactic acid being the core, followed by drawing, crimping, and cutting by the same procedure as in Example 39 to give drawn staple fibers of a polyamide composite fiber containing polylactic acid. The plant-derived component content in the obtained polyamide composite fiber containing polylactic acid was 40 wt %. The carboxyl end group concentration of a filament sampled immediately after spinning was 0 eq/ton.

Further, a drawn yarn obtained by spinning using the above Nylon 6 alone under the same conditions was crimped with an ordinary crimper configured such that mechanical buckling is given by stuffing. The yarn was then cut to a length of 6 mm to give crimpled polyamide drawn staple fibers.

The drawn staple fibers of a polyamide composite fiber containing polylactic acid and the polyamide drawn staple fibers were mixed and stirred in a weight ratio of 50/50, formed into paper of 50 g/m$^2$ using TAPPI (square sheet machine manufactured by Kumagai Riki Kogyo), and then subjected to yankee dryer drying (120° C.×2 minutes) and calendering (160° C.×1176 N/cm (120 kg/cm), metal/paper roller) to give a sheet-like fiber structure.

At the time of the melting, spinning, and processing of the stereocomplex polylactic acid chips, no isocyanate odor was detected. Also, upon melting at 300° C. for 5 minutes, the result of isocyanate odor evaluation was acceptable.

Comparative Example 24

The same procedure as in Example 40 was performed, except that a linear polycarbodiimide compound [manufactured by Nisshinbo Chemical; "CARBODILITE" HMV-8CA] was used in place of the cyclic carbodiimide compound (2). The plant-derived component content in the obtained polyamide drawn staple fibers was 40 wt %. The carboxyl end group concentration of a filament sampled immediately after spinning was 1 eq/ton. However, an isocyanate odor was detected especially at the time of spinning. Also, upon melting at 300° C. for 5 minutes, the result of isocyanate odor evaluation was unacceptable.

Example 41

Chips of polyethylene terephthalate having a melting point of 262° C. and a carboxyl end group concentration of 28 eq/ton were dried, then melted in an extruder-type spinning machine at a temperature of 280° C., and spun at a spinning temperature of 290° C. After that, the undrawn yarn was wound up at a rate of 3000 m/min. The wound undrawn yarn was drawn in a drawing machine under conditions of a drawing temperature of 90° C., a heat-setting temperature of 130° C., a draw ratio of 1.80, and a drawing rate of 800 m/min, thereby giving a polyethylene terephthalate drawn yarn.

Subsequently, the drawn yarn was crimped with an ordinary crimper configured such that mechanical buckling is given by stuffing. The yarn was then cut to a length of 6 mm to give polyethylene terephthalate drawn staple fibers (fineness: 1.2 dtex, fiber length: 6 mm).

Also, the poly(L-lactic acid) chips obtained in Reference Example 9 were dried, then melted in an extruder-type spinning machine at a temperature of 220° C., and spun at a spinning temperature of 255° C. After that, the undrawn yarn was wound up at a rate of 500 m/min. The wound undrawn yarn was drawn to 4.9 times its original length in a drawing machine at a preheating temperature of 80° C. The drawn yarn was wound up and then heat-treated at 140° C. The process-passing properties were excellent in the spinning process and the drawing process. The wound drawn yarn had a single-fiber fineness of 2.2 dtex. The obtained drawn yarn had a strength of 4.2 cN/dtex and a boiling water shrinkage of 6.2%.

Subsequently, the obtained drawn yarn was crimped with an ordinary crimper configured such that mechanical buckling is given by stuffing. The yarn was then cut to a length of 6 mm to give crimped polylactic acid drawn staple fibers.

The above polyethylene terephthalate staple fibers and the obtained polylactic acid staple fibers were mixed and stirred in a weight ratio of 80/20, formed into paper of 50 g/m$^2$ using TAPPI (square sheet machine manufactured by Kumagai Riki Kogyo), and then subjected to yankee dryer drying (120° C.×2 minutes) and calendering (160° C.×1176 N/cm (120 kg/cm), metal/paper roller) to give a sheet-like polyethylene terephthalate fiber structure.

The plant-derived component content in the obtained fiber structure was 20 wt %. The carboxyl end group concentration of a polylactic acid filament sampled immediately after spinning was 15 eq/ton.

Example 42

The stereocomplex polylactic acid resin obtained in Reference Example 9 and the cyclic carbodiimide compound (2) were separately dried and then mixed in a weight ratio of 99:1. The mixture was melted in an extruder-type spinning machine at a temperature of 220° C., and spun at a spinning temperature of 255° C. The undrawn yarn was then wound up a rate of 500 m/min. The wound undrawn yarn was drawn to 4.9 times its original length in a drawing machine at a preheating temperature of 80° C. The drawn yarn was wound up and then heat-treated at 180° C. The process-passing properties were excellent in the spinning process and the drawing process. The wound drawn yarn had a single-fiber fineness of 2.2 dtex. In DSC measurement, the obtained polylactic acid fiber showed a single melting peak, and the melting peak temperature (melting point) was 224° C., while the stereocomplex crystallinity was 100%. Subsequently, the obtained drawn yarn was crimped with an ordinary crimper configured such that mechanical buckling is given by stuffing. The yarn was then cut to a length of 6 mm to give crimped polylactic acid drawn staple fibers.

The polyethylene terephthalate staple fibers obtained in the same manner as in Example 41 and the polylactic acid drawn staple fibers obtained by the above procedure were mixed and stirred in a weight ratio of 80/20, formed into paper of 50 g/m$^2$ using TAPPI (square sheet machine manufactured by Kumagai Riki Kogyo), and then subjected to yankee dryer drying (120° C.×2 minutes) and calendering (160° C.×1176 N/cm (120 kg/cm), metal/paper roller) to give a sheet-like polyethylene terephthalate fiber structure.

The plant-derived component content in the obtained fiber structure was 20 wt %. At the time of the melting, spinning, and processing of the polylactic acid chips, no isocyanate odor was detected. Also, upon melting at 300° C. for 5 minutes, the result of isocyanate odor evaluation was acceptable.

The carboxyl end group concentration of a polylactic acid filament sampled immediately after spinning was 0 eq/ton.

Comparative Example 25

The same procedure as in Example 42 was performed, except that a linear polycarbodiimide compound [manufactured by Nisshinbo Chemical; "CARBODILITE" HMV-8CA] was used in place of the cyclic carbodiimide compound (2). The plant-derived component content in the obtained fiber structure was 20 wt %. The carboxyl end group concentration of a polylactic acid filament sampled immediately after spinning was 1 eq/ton. However, an isocyanate odor was detected especially at the time of spinning. Also, upon melting at 300° C. for 5 minutes, the result of isocyanate odor evaluation was unacceptable.

Example 43

The poly(L-lactic acid) chips obtained by the procedure of Reference Example 9 and the cyclic carbodiimide compound (1) were separately dried and then melt-blended in a weight ratio of 99:1. The resulting pellets were fed to a twin-screw melt extruder (using a vent), and a multifilament of 84 dtex/72 filaments was obtained in the usual manner. The strength of the obtained fiber was 3.8 cN/dtex.

At the time of the melt-kneading and yarn making of the polylactic acid fiber, no isocyanate odor was detected. Also, when the obtained fiber was melted at 300° C. for 5 minutes, the result of isocyanate odor evaluation was acceptable.

The carboxyl end group concentration of the polylactic acid resin pellets obtained by melt-blending the cyclic carbodiimide compound (1) was 1 eq/ton, and the carboxyl end group concentration in a polylactic acid fiber was 2 eq/ton.

Further, using a silk yarn of 23 dtex/2-ply (equivalent to 46 dtex) (first twist Z: 1200 times/m, second twist S: 1100 times/m) as the warp and a yarn obtained by similarly twisting the above polylactic acid fiber (multifilament) as the weft, the yarns were woven into a broken twill weave by jacquard weaving using a rapier weaving machine (warp density: 248 yarns/inch, weft density: 131 yarns/inch).

In an aqueous solution having dissolved therein "SCOUROL" (manufactured by Kao) in an amount of 0.5 g/L and sodium carbonate in an amount of 0.5 g/L, the obtained woven fabric was scoured at 80° C. for 30 minutes in the usual manner for silk/polylactic acid fiber blend fabrics. A fiber structure was thus obtained. Ten single yarns (filaments) to be tested were randomly extracted from the fiber structure. Under the conditions where the yarn sample length was 50 mm (length between chucks) and the elongation rate was 500 mm/min, a strain-stress curve was measured at an ambient temperature of 20° C. and a relative humidity of 65% RH using "TENSILON" manufactured by Orientec. The strength (cN/yarn) was determined from the stress and tension at the breaking point, and then the strength was divided by fineness to determine fiber strength (cN/dtex). As a result of the measurement of strength, the fiber strength was 3.8 cN/dtex, showing no decrease in polylactic acid fiber strength due to scouring.

Example 44

The example was performed in the same manner as in Example 43, except that the stereocomplex polylactic acid chips obtained by the procedure of Reference Example 9 were used in place of the poly(L-lactic acid) chips, and that the cyclic carbodiimide compound (2) was used in place of the cyclic carbodiimide compound (1). The strength of the obtained fiber was 3.9 cN/dtex. At the time of the melt-kneading and yarn making of the polylactic acid fiber, no isocyanate odor was detected. Also, when the obtained fiber was melted at 300° C. for 5 minutes, the result of isocyanate odor evaluation was acceptable.

The carboxyl end group concentration of the polylactic acid resin pellets obtained by melt-blending the cyclic carbodiimide compound was 1 eq/ton, and the carboxyl end group concentration in a polylactic acid fiber was 1 eq/ton.

The obtained woven fabric was scoured in the same manner as in Example 43 to give a fiber structure.

In the same manner as in Example 43, polylactic acid fibers were extracted from the fiber structure, and the strength thereof was measured. As a result, the strength was 3.9 cN/dtex, showing no decrease in polylactic acid fiber strength due to scouring.

Comparative Example 26

The same procedure as in Example 43 was performed, except that a linear polycarbodiimide compound [manufactured by Nisshinbo Chemical; "CARBODILITE" HMV-8CA] was used in place of the cyclic carbodiimide compound (1).

The carboxyl end group concentration of the polylactic acid resin pellets obtained by melt-blending polylactic acid and the linear carbodiimide compound was 2 eq/ton, and the carboxyl end group concentration in a polylactic acid fiber was 3 eq/ton. However, an isocyanate odor was detected especially at the time of spinning. Also, when the obtained polylactic acid fiber was melted at 300° C. for 5 minutes, the result of isocyanate odor evaluation was unacceptable.

The obtained woven fabric was scoured in the same manner as in Example 43 to give a fiber structure. In the same manner as in Example 43, polylactic acid fibers were extracted from the fiber structure, and the strength thereof was measured. As a result, the strength was 3.7 cN/dtex, showing almost no decrease in polylactic acid fiber strength due to scouring.

Comparative Example 27

The same procedure as in Example 43 was performed, except that the cyclic carbodiimide compound (1) was not used. At the time of melt-kneading and spinning, no isocyanate odor was detected. Also, upon melting at 300° C. for 5 minutes, the result of isocyanate odor evaluation was acceptable. However, at the time of spinning, the carboxyl end group concentrations in a polylactic acid fiber was 38 eq/ton, indicating poor hydrolysis resistance.

Further, from a fiber structure obtained by scouring the obtained woven fabric in the same manner as in Example 43, polylactic acid fibers were extracted to measure strength in the same manner as in Example 43. As a result, the strength was 3.3 cN/dtex, showing a decrease in polylactic acid fiber strength due to scouring.

Example 45

The poly(L-lactic acid) chips obtained by the procedure of Reference Example 9 and the cyclic carbodiimide compound (1) were separately dried and then mixed in a weight ratio of 99:1. The mixture was melted in an extruder-type spinning machine at a temperature of 220° C., discharged from a spinneret having 30 discharge holes, and then cooled in a spinning chimney. After that, an oil was applied thereto, and the undrawn yarn was wound up at a rate of 500 m/min. The undrawn yarn was drawn to 4.9 times its original length at a preheating temperature of 80° C., subsequently heat-treated at 120° C., and wound up as a fiber of 56 dtex/20 filaments. By the same procedure as above, a fiber having a fineness of 84 dtex/36 filaments was also obtained.

Next, using the fiber having a total fineness of 56 dtex/20 filaments as the warp and the multifilament having a total fineness of 84 dtex/36 filaments as the weft, a taffeta woven fabric having a warp density of 76 yarns/2.54 cm and a weft density of 90 yarns/2.54 cm was obtained. In the usual manner, the taffeta woven fabric was scoured, relaxed, dyed, then dried, and set to give a base fabric.

In order to impart heat-retaining properties, the following blend composition was prepared.

[Composition of Blend Composition]

Acrylic binder: 60.0 wt % (solid content: 40 wt %)

Antimony-doped tin oxide (ATO) aqueous dispersion: 5.0 wt %

(solid content: 15 wt %, heat conductivity of ATO: 50 W/(m·K), size of ATO fine particles: 50 nm or less)

Water: 35.0 wt %

Next, using a 105-mesh gravure roll, the blend composition was applied to one side of the taffeta woven fabric (ATO content: 0.8 g/m$^2$, binder resin solid content: 24.2 g/m$^2$), and then dried at 140° C. to give a heat-retaining cloth (heat-retaining polylactic acid fiber structure). As the transfer pattern of the gravure roll, one having the grid pattern made of horizontal and vertical lines shown in FIG. 3 over its entire surface was employed (area percentage of the application region: 50%, lattice spacing: 10 mm).

In order to confirm the heat-retaining effect, using a 200-W reflex lamp light source as the energy source, the obtained heat-retaining cloth was irradiated from a height of 50 cm in a constant-temperature, constant-humidity environment of 20° C. and 60% RH. The temperature of the front of the cloth in 30 seconds was measured using a thermoviewer (IR sensor: manufactured by JEOL), while the temperature of the back of the cloth was measured using a thermocouple. In addition, softness was evaluated by three panelists in sensory evaluation on a four-level scale. "Extremely excellent" was expressed as A, "excellent" was expressed as B, "fair" was expressed as C, and "poor" was expressed as D.

With respect to heat-retaining properties, the temperature of the front of the cloth was 38.0° C., and the temperature of the back of the cloth was 39.5° C. Softness was B, warp fiber strength was 3.7 cN/dtex, and weft fiber strength was 3.7 cN/dtex. Thus, the cloth was excellent in terms of the fiber strength of polylactic acid fibers, and also had excellent heat-retaining properties.

Incidentally, at the time of melt-kneading and yarn making, no isocyanate odor was detected. Also, when the obtained structure was melted at 300° C. for 5 minutes, the result of isocyanate odor evaluation was acceptable. The carboxyl end group concentration of a polylactic acid filament sampled immediately after spinning was 1 eq/ton, and the carboxyl end group concentration of the heat-retaining cloth was 2 eq/ton.

Example 46

The example was performed in the same manner as in Example 45, except that the stereocomplex polylactic acid chips obtained by the procedure of Reference Example 9 and the cyclic carbodiimide compound (2) were used. The obtained heat-retaining cloth was evaluated in the same manner as in Example 45. With respect to heat-retaining properties, the temperature of the front of the cloth was 38.1° C., and the temperature of the back of the cloth was 39.6° C. Softness was B, warp fiber strength was 3.8 cN/dtex, and weft fiber strength was 3.7 cN/dtex. Thus, the cloth was excellent in terms of the fiber strength of polylactic acid fibers, and also had excellent heat-retaining properties.

Incidentally, at the time of melt-kneading and yarn making, no isocyanate odor was detected. Also, when the obtained structure was melted at 300° C. for 5 minutes, the result of isocyanate odor evaluation was acceptable. The carboxyl end group concentration of a polylactic acid filament sampled immediately after spinning was 1 eq/ton, and the carboxyl end group concentration of the heat-retaining cloth was 1 eq/ton.

Example 47

Figure 4:
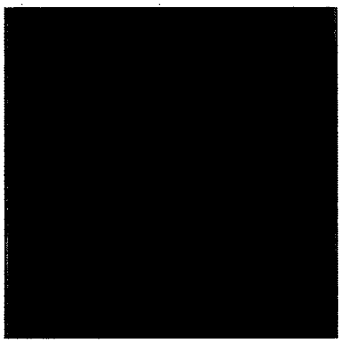
FIG. 4 is a schematic diagram of an example of the attachment pattern of a heat-retaining-property-imparting agent, a water-repellent agent, or the like usable in the invention (pattern where the agent is applied over the entire surface). Incidentally, the black part represents the region where the agent is attached.

The example was performed in the same manner as in Example 2, except that the transfer pattern of the gravure roll in Example 46 was changed to the full pattern shown in FIG. 4, where the area percentage of the application region is 100% (ATO content: 1.6 g/m$^2$, binder resin solid: 48.4 g/m$^2$). The obtained heat-retaining cloth was evaluated in the same manner as in Example 45. With respect to heat-retaining properties, the temperature of the front of the cloth was 38.6° C., and the temperature of the back of the cloth was 39.7° C. Softness was C, but heat-retaining properties were excellent. Incidentally, at the time of melt-kneading and yarn making, no isocyanate odor was detected. Also, when the obtained structure was melted at 300° C. for 5 minutes, the result of isocyanate odor evaluation was acceptable. The carboxyl end group concentration of a polylactic acid filament sampled immediately after spinning was 2 eq/ton, and the carboxyl end group concentration of the heat-retaining cloth was 2 eq/ton.

Comparative Example 28

The same procedure as in Example 46 was performed, except that a linear polycarbodiimide compound [manufactured by Nisshinbo Chemical; "CARBODILITE" HMV-8CA] was used in place of the cyclic carbodiimide compound (2). The obtained heat-retaining cloth was evaluated in the same manner as in Example 45. With respect to heat-retaining properties, the temperature of the front of the cloth was 38.7° C., and the temperature of the back of the cloth was 39.8° C. Softness was B, and heat-retaining properties were also excellent.

The carboxyl end group concentration of a polylactic acid filament sampled immediately after spinning was 2 eq/ton, and the carboxyl end group concentration of the heat-retaining cloth was 2 eq/ton. However, an isocyanate odor was detected especially at the time of spinning. Also, when the obtained structure was melted at 300° C. for 5 minutes, the result of isocyanate odor evaluation was unacceptable.

Comparative Example 29

The same procedure as in Example 46 was performed, except that the cyclic carbodiimide compound (2) was not used. The obtained heat-retaining cloth was evaluated in the same manner as in Example 45. With respect to heat-retaining properties, the temperature of the front of the cloth was 38.5° C., and the temperature of the back of the cloth was 39.9° C. Softness was B, and heat-retaining properties were also excellent.

Incidentally, at the time of melt-kneading and spinning, no isocyanate odor was detected. Also, upon melting at 300° C. for 5 minutes, the result of isocyanate odor evaluation was acceptable. However, the carboxyl end group concentration of a polylactic acid filament sampled immediately after spinning was 29 eq/ton, and the carboxyl end group concentration of the heat-retaining cloth was 38 eq/ton, indicating poor hydrolysis resistance.

Example 48

The poly(L-lactic acid) chips obtained by the procedure of Reference Example 9 and the cyclic carbodiimide compound (1) were separately dried and then mixed in a weight ratio of 99:1. The mixture was melted in an extruder-type spinning machine at a temperature of 220° C., discharged from a spinneret having 30 discharge holes, and then cooled in a spinning chimney. After that, an oil was applied thereto, and the undrawn yarn was wound up at a rate of 500 m/min. The wound undrawn yarn was drawn to 4.9 times its original length in a drawing machine at a preheating temperature of 80° C. The drawn yarn was wound up, then heat-treated at 120° C., and further subjected to false-twist crimping. The process-passing properties were excellent in the spinning process and the drawing process. The obtained false-twist crimped yarn was a multifilament having a fineness of 190 dtex/48 filaments (single-fiber transverse cross-sectional shape: round cross-section).

Next, using the false-twist crimped yarn as the warp and the false-twist crimped yarn as the weft (used in 1:1), a weft-backed woven fabric (grey-fabric warp density: 100 yarns/2.54 cm, grey-fabric weft density: 160 yarns/2.54 cm) was formed, then scoured at 80° C., and dyed in the usual manner at 110° C. for 30 minutes. At the time of dyeing, water-repellent processing was performed in the same bath (5% owf) using a hydrophilizing agent containing a polyethylene terephthalate-polyethylene glycol copolymer (SR-1000 manufactured by Takamatsu Oil & Fat), followed by drying (at a temperature of 110° C., 3 minutes) and setting (at a temperature of 150° C., 1 minute).

Next, onto one side of the woven fabric, a treatment liquid of the following formulation was applied in an amount of about 15 g/m$^2$ by gravure transfer printing in the checkerboard grid pattern shown in FIG. 2 (square size: 1 mm×1 mm, area percentage of the application region: 50%), then dried at 110° C., and subjected to a dry heat treatment at 130° C. for 45 seconds to give a woven fabric.

[Composition of Treatment Liquid]

Water: 91.6 wt %

Fluoride-based water-repellent agent: 8 wt %
("AsahiGuard AG710" manufactured by Asahi Glass)

Melamine-based binder resin: 0.3 wt %
("SUMITEX Resin M-3" manufactured by Sumitomo Chemical, contact angle: 67.5°)

Catalyst: 0.1 wt %
("SUMITEX Accelerator ACX")

The obtained woven fabric was as follows: warp density: 140 yarns/2.54 cm, grey-fabric weft density: 180 yarns/2.54 cm, thickness: 0.5 mm, wetness: middle to low, water absorptivity: 1.4 seconds, dryness: 72%, washing durability: 30 times, texture: slightly hard. The fiber strength of polylactic acid fibers contained in the woven fabric was 3.5 cN/dtex.

In the above, ten single yarns (filaments) to be tested were randomly extracted from the woven fabric. Then, under the conditions where the yarn sample length was 50 mm (length between chucks) and the elongation rate was 500 mm/min, a strain-stress curve was measured at an ambient temperature of 20° C. and a relative humidity of 65% RH using "TENSILON" (product name) manufactured by Orientec. The strength (cN/yarn) was determined from the stress and tension at the breaking point, and then the strength was divided by fineness to determine fiber strength (cN/dtex).

Besides, with respect to wetness, first, 0.3 cc of water was placed on an acrylic plate. A woven or knitted fabric cut into a 10 cm square was placed thereon, and, while applying a load of 2.9 mN/cm$^2$ (0.3 gf/cm$^2$), the woven or knitted fabric was allowed to sufficiently absorb water for 30 seconds. After that, the water-soaked woven or knitted fabric was placed on the upper arms of ten panelists, including five men and five women, and the sensory evaluation of wetness was performed. In the evaluation, wetness was evaluated on a four-level scale: extremely low (the best), low, middle, high. Incidentally, the amount of water, 0.3 ml, placed on the acrylic plate was enough to run over the entire 10-cm square cloth.

With respect to dryness, first, the initial mass (A) of a woven or knitted fabric cut into a 10 cm square is measured. The woven or knitted fabric is then placed on a horizontally placed constant-temperature plate controlled at 32° C., and water is supplied thereto from the back of the woven or knitted fabric by a metering pump at a rate of 0.2 cc/min for 10 minutes to give excess moisture to the cloth. Water supply is stopped in 10 minutes, and the mass (B) of the woven or knitted fabric at this time is measured. The fabric is then allowed to stand in a constant-temperature chamber controlled at 32° C. After standing for 10 minutes, the mass (C) of the woven or knitted fabric is measured again. Dryness was evaluated using the following equation.

$$\text{Dryness } (\%)=((B-C)/(B-A))\times 100$$

Incidentally, the dryness thus defined is a value from 0 to 100, and a higher value indicates higher dryness. The dryness evaluation method shown herein is an experimental evaluation method supposing that sweating starts with the start of exercise and stops after the exercise, simulating the case where an exercise in which the amount of sweat absorbed by the woven or knitted fabric is about 200 g/m$^2$/h is performed for 1 hour, followed by a rest for 10 minutes. As the exercise in which the amount of sweat absorbed by a cloth is about 200 g/m$^2$/h, the case where basketball, tennis, running, or the like is seriously played for about 1 hour can be mentioned. Usually, in the case where a commercially available cotton T-shirt is worn as outerwear, the cotton T-shirt is completely soaked with sweat.

With respect to water absorptivity, measurement was performed according to the test method of JIS L-1018:1998 A (falling-drop method), related to the rate of water absorption. The time for one drop of water on a horizontal sample surface to be absorbed was shown.

With respect to washing durability, washing was performed in an ordinary household washing machine, and the number of washes at the time when the initial performance was halved was evaluated.

With respect to the texture of a woven or knitted fabric, a 30-cm square woven or knitted fabric was subjected to sensory evaluation by blindfolded ten panelists, including five men and five women. In terms of softness, the fabric was evaluated on a four-level scale: soft (the best), slightly software, slightly hard, hard.

With respect to thickness, in the case of a woven fabric, the thickness was measured according to the thickness measurement method of JIS L-1096:1998, 6.5, while in the case of a knitted fabric, the thickness was measured according to the thickness measurement method of JIS L-1018: 1998, 6.5.

With respect to contact angle, using a contact angle measuring apparatus (manufactured by Erma), the contact angle between the binder resin and an ordinary polyethylene terephthalate fiber was measured.

Incidentally, at the time of melt-kneading and yarn making, no isocyanate odor was detected. Also, when the obtained structure was melted at 300° C. for 5 minutes, the result of isocyanate odor evaluation was acceptable.

The carboxyl end group concentration of a polylactic acid filament sampled immediately after spinning was 1 eq/ton, and the carboxyl end group concentration of the cloth was 2 eq/ton.

Example 49

The example was performed in the same manner as in Example 48, except that the stereocomplex polylactic acid chips obtained by the procedure of Reference Example 9 and the cyclic carbodiimide compound (2) were used. The obtained woven fabric was as follows: warp density: 140 yarns/2.54 cm, grey-fabric weft density: 180 yarns/2.54 cm, thickness: 0.5 mm, wetness: middle to low, water absorptivity: 1.3 seconds, dryness: 71%, washing durability: 31 times, texture: slightly hard. The fiber strength of polylactic acid fibers contained in the woven fabric was 3.6 cN/dtex. (Each value was calculated in the same manner as described in Example 48.)

Incidentally, at the time of melt-kneading and yarn making, no isocyanate odor was detected. Also, when the obtained structure was melted at 300° C. for 5 minutes, the result of isocyanate odor evaluation was acceptable. The carboxyl end group concentration of a polylactic acid filament sampled immediately after spinning was 1 eq/ton, and the carboxyl end group concentration of the cloth was 1 eq/ton.

Example 50

The example was performed in the same manner in Example 49, except that the weft was changed to a false-twist crimped yarn (used in 1:1) having a total fineness of 190 dtex/48 filaments and made of polyethylene terephthalate containing 3-carbomethoxy sodium benzenesulfonate-5-sodium carboxylate (1.3 mol % relative to dimethyl terephthalate) as a micropore-forming agent, and that immediately before dyeing, alkali weight-reduction was performed in a 35 g/l aqueous sodium hydroxide solution (temperature: 95° C.) whereby irregularities having a depth of about 0.01 to 10 μm were formed in the single yarn fiber surface.

The obtained woven fabric was as follows: warp density: 140 yarns/2.54 cm, grey-fabric weft density: 180 yarns/2.54 cm, thickness: 0.5 mm, wetness: extremely low, water absorptivity: 0.4 seconds, dryness: 88%, washing durability: 49 times, texture: soft (each value was calculated in the same manner as described in Example 48).

Incidentally, at the time of melt-kneading and yarn making, no isocyanate odor was detected. Also, when the obtained structure was melted at 300° C. for 5 minutes, the result of isocyanate odor evaluation was acceptable. The carboxyl end group concentration of a polylactic acid filament sampled immediately after spinning was 2 eq/ton, and the carboxyl end group concentration of the cloth was 2 eq/ton.

Example 51

The example was performed in the same manner in Example 49, except that the single-fiber transverse cross-sectional shape of the false-twist crimped yarn used as the weft was changed to the flat shape with four peaks as shown in FIG. 1.

The obtained woven fabric was as follows: warp density: 140 yarns/2.54 cm, grey-fabric weft density: 180 yarns/2.54 cm, thickness: 0.5 mm, wetness: extremely low, water absorptivity: 0.3 seconds, dryness: 89%, washing durability: 42 times, texture: soft (each value was calculated in the same manner as described in Example 48).

Incidentally, at the time of melt-kneading and yarn making, no isocyanate odor was detected. Also, when the obtained structure was melted at 300° C. for 5 minutes, the result of isocyanate odor evaluation was acceptable. The carboxyl end group concentration of a polylactic acid filament sampled immediately after spinning was 2 eq/ton, and the carboxyl end group concentration of the cloth was 2 eq/ton.

Example 52

The example was performed in the same manner in Example 49, except that the square size of the checkerboard grid pattern was changed to 0.4 mm×0.4 mm.

The obtained woven fabric was as follows: warp density: 140 yarns/2.54 cm, grey-fabric weft density: 180 yarns/2.54 cm, thickness: 0.5 mm, wetness: middle, water absorptivity: 1.8 seconds, dryness: 44%, washing durability: 8 times, texture: slightly hard (each value was calculated in the same manner as described in Example 48).

Incidentally, at the time of melt-kneading and yarn making, no isocyanate odor was detected. Also, when the obtained structure was melted at 300° C. for 5 minutes, the result of isocyanate odor evaluation was acceptable. The carboxyl end group concentration of a polylactic acid filament sampled immediately after spinning was 2 eq/ton, and the carboxyl end group concentration of the cloth was 3 eq/ton.

Example 53

The example was performed in the same manner in Example 49, except that the square size of the checkerboard grid pattern was changed to 3 mm×3 mm (area percentage of the application part: 50%).

The obtained woven fabric was as follows: warp density: 140 yarns/2.54 cm, grey-fabric weft density: 180 yarns/2.54 cm, thickness: 0.5 mm, wetness: middle, water absorptivity: 1.9 seconds, dryness: 40%, washing durability: 9 times, texture: slightly hard (each value was calculated in the same manner as described in Example 48).

Incidentally, at the time of melt-kneading and yarn making, no isocyanate odor was detected. Also, when the obtained structure was melted at 300° C. for 5 minutes, the result of isocyanate odor evaluation was acceptable. The carboxyl end group concentration of a polylactic acid filament sampled immediately after spinning was 2 eq/ton, and the carboxyl end group concentration of the cloth was 2 eq/ton.

Comparative Example 30

The same procedure as in Example 48 was performed, except that a linear polycarbodiimide compound [manufactured by Nisshinbo Chemical; "CARBODILITE" HMV-8CA] was used in place of the cyclic carbodiimide compound (1).

The obtained woven fabric was as follows: warp density: 140 yarns/2.54 cm, grey-fabric weft density: 180 yarns/2.54 cm, thickness: 0.5 mm, wetness: middle, water absorptivity: 2.0 seconds, dryness: 44%, washing durability: 8 times, texture: slightly hard (each value was calculated in the same manner as described in Example 48).

The carboxyl end group concentration of a polylactic acid filament sampled immediately after spinning was 2 eq/ton, and the carboxyl end group concentration of the water-absorbing cloth was 2 eq/ton. However, an isocyanate odor was detected especially at the time of spinning. Also, when the obtained structure was melted at 300° C. for 5 minutes, the result of isocyanate odor evaluation was unacceptable.

Comparative Example 31

The same procedure as in Example 48 was performed, except that the cyclic carbodiimide compound (1) was not used.

The obtained woven fabric was as follows: warp density: 140 yarns/2.54 cm, grey-fabric weft density: 180 yarns/2.54 cm, thickness: 0.5 mm, wetness: middle, water absorptivity: 1.9 seconds, dryness: 40%, washing durability: 7 times, texture: slightly hard (each value was calculated in the same manner as described in Example 48).

Incidentally, at the time of melt-kneading and spinning, no isocyanate odor was detected. Also, upon melting at 300° C. for 5 minutes, the result of isocyanate odor evaluation was acceptable. However, the carboxyl end group concentration of a polylactic acid filament sampled immediately after spinning was 29 eq/ton, and the carboxyl end group concentration of the water-absorbing cloth was 38 eq/ton, indicating poor hydrolysis resistance.

Reference Example 10

25 parts of an azo red organic pigment (C.I. Pigment Red 150), 25 parts of a polymeric dispersant having a weight-average molecular weight of 8,500 and containing a carboxyl group as an ionic group and a phenyl group as a hydrophobic group ("JONCRYL 62": manufactured by BASF Japan), 5 parts of propylene glycol, and 45 parts of water were mixed, and dispersed in an attritor (glass beads 0.6 mm in diameter, batch-type dispersing machine) for 48 hours to give a red pigment dispersion of 0.285 μm.

Next, 95 parts of water and 2.5 parts of a polyacrylic thickener ("ALCOPRINT PTF": manufactured by Ciba Specialty Chemical) was uniformly stirred and mixed to give a turpentine-free reducer (reducer).

Further, 5 parts of the red pigment dispersion, 95 parts of the reducer, and 3 parts of a blocked isocyanate crosslinking agent ("FIXER N": manufactured by Matsui Shikiso Chemical) were incorporated to give a color ink for screen printing (red).

Example 54

The poly(L-lactic acid) chips obtained by the procedure of Reference Example 9 and the cyclic carbodiimide compound (1) were separately dried and then mixed in a weight ratio of 99:1. The mixture was melted in an extruder-type spinning machine at a temperature of 220° C., discharged from a spinneret having 30 discharge holes, and then cooled in a spinning chimney. After that, an oil was applied thereto, and the undrawn yarn was wound up at a rate of 500 m/min. The undrawn yarn was drawn to 4.9 times its original length at a preheating temperature of 80° C., subsequently heat-treated at 130° C., and wound up as a fiber of 56 dtex/20 filaments.

By the same procedure as above, a fiber having a fineness of 84 dtex/36 filaments was also obtained.

Next, using the fiber having a total fineness of 56 dtex/20 filaments as the warp and the multifilament having a total fineness of 84 dtex/36 filaments as the weft, a taffeta woven fabric having a warp density of 76 yarns/2.54 cm and a weft density of 90 yarns/2.54 cm was obtained. Further, the color ink for screen printing obtained in Reference Example 10 was hand-printed on the taffeta woven fabric using a 100-mesh screen stencil with a polka-dot pattern, dried at 100° C. in a dryer, and heat-treated at 130° C. for 3 minutes to give a colored cloth with red polka dots.

The thus-processed fiber structure had a washing fastness of Class 4. After treatment at 70° C.×90% RH for a week, the fiber strength of polylactic acid fibers contained in the woven fabric was 1.8 cN/dtex (300 g/yarn). Next, using the woven fabric, a uniform, a car interior material (car seat skin material), and an upholstery material (chair covering) were obtained. They had excellent washing fastness together with excellent durability. Incidentally, at the time of melt-kneading and yarn making, no isocyanate odor was detected. Also, when the obtained structure was melted at 300° C. for 5 minutes, the result of isocyanate odor evaluation was acceptable.

The carboxyl end group concentration of a polylactic acid filament sampled immediately after spinning was 1 eq/ton, and the carboxyl end group concentration of the cloth before printing was 2 eq/ton.

Incidentally, in this example, washing fastness was determined based on the following AATCC II-A method.

A) Apparatus and Material:

1. Launderometer: 40 to 44 rpm
2. Test bottle (made of stainless steel): 450 to 550 ml
3. Stainless-steel ball: 0.4 mm in diameter, 50 balls per bottle
4. Soap: Solid laundry soap (JIS K3302:1985), additive-free (one kind)
5. Sodium metasilicate ($Na_2SiO_3$ $5H_2O$)
6. Glacial acetic acid
7. Flat iron
8. Centrifugal dehydrator or wringer B) Standard Adjacent Fabric:

AATCC Multifiber No. 1

Woof: Acetate, cotton, nylon, silk, rayon, wool

Warp: Polyester (spun yarn)

C) Preparation of Specimen:

A specimen measuring 15 cm in length×5 cm in width is taken. A standard adjacent fabric (Multifiber No. 1) measuring 5 cm×5 cm is brought into contact with the center of the specimen, and the four side of the fabric are loosely sewn thereto using a white cotton yarn. In the case of a knitted fabric, a bleached muslin with the same size as the specimen and a density of 80 (yarns/2.54 cm)×(yarns/2.54 cm) is used, and all the four sides are sewn to the specimen to prevent its ends from getting caught during the test.

D) Test Operation:

150 ml of a solution containing 0.2% soap and 0.2% sodium metasilicate is placed in a test bottle, and 50 hard stainless steel balls are placed therein. After preheating to a temperature of 49° C., a composite specimen is placed therein. The bottle is hermetically sealed, attached to a rotary shaft, and rotated at a temperature of 49° C. for 45 minutes. Next, without cooling, the composite specimen is immediately removed from the test bottle, washed twice with 100 ml of hot water (40° C.) for 1 minute, and further washed with 100 ml of water (27° C.) for 1 minute. Subsequently, the composite specimen is dehydrated in a centrifugal dehydrator or wringer, and then press-dried with a flat iron at a temperature of 135° C. to 150° C. while the specimen and the standard adjacent fabric remain attached together.

E) Determination:

Staining of Multifiber No. 1 is determined based on the staining of a nylon part using the grey scale according to JIS L-0801:2004.

Example 55

The example was performed in the same manner as in Example 54, except that the stereocomplex polylactic acid chips obtained by the procedure of Reference Example 9 and the cyclic carbodiimide compound (2) were used. The printed fiber structure had a washing fastness of Class 4. After treatment at 70° C.×90% RH for a week, the fiber strength of polylactic acid fibers contained in the woven fabric was 1.9 cN/dtex (300 g/yarn).

Next, using the woven fabric, a uniform, a car interior material (car seat skin material), and an upholstery material (chair covering) were obtained. They had excellent washing fastness together with excellent durability (washing fastness was measured in the same manner as in Example 54). Incidentally, at the time of melt-kneading and yarn making, no isocyanate odor was detected. Also, when the obtained structure was melted at 300° C. for 5 minutes, the result of isocyanate odor evaluation was acceptable. The carboxyl end group concentration of a polylactic acid filament sampled immediately after spinning was 1 eq/ton, and the carboxyl end group concentration of the cloth before printing was 1 eq/ton.

Comparative Example 32

The same procedure as in Example 54 was performed, except that a linear polycarbodiimide compound [manufactured by Nisshinbo Chemical; "CARBODILITE" HMV-8CA] was used in place of the cyclic carbodiimide compound (1). The printed fiber structure had a washing fastness of Class 4. After treatment at 70° C.×90% RH for a week, the fiber strength of polylactic acid fibers contained in the woven fabric was 1.8 cN/dtex (300 g/yarn). Next, using the woven fabric, a uniform, a car interior material (car seat skin material), and an upholstery material (chair covering) were obtained. They had excellent washing fastness together with excellent durability (washing fastness was measured in the same manner as in Example 54).

The carboxyl end group concentration of a polylactic acid filament sampled immediately after spinning was 2 eq/ton, and the carboxyl end group concentration of the cloth was 2 eq/ton. However, an isocyanate odor was detected especially at the time of spinning. Also, when the obtained structure was melted at 300° C. for 5 minutes, the result of isocyanate odor evaluation was unacceptable.

Comparative Example 33

The same procedure as in Example 54 was performed, except that the cyclic carbodiimide compound (1) was not used.

The printed fiber structure had a washing fastness of Class 2. After treatment at 70° C.×90% RH for a week, the fiber strength of polylactic acid fibers contained in the woven fabric was 0.8 cN/dtex (300 g/yarn) (washing fastness was measured in the same manner as in Example 54).

Incidentally, at the time of melt-kneading and spinning, no isocyanate odor was detected. Also, upon melting at 300° C. for 5 minutes, the result of isocyanate odor evaluation was acceptable. However, the carboxyl end group concentration of a polylactic acid filament sampled immediately after spinning was 32 eq/ton, and the carboxyl end group concentration of the cloth before printing was 36 eq/ton, indicating poor hydrolysis resistance.

Reference Example 11

25 parts of a blue organic pigment (C.I. Solvent Blue 45, manufactured by Clariant Japan), 25 parts of a polymeric dispersant having a weight-average molecular weight of 8,500 and containing a carboxyl group as an ionic group and a phenyl group as a hydrophobic group ("JONCRYL 62": manufactured by BASF Japan), 5 parts of propylene glycol, and 45 parts of water were mixed, and dispersed for hours in an attritor (glass beads 0.6 mm diameter, batch-type dispersing machine) to give a blue pigment dispersion.

Next, 95 parts of water and 2.5 parts of a polyacrylic thickener ("ALCOPRINT PTF": manufactured by Ciba Specialty Chemical) was uniformly stirred and mixed to give a turpentine-free reducer (reducer).

Further, 5 parts of the blue pigment dispersion, 95 parts of the reducer, and 3 parts of a blocked isocyanate crosslinking agent ("FIXER N": manufactured by Matsui Shikiso Chemical) were incorporated to give a color ink for screen printing (blue).

Example 56

The poly(L-lactic acid) chips obtained by the procedure of Reference Example 9 and the cyclic carbodiimide compound (1) were separately dried and then mixed in a weight ratio of 99:1. The mixture was melted in an extruder-type spinning machine at a temperature of 220° C., discharged from a spinneret having 30 discharge holes, and then cooled in a spinning chimney. After that, an oil was applied thereto, and the undrawn yarn was wound up at a rate of 500 m/min.

The undrawn yarn was drawn to 4.9 times its original length at a preheating temperature of 80° C., followed by a heat treatment at 130° C. The process-passing properties were excellent in the spinning process and the drawing process. The wound drawn yarn was a multifilament having a fineness of 167 dtex/36 filaments, a strength of 3.6 cN/dtex, and an elongation of 35%.

Two of the obtained polylactic acid filaments were joined together, twisted 160 times/m, and woven as the warp and weft into a woven fabric having a twill weave structure. After that, the woven fabric was subjected to dry heat setting at a temperature of 130° C. for 2 minutes, and then dyed at a temperature of 120° C. for 30 minutes using a jet dyeing machine. At that time, the following disperse dye was used to perform dyeing and reduction clearing.

(Dyeing Conditions)

Disperse Dye: C.I. Disperse Blue 79: 1% owf

The obtained dyed article was cleared in the following reducing bath (pH 5.5).

Bath ratio: 1:20

Temperature×Time: 120° C.×30 minutes

Reducing Bath Composition and Clearing Conditions:

Thiourea dioxide: 1 g/l

Bath ratio: 1:20

Temperature×Time: 70° C.×15 minutes

Next, drying was performed at a temperature of 110° C. for 10 minutes, followed by dry heat setting at a temperature of 130° C. for 2 minutes. Further, the color ink for screen printing obtained in Reference Example 11 was hand-printed on a woven fabric, dried at 100° C. in a dryer, and heat-treated at 130° C. for 3 minutes to give a blue colored cloth.

The thus-processed fiber structure had an L value of 39, a washing fastness of Class 4, and a rubbing fastness of Class 3 (washing fastness was measured in the same manner as in Example 54).

Next, using the woven fabric, a uniform, a car interior material (car seat skin material), and an upholstery material (chair covering) were obtained. They had excellent washing fastness together with excellent durability.

Incidentally, at the time of melt-kneading and yarn making, no isocyanate odor was detected. Also, when the obtained structure was melted at 300° C. for 5 minutes, the result of isocyanate odor evaluation was acceptable.

The carboxyl end group concentration of a polylactic acid filament sampled immediately after spinning was 1 eq/ton, and the carboxyl end group concentration of the cloth before dyeing was 2 eq/ton.

Incidentally, in this example, the color L value (L value of the structure after dyeing) was measured from the cloth surface using a spectrophotometer (Gretag MacBeth Color-Eye 7000A). The L value shows lightness, and a greater value indicates higher lightness. A value closer to 100 indicates a lighter, whiter color, while a value closer to 0 indicates a deeper color. Rubbing fastness (dyed structure) was evaluated according to JIS L-0849:2004, Rubbing Tester, Type II (JSPS type), using the grey scale. A fastness of Class 3 or higher was rated as acceptable.

Example 57

The stereocomplex polylactic acid chips obtained by the procedure of Reference Example 9 and the cyclic carbodiimide compound (2) were separately dried and then mixed in a weight ratio of 99:1. The mixture was melted in an extruder-type spinning machine at a temperature of 220° C., discharged from a spinneret having 30 discharge holes, and then cooled in a spinning chimney. After that, an oil was applied thereto, and the undrawn yarn was wound up at a rate of 500 m/min. The following processes were performed in the same manner as in Example 56.

The thus-processed, printed fiber structure had an L value of 36, a washing fastness of Class 4, and a rubbing fastness of Class 3 to 4 (each value was calculated by the same method as described in Example 56). Next, using the woven fabric, a uniform, a car interior material (car seat skin material), and an upholstery material (chair covering) were obtained. They had excellent washing fastness together with excellent durability. Incidentally, at the time of melt-kneading and yarn making, no isocyanate odor was detected. Also, when the obtained structure was melted at 300° C. for 5 minutes, the result of isocyanate odor evaluation was acceptable.

The carboxyl end group concentration of a polylactic acid filament sampled immediately after spinning was 1 eq/ton, and the carboxyl end group concentration of the cloth before dyeing was 1 eq/ton.

Comparative Example 34

The same procedure as in Example 56 was performed, except that a linear polycarbodiimide compound [manufactured by Nisshinbo Chemical; "CARBODILITE" HMV-8CA] was used in place of the cyclic carbodiimide compound (1).

The printed fiber structure had a washing fastness of Class 4 and a rubbing fastness of Class 3 (each value was calculated by the same method as described in Example 56). Next, using the woven fabric, a uniform, a car interior material (car seat skin material), and an upholstery material (chair covering) were obtained. They had excellent washing fastness together with excellent durability.

The carboxyl end group concentration of a polylactic acid filament sampled immediately after spinning was 2 eq/ton, and the carboxyl end group concentration of the cloth was 2 eq/ton. However, an isocyanate odor was detected at the time of spinning. Also, when the obtained cloth was melted at 300° C. for 5 minutes, the result of isocyanate odor evaluation was unacceptable.

INDUSTRIAL APPLICABILITY

According to the invention, it is possible to provide a fiber and a fiber structure, which have improved hydrolysis resistance and from which no free isocyanate compounds are produced.

Further, acidic groups of a polymer can be capped with a carbodiimide compound without the release of an isocyanate compound. As a result, the generation of an offensive odor from a free isocyanate compound can be suppressed, whereby the working environment can be improved.

In addition, when polymer chain ends are capped with a cyclic carbodiimide compound, isocyanate groups are produced at the polymer chain ends. The reaction of such isocyanate groups allows the molecular weight of the polymer to be further increased. A cyclic carbodiimide compound also has the function of capturing free monomers or other acidic-group-containing compounds in the polymer. Further, according to the invention, because of its ring structure, the cyclic carbodiimide compound has an advantage in that ends can be capped under milder conditions as compared with commonly used linear carbodiimide compounds.

The difference in end-capping reaction mechanism between a linear carbodiimide compound and a cyclic carbodiimide compound is as follows.

When a linear carbodiimide compound ($R_1$—N═C═N—$R_2$) is used as a carboxyl-end-capping agent for a polymer, for example, polylactic acid, the reaction is as shown in the formula below. Through a reaction of a linear carbodiimide compound with a carboxyl group, an amide group is formed at the end of polylactic acid, and an isocyanate compound ($R_1$NCO) is released.

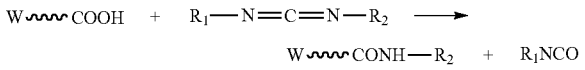

(In the formula, W is the main chain of polylactic acid.)

Meanwhile, when a cyclic carbodiimide compound is used as a carboxyl-end-capping agent for a polymer, for example, polylactic acid, the reaction is as shown in the formula below. Through a reaction of a cyclic carbodiimide compound with a carboxyl group, an isocyanate group (—NCO) is formed at the end of polylactic acid via an amide group. It will be understood that no isocyanate compound is released.

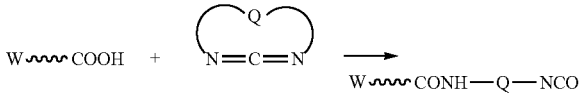

(In the formula, W is the main chain of polylactic acid, and Q is a divalent to tetravalent linking group that is an aliphatic group, an alicyclic group, an aromatic group, or a combination thereof.)

The invention claimed is:

1. A fiber comprising a composition obtained by mixing:

a compound having at least a ring structure containing only one carbodiimide group with the first nitrogen and second nitrogen thereof being linked together through a linking group; with a polymer compound having an acidic group, wherein the fiber has a single-fiber fineness in a range of 0.02 dtex to 10,000 dtex, wherein the ring structure is represented by the following formula (1), and the number of atoms forming the ring structure is 8 to 20:

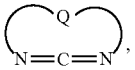

(1)

wherein Q is a divalent to tetravalent linking group represented by the following formula (1-1) or (1-2):

$$—Ar^1—(O—X^1)_s—O—Ar^2— \quad (1-1)$$

$$—R^1—(O—X^2)_k—O—R^2— \quad (1-2)$$

wherein $Ar^1$ and $Ar^2$ are each independently a divalent to tetravalent aromatic group having 5 to 15 carbon atoms, $R^1$ and $R^2$ are each independently a divalent to tetravalent aliphatic group having 1 to 20 carbon atoms, a divalent to tetravalent alicyclic group having 3 to 20 carbon atoms, a combination thereof, or a combination of the aliphatic or alicyclic group with a divalent to tetravalent aromatic group having 5 to 15 carbon atoms, $X^1$ and $X^2$ are each independently a divalent to tetravalent aliphatic group having 1 to 20 carbon atoms, a divalent to tetravalent alicyclic group having 3 to 20 carbon atoms, a divalent to tetravalent aromatic group having 5 to 15 carbon atoms, or a combination thereof, and s is an integer of 0 to 10 and k is an integer of 0 to 10, with the proviso that when s or k is 2 or more, $X^1$ or $X^2$ as a repeating unit may be different from the other $X^1$ or $X^2$, with the proviso that $Ar^1$, $Ar^2$, $R^1$, $R^2$, $X^1$, and $X^2$ optionally contain a heteroatom, when Q is a divalent linking group, $Ar^1$, $Ar^2$, $R^1$, $R^2$, $X^1$, and $X^2$ are all divalent groups, when Q is a trivalent linking group, one of $Ar^1$, $Ar^2$, $R^1$, $R^2$, $X^1$, and $X^2$ is a trivalent group, and when Q is a tetravalent linking group, one of $Ar^1$, $Ar^2$, $R^1$, $R^2$, $X^1$, and $X^2$ is a and tetravalent group or two of $Ar^1$, $Ar^2$, $R^1$, $R^2$, $X^1$, and $X^2$ are trivalent groups.

2. A fiber according to claim 1, wherein the compound having a ring structure is represented by the following formula (2):

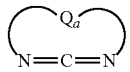

(2)

wherein $Q_a$ is a divalent linking group represented by the following formula (2-1) or (2-2):

$$—Ar_a^1—(O—X_a^1)_s—O—Ar_a^2— \quad (2-1)$$

$$—R_a^1—(O—X_a^2)_k—O—R_a^2— \quad (2-2)$$

wherein $Ar_a^1$, $Ar_a^2$, $R_a^1$, $R_a^2$, $X_a^1$, $X_a^2$, s, and k are as defined for $Ar^1$, $Ar^2$, $R^1$, $R^2$, $X^1$, $X^2$, s, and k of formulae (1-1) to (1-2), respectively.

3. A fiber according to claim 1, wherein the compound having a ring structure is represented by the following formula (3):

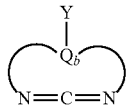

(3)

wherein $Q_b$ is a trivalent linking group represented by the following formula (3-1) or (3-2):

$$—Ar_b^1—(O—X_b^1)_s—O—Ar_b^2— \quad (3-1)$$

$$—R_b^1—(O—X_b^2)_k—O—R_b^2— \quad (3-2)$$

wherein $Ar_b^1$, $Ar_b^2$, $R_b^1$, $R_b^2$, $X_b^1$, $X_b^2$, s, and k are as defined for $Ar^1$, $Ar^2$, $R^1$, $R^2$, $X^1$, $X^2$, s, and k of formulae (1-1) to (1-2), respectively, with the proviso that one of the groups is a trivalent group.

4. A fiber according to claim 3, wherein Y is a single bond, a double bond, an atom, an atomic group, or a polymer.

5. A fiber according to claim 1, wherein the compound having a ring structure is represented by the following formula (4):

(4)

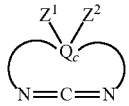

wherein $Q_c$ is a tetravalent linking group represented by the following formula (4-1) or (4-2):

$$—Ar_c^1—(O—X_c^1)_s—O—Ar_c^2— \quad (4\text{-}1)$$

$$—R_c^1—(O—X_c^2)_k—O—R_c^2— \quad (4\text{-}2)$$

wherein $Ar_c^1$, $Ar_c^2$, $R_c^1$, $R_c^2$, $X_c^1$, $X_c^2$, s, and k are as defined for $Ar^1$, $Ar^2$, $R^1$, $R^2$, $X^1$, $X^2$, s, and k of formulae (1-1) to (1-2), respectively, with the proviso that one of the groups is a tetravalent group or two of the groups are trivalent groups.

6. A fiber according to claim 5, wherein $Z^1$ and $Z^2$ are each independently a single bond, a double bond, an atom, an atomic group, or a polymer.

7. A fiber according to claim 1, wherein the polymer compound having an acidic group is at least one member selected from the group consisting of aromatic polyesters, aliphatic polyesters, polyamides, polyamideimide, and polyester amides.

8. A fiber according to claim 7, wherein the aromatic polyester contains as a main repeating unit at least one member selected from the group consisting of butylene terephthalate, ethylene terephthalate, trimethylene terephthalate, ethylene naphthalene dicarboxylate, and butylene naphthalene dicarboxylate.

9. A fiber according to claim 7, wherein the aliphatic polyester is polylactic acid.

10. A fiber according to claim 9, wherein the polylactic acid forms a stereocomplex crystal.

11. A fiber structure using at least a fiber according to claim 1.

12. A fiber structure according to claim 11, wherein the fiber structure is in at least one form selected from a textured yarn, a woven fabric, a knitted fabric, and a nonwoven fabric.

13. A fiber according to claim 1, wherein the single-fiber fineness is in a range of 0.1 dtex to 3000 dtex.

14. A fiber according to claim 1, wherein the fiber has a total fineness in a range of 20 dtex to 10,000 dtex.

15. A fiber according to claim 1, wherein the polymer compound having an acidic group is poly(4-oxyphenylene-2,2-propylidene-4-oxyphenylene-terephthaloyl-co-isophthaloyl).

16. A fiber according to claim 1, wherein the compound having a ring structure is:

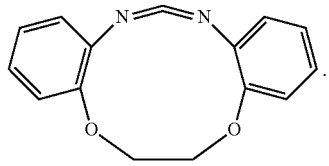

17. A fiber according to claim 5, wherein the compound having a ring structure is:

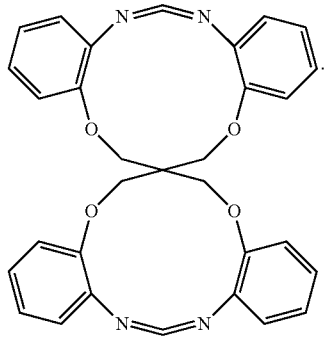

* * * * *